US008820746B2

(12) United States Patent
Poulos

(10) Patent No.: US 8,820,746 B2
(45) **Date of Patent: *Sep. 2, 2014**

(54) METHODS AND DEVICES FOR ON-THE-ROLL SPORTS GAMES

(71) Applicant: Jeff Poulos, Huntington Station, NY (US)

(72) Inventor: Jeff Poulos, Huntington Station, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/034,225

(22) Filed: Sep. 23, 2013

(65) Prior Publication Data

US 2014/0021682 A1 Jan. 23, 2014

Related U.S. Application Data

(63) Continuation of application No. 13/752,182, filed on Jan. 28, 2013, now Pat. No. 8,540,247, which is a continuation-in-part of application No. 12/748,919, filed on Mar. 29, 2010, now Pat. No. 8,360,433, which is a continuation of application No. 10/817,119, filed on Apr. 2, 2004, now Pat. No. 7,686,304.

(60) Provisional application No. 60/459,863, filed on Apr. 2, 2003.

(51) Int. Cl.
*A63F 3/00* (2006.01)

(52) U.S. Cl.
USPC ..... 273/247; 273/287; 273/259; 273/244; 273/277

(58) Field of Classification Search
USPC ..... 273/244, 247, 259, 277, 287
See application file for complete search history.

(56) References Cited

U.S. PATENT DOCUMENTS 8,360,433 B2 * 1/2013 Poulos ..... 273/247

* cited by examiner

*Primary Examiner* — Vishu K. Mendiratta
(74) *Attorney, Agent, or Firm* — Harvey Lunenfeld

(57) ABSTRACT

A realistic professional team sports board game, including an On-The-Roll mechanism where, once play begins, real time play continues, generally against a clock, opposing teams continue to roll dice continuing sub-play actions or elements, until a play is completed, as by a touchdown, tackle and a series of rules and charts, based on statistical compilation that maps various combinations of offensive and defensive strategies and dice rolls into realistic game situations and the progression among them. Both teams: secretly choose a strategy, generally by selecting a card placed face down; roll dice; reveal strategy choices by turning cards face up; determine a situation chart to consult, and further determine which result is selected from within the chart, based on some combination of which cards were played and the results of the dice rolls. A variety of play cards affect the overall game momentum of either team.

7 Claims, 69 Drawing Sheets

901

Pass

Fly (10-yards )
Best out of 3 rolls
Two dice, then Two dice
TPE

902

Run

Two dice, then OFF
One die alone, then
each team Two dice
TPE

903

West Coast Offense

Multiple Pass Offense

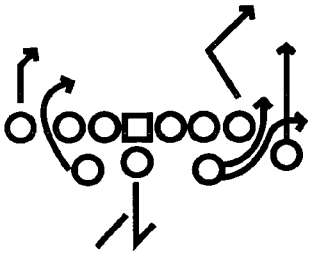

904

Play Option Run

Bomb (40-yard pass)
Best out of 5 rolls, single
Die
Screen Pass
Roll one die to see if R.B.
catches ball and gain that
value, then two Dice for
yards TPE
Slant
One double die roll only
Doubles rule applies

905

Zone Coverage

PASS DEF THAT ALLOWS DEFENSE TO BETTER POSITION FOR THE RUN AS WELL

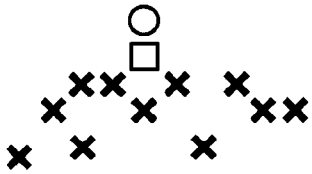

906

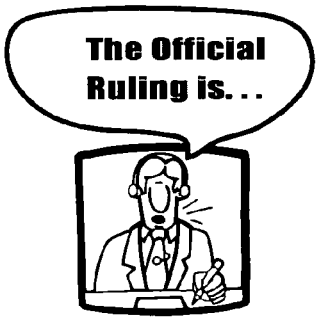

Referee Rules

No Infraction On The Play

FIGURE 9

| GAME CLOCKS | |
|---|---|
| DESCRIPTION AND SETTINGS | There are Two Game Clocks working together to accurately compute the game timing.<br>1. The Game Clock: set to a regulation 15 minutes and controlled by the Offense. This clock counts down from 15 minutes to zero the end of a quarter.<br>2. The Play Clock: set to 30 or 40 seconds prior to the game agreed upon between the players and controlled by the Defense. This clock counts down from the seconds agreed upon and will produce an Immediate 5-yard delay of game penalty for the OFF if it runs out of time. |
| PROCEDURE | The Two Time Versions of OTR Football.<br>1. Two-15 minute quarters looked at as two halves. Regulation stops apply, but it also stops to review the play chart outcomes, adjust the field markers, and discussions over the game procedures without using a time out. No play clock is used.<br>2. Four-15 minute quarters. Here the clock runs under professional football guidelines with regulation stops applying only. The Play Clock is use as well. |
| REGULATION STOPS | 1. Incomplete pass.<br>2. Change of Possession after the play ends.<br>3. Declared Fair Catch or Touch Back.<br>4. Out of Bounds of any sort.<br>5. After a score of any type.<br>6. The 2-minute warning.<br>7. Team timeouts.<br>8. The end of a quarter where the teams switch end zones.<br>9. After the Kick-Off, Field Goal, Punt or On Side Kick.<br>10. Coaches challenge<br>11. Penalties. Immediately for OFF, After the Play Ends for DEF,<br>"At Snap" OTR game Penalties such as using the wrong dice or play cards. |
| TEAM TIMEOUTS | 3-per team per half. The length should be negotiated between the players. |
| OVERTIME | One-15 minute quarter of sudden death, the first team to score any Points, with only two team timeouts. After that the game is a draw. |
| NOTE | Timing is an extremely important element of the game of Football, Therefore it is expected of both teams to honor the rules governing keeping time and exercising an overall respect for each other's position in the game, meaning if one is winning or losing. The OFF controls the pace of the game, because if the OFF is winning they will look to eat up the clock, but if they are losing they will need to conserve as much time as possible, running plays fast and using timeouts. So the DEF must respect and be ready for either Offensive position.<br>See the players guide for strategies in clock management.<br>A single multi functional clock may be provided for use with the above rules of operation. |

FIGURE 10A

| All possible dice roll combinations<br>Basic win and lose outcomes based on two dice rolled. | | |
|---|---|---|
| OFF | DEF | OUTCOME |
| HI SUM (4+5=9) | LO SUM (4+3=7) | OFF wins |
| LO SUM (4+3=7) | HI SUM (4+5=9) | DEF wins |
| EQUAL SUM (4+5=9) | EQUAL SUM (6+3=9) | DEF wins<br>(Tie generally goes to DEF) |
| MATCHED SUM (4+5=9) | MATCHED SUMS (4+5=9) | DEF wins<br>(Tie generally goes to DEF) |
| DOUBLES (5+5=10) | NO DOUBLES (4+5=9) | OFF wins |
| NO DOUBLES (4+5=9) | DOUBLES (5+5=10) | DEF wins |
| HI DOUBLES (5+5=10) | LO DOUBLES (4+4=8) | OFF wins (Defaults to Hi/Lo rolls) |
| LO DOUBLES (4+4=8) | HI DOUBLES (5+5=10) | DEF wins (Defaults to Hi/Lo rolls) |
| EQUAL DOUBLES (4=4+8) | EQUAL DOUBLES (4+4=8) | DEF wins (Defaults to Hi/Lo rolls) |

| All possible dice roll combinations<br>Basic win and lose outcomes, based on one die rolled | | |
|---|---|---|
| OFF | DEF | OUTCOME |
| HI VALUE | LO VALUE | OFF wins |
| LO VALUE | HI VALUE | DEF wins |
| EQUAL (MATCHED) VALUES | EQUAL (MATCHED) VALUES | DEF wins |

FIGURE 10B

DICE RULES ON ROLLING FOR ADDITIONAL YARDS

1. This applies to the outcome of a Pass completion, Successful Run, Fumble, Interception, rolling Doubles or any other situation where there is eligibility for additional yards.
2. The following rules reflect the Sum of two dice rolled or one die rolled, any further details on these outcomes can be found in the appropriate play outcome chart.

Till Play Ends (TPE) indicates that the OFF has won the roll and can continue to roll any number of dice until the DEF beats the OFF roll, end of play.

DOUBLE DICE ROLLS

| OFF | DEF | OUTCOME |
|---|---|---|
| Hi Sum | Lo Sum | OFF advances sum of their roll, each team continues to roll till play ends. (TPE) |
| Lo Sum | Hi Sum | DEF stops gain, next down. |
| Equal or Match Sums | Equal or Match Sums | DEF stops gain, next down. Ties generally go to the DEF |
| Doubles | No Doubles | OFF advances sum of their roll and rolls two play dice alone once If they roll Doubles again they may continue to roll alone until no more Doubles are rolled and then each team continues to roll till play ends. (TPE) |
| Any Roll Except Double Ones and Sixes | Double Sixes | FUMBLE, each team rolls One die for possession and then one or two dice, depending on the particular play directive and circumstance, for yards till play ends. (TPE) |
| No Doubles | Doubles | DEF stops gain, next down. |
| Hi/ Lo or Equal Doubles | Hi/Lo or Equal Doubles | Defaults to Hi /Lo rolls. |

SINGLE DIE ROLLS

| OFF | DEF | OUTCOME |
|---|---|---|
| Hi Value | Lo value | OFF advances sum of roll, each team continues to roll till play ends. (TPE) |
| Lo Value | Hi Value | DEF stops gain, next down. |
| Equal Values | Equal Values | DEF stops gain, next down |
| Six | One | DEF PENALTY after the play ends |
| One | Six | Immediate OFF PENALTY. |
| Six | Six | Off setting Penalties on the play, Next Down. |

NOTE: Exceptions to a double six turnover are when the Offense has rolled double ones or sixes along with the DEF sixes, that is ruled a play out-of-bounds, next down, or when they are rolled on an "At Snap" penalty play or on a penalty pending play depending on the outcome of the penalty.

FIGURE 10C

PASS OFFENSE WINS

Doubles Rule applies in addition to extra rolls from chart directives.

| Play type | 8 Man Box | Man | Zone | Change | Nickel | Blitz |
|---|---|---|---|---|---|---|
| **Post:** (20-yards) Best out of 5 rolls Two dice then Two dice TPE. If DEF rolls any Doubles, Equal/Match sums during series Pass is Incomplete. (Inside 20 Pass is default 10-yards) | Sum, 2 dice TPE | Sum, each team 2 dice Once, ND | Sum, 2 dice TPE | Sum, 2 dice TPE | Sum, then OFF Penalty. | Sum, OFF extra 2 dice roll, each team 2 dice TPE |
| | Doubles: Sum, OFF extra 2 dice roll, 2 dice TPE | | | | | Doubles: Sum, OFF 2 extra 2 dice rolls, then each team 2 dice TPE |
| **Quick Out** Two dice, OFF gains value of Higher die rolled, ND. DEF can only prevent with any Doubles, Match/Equal sums. | Value, ND | Value, ND | Value, ND | Value, ND | OFF gains Value of Lower die rolled, ND OFF Penalty after play | Value, OFF extra One die roll, ND |
| | Doubles: Sum of Doubles, ND | | | | | Doubles: Sum, OFF extra 2 dice roll, ND |
| Cross Pattern Two dice roll If OFF loses roll each team keep Higher value die each team roll One die again to complete pass, then Two dice TPE. | Sum, each team 2 dice TPE | Sum, 2 dice TPE | Sum, Each team extra 2 dice once, ND | Same as Zone | OFF gains diff-between OFF/DEF first roll value only, ND | Sum, extra One die roll then each team 2 dice TPE |
| | Doubles: Sum, OFF extra One die roll, each team 2 dice TPE | | | | | Doubles: Sum, OFF extra 2 dice roll, then each team 2 dice TPE |
| Curl (7 Yards) Two dice, OFF must roll 7 or higher for a completion. DEF can only prevent with any Doubles | Sum, each team extra One die roll, ND | Sum, ND | Sum, each team extra One die roll ND | Sum, ND | OFF gains diff-between OFF/DEF roll, ND | Sum, extra One die roll alone, ND |
| | Doubles: Complete, each team extra 2 dice, ND | | | | | Doubles: Sum, OFF extra One die roll, then each team 2 dice TPE |
| Fly:(10-yards) Best out of 3 rolls Two dice, then Two dice TPE (Inside 20 pass is Default 5-yard) | Sum, Two dice TPE | Sum, Two dice TPE | Sum, ND | Same as Zone | Sum, then OFF Penalty. | Sum, OFF extra One die roll then each team Two dice TPE |
| | Doubles: Sum, OFF extra Two dice roll each team Two dice TPE | | | | | Doubles: Sum, OFF 2 extra Two dice roll, then each team Two dice TPE |

FIGURE 11A

RUN OFF WINS

Doubles Rule only applies for Two dice plays.

| Play type | 8 Man Box | Man | Zone | Change | Nickel | Blitz |
|---|---|---|---|---|---|---|
| Blast<br>Two dice, Def can only prevent with any Doubles, Equal or Match sums otherwise OFF gains sum of Higher die value rolled, ND | OFF gains value of Lower die rolled, ND | Value of Higher die rolled, ND | Value of Higher die rolled, ND | Same as Zone | Value of Higher die rolled, ND | OFF gains sum of 2 dice rolled, each team roll One die once more, ND |
| Pitch<br>Best of 3 rolls Two dice, OFF gains sum of last roll, then each team Two dice TPE | Diff-between OFF/DEF last roll, ND | Sum of last roll, then each team extra One die roll, ND | Sum of last roll then each team 2 dice once, ND | Same as Zone | Sum of last roll, then each team One die TPE | Sum of last roll, OFF extra One die roll, then each team 2 dice TPE |
| Misdirection<br>Two dice OFF gains value of Higher die rolled. If OFF loses roll each team roll Two dice again for second try. | OFF gains value of Lower die rolled, ND | Value of Higher die rolled, ND. | Value of Higher die rolled, ND | Same as Zone | Value of Higher die rolled, ND | Value of Higher die rolled, each team extra One die roll, ND |
| Trap<br>Two dice, then OFF One die alone, then each team Two dice TPE | Diff-between OFF/DEF first roll, ND | Sum, no extra roll alone, each team roll One die TPE | Sum, OFF extra One die roll alone, ND | Same as Zone | Sum, OFF extra One die roll, each team One die TPE | Sum, OFF extra One die roll, each team 2 dice TPE |
| Sweep<br>Best out of 5 rolls Two dice. OFF gains sum of last roll then each team Two dice TPE | Diff-between OFF/DEF last roll, ND | Sum, Each team One die TPE | Sum, Each team 2 dice once more, ND | Same as Zone | Sum, each team One die TPE | Sum, OFF extra One die roll, then each team 2 dice TPE |

FIGURE 11B

PASS DEFENSE WINS a) Match Sums during a Best Out of play ends the play then, even if there are rolls left.
b) Match Sums on initial roll with perfect DEF coverage is an automatic OFF Penalty.
c) Whenever DEF wins initial roll with a Blitz, play stops there. Go to charts for outcome.

| Play Type | 8 Man | Man | Zone | Change | Nickel | Blitz |
|---|---|---|---|---|---|---|
| Post | Inc. | Inc. | Inc. | Same as Zone | SACK and LOY of OFF roll | SACK and Fumble. Roll for possession OFF wins: ND, LOS DEF wins 2 dice TPE |
| | Doubles: SACK and Fumble roll for possession at LOS. | Doubles OFF Penalty | | | Doubles: Intercepted at default yards, No return | Doubles: Intercepted at default yards, each team 2 dice TPE. |
| Quick Out | Inc. | Inc. | Inc. | Same as Zone | Inc. | Ball tipped at LOS, roll for possession, then One die once for yards, ND |
| Cross Pattern | Inc. | Inc. | Inc. | Same as Zone | Receiver bobbles ball, roll for possession at distance of OFF roll then 2 dice TPE | OFF Penalty |
| | | | Doubles: OFF Penalty | | Doubles: Intercepted at distance of OFF roll, each team 2 dice TPE | Doubles: SACK and LOY of DEF roll |
| Curl | Inc. | Inc. | Inc. | Same as Zone | LOY of OFF roll QB runs O.O.B to avoid Sack | Ball tipped at LOS, roll for possession, then One die once, ND. |
| | | | Doubles: OFF Penalty | | Doubles: Receiver bobbles ball, roll for possession at distance of OFF roll, then 2 dice TPE | Doubles: SACK and LOY of OFF roll |
| Fly | Inc. | Inc. | Inc. | Same as Zone | OFF Penalty | SACK and LOY of OFF and DEF roll |
| | Doubles: SACK and LOY of DEF roll, ND | | Doubles: Receiver bobbles ball, roll for possession at distance of OFF roll, then 2 dice TPE | | Doubles: SACK and Fumble 7- yards behind LOS roll for possession. DEF wins: 2 dice TPE. OFF wins: ND at LOY. | Doubles: Intercepted at distance of default yards, each team roll 2 dice TPE |

FIGURE 11C

RUN DEF WINS a) Any play immediately ends when the DEF wins on the initial roll with the Blitz See charts.
b) Match Sums rolled anytime during a Best Out of plays ends the play then. See charts
c) Match Sums where DEF has the perfect Defensive play on the initial roll is an automatic OFF Penalty. Possession is gained at the current LOS on Fumbles and if a six is rolled while advancing the team in possession gets an extra roll alone before the DEF can again roll to defend TPE.

| Play Type | 8 Man Box | Man | Zone | Change | Nickel | Blitz |
|---|---|---|---|---|---|---|
| Blast | OFF loses 1-yard, ND | No Gain | No Gain | No Gain | No Gain | LOY of OFF roll, ND |
| | Doubles/Equal or Match sums LOY of OFF lower die value rolled. | | | | | Doubles/Equal or Match sums LOY of OFF Higher die value rolled, ND |
| Pitch | SACK and LOY of OFF Lower die value rolled, ND. LB gets through untouched | No Gain | No Gain | No Gain | No Gain | LOY of OFF Higher die value rolled, ND |
| | Doubles: Fumble: roll One die for possession at current LOS | | | | | Doubles: Fumble: roll One die for possession at the LOS. |
| Misdirection | LOY of OFF Lower die value rolled, ND | No gain | No gain | No gain | No Gain | LOY of OFF Higher die value rolled, ND |
| | Doubles: OFF Penalty | | | | | Doubles: OFF penalty |
| Trap | LOY of OFF Higher die value rolled, ND | No Gain | No Gain | NO gain | No Gain | LOY of OFF Higher die value rolled, ND |
| | Doubles: OFF penalty | | | | | Doubles: OFF Penalty |
| Sweep | LOY of OFF Lower die value rolled, ND | No Gain | No Gain | No Gain | No gain | LOY of OFF Higher die value rolled, ND |
| | Doubles: OFF Penalty | | | | | Doubles: Fumble: roll one die for possession, then 2 dice TPE |

FIGURE 11D

| PLAY OPTION RUN | |
|---|---|
| HOW TO USE | The play is revealed by the OFF after the initial roll. |
| NUMBER OF DICE | OFF Two Green play dice and DEF Two Red play dice. |
| PROCEDURE | The OFF puts this card face down the DEF puts down their play card and after each team rolls simultaneously, they flip their cards to reveal their play selections. If the OFF wins the roll, they must proceed with their original intent to Run, however if the DEF wins on the initial roll and they did not use the Change-Up defense, the OFF may select from three alternative Pass plays:<br>1. THE BOMB: (A maximum 40-yard gain) each team rolls One die for the Best Out of Five rolls. The distance decreases as you near your end zone.<br>Once past the 40 to 31-yard line: 30-yard pass<br>Once past the 30 to 21-yard line: 20-yard pass<br>Once past the 20 to 11-yard line: 10-yard Pass.<br>2. SCREEN PASS: Each team rolls One die for a Completion or not. If the OFF wins they gain the value of their roll and each team rolls Two dice for yards TPE.<br>3. SLANT: QB throws the ball on a Slant route each team rolls Two dice Once. If Doubles are rolled OFF gets extra roll until no more doubles, ND |
| RESTRICTIONS | 1. OFF can only use the Play Option (Pass or Run) once between First Downs. If used twice without obtaining a First Down it is a 5-yard Penalty, Repeat Down.<br>2. There are no TPE conditions if you win the initial roll with the Option and use your original intent to Run. See Option outcome chart. |
| LOSS OF POSSESSION | On Run plays it is a Fumble. Each team rolls One die for possession, and then One die for yards TPE. When rolling for possession if there is a Tie, each team continues to roll till someone wins.<br>Loss of possession on a Pass play is an Interception; at the distance of the OFF roll, each team Two dice for yards TPE. |
| DOUBLES RULE | Applies. |
| DOUBLE SIXES RULE | Applies. |
| 1/6 RULE | Applies. All passes are an interception. |
| CLOCK USE | Regular game timing. |
| NOTE | The alternative plays are Pass instead of Run because in theory, the DEF read the play so the OFF changes their original formation of Run to Pass at the LOS in attempt to fool the DEF. |
| STRATEGY APPROACH | The Play Option is a powerful play in OTR football. Because of it's flexibility It tends to keep the DEF off balance with their play calling because they are always anticipating you using it so they have the big decision of when to use the Change-Up defense. If you win the roll with this card you will find the outcomes limited in results as the Pass and Run plays yield short yards with no TPE conditions. You must consider prior to the Snap, which alternate play you will use to stay with-in the time frame of the play. Always know where you are at in field position so you can use the best alternative play for the yards you need. |

FIGURE 12A

| CHANGE-UP DEFENSE Pro | |
|---|---|
| HOW TO USE | The play is revealed by the DEF after the initial roll. |
| NUMBER OF DICE | DEF Two Red dice and OFF Two Green dice. |
| PROCEDURE | The DEF puts this card face down while the OFF puts down their play card and after each team rolls simultaneously, they flip their cards to reveal their play selections.<br>1. If the OFF Lost the Roll but has the Play Option and the DEF has the Change-Up and has not rolled Doubles on the initial roll, each team rolls One die for the below chart results. DEF Doubles, see below<br>2. If the OFF has lost the roll and the DEF does not have the Change-Up then the OFF may use any of the Option plays.<br>3. If the OFF has won the roll with the Play Option they must proceed with their original Option Pass or Run play. See Play Option Outcomes chart. |
| RESTRICTIONS | If the DEF has rolled Any Doubles on the Initial Roll see below for outcome. |
| LOSS OF POSSESSION | On Run plays it is a Fumble. Each team rolls One die for possession, and then Two dice for yards TPE. When rolling for possession if there is a Tie, each team continues to roll till someone wins.<br>Loss of possession on a Pass play is an Interception; roll Two dice for yards TPE. |
| DOUBLES RULE | Applies. |
| DOUBLE SIXES RULE | Applies. |
| 1/6 RULE | Applies. |
| CLOCK USE | Regular game timing. |
| NOTE | The Change-Up is a flexible DEF It should be used when the DEF is anticipating the OFF to use the Play Option Pass or Run or the Audible Offense |
| STRATEGY APPROACH | This is your ultimate DEF against the Play Option plays and the Audible Offense. It is a specific defense in OTR design. If the OFF wins the roll not using the Play Option and the DEF has used the Change-Up it will produce a similar outcome to the Zone overage defense. |

DEF Doubles on the initial roll with the OFF attempting to use the Play Option

| OFF | DEF | OUTCOME |
|---|---|---|
| No Doubles | Doubles | OFF Penalty "Holding" ball beyond the LOS, 10-yards, ND<br>The OFF can re-use the Play Option. Each team Doubles defaults to HI/Lo rolls |

Single die outcomes for a Change-Up and Play Option Match up roll.

| OFF | DEF | OUTCOME |
|---|---|---|
| Hi Value | Lo Value | OFF gains the Sum of their roll, Next Down. Can Re-Use Option. |
| Lo Value or Equal Value | Hi Value or Equal Value | RUN Option: LOY Diff-between OFF/DEF roll.<br>PASS Option: LOY of OFF roll,<br>(QB Runs Out of Bounds to avoid Sack). Clock Stops.<br>OFF can Re-Use Play Option. |

1/6 Rule

| OFF | DEF | OUTCOME |
|---|---|---|
| Six | One | DEF PENALTY, OFF can Re-Use Play Option |
| One. | Six | OFF PENALTY, OFF can Re-Use Play Option.<br>If it is the Next Down, OFF can still Re-Use Play Option. |
| Six | Six | Off Setting Penalties, Remains Same Down. OFF can Re-Use the Play Option. |

FIGURE 12B

| FIELD GOAL Three Points | |
|---|---|
| HOW TO USE | This play is declared by the OFF before the roll. All Field Goal attempts are calculated from the Current LOS. |
| NUMBER OF DICE | 1. Outside the 20-yard line (21 and up) the OFF and the DEF use Three dice: the Field Goal/Punt die and Two play dice.<br>2. Inside the 20-yard line (20 to goal line), the DEF rolls Two dice and must roll any Doubles to Block the Field Goal. The OFF if they choose, may roll Two dice and must roll Doubles to have the option to Fake. If the Def also rolls doubles there is no fake, Field Goal Blocked |
| PROCEDURE | The OFF puts the Field Goal card down on the field face up and declares the Field Goal attempt. If outside the 20-yard line each team rolls the same combination of dice simultaneously.<br>1. The OFF must roll the total yards needed to reach the End Zone or better for a successful Field Goal. If not the attempt is no good.<br>The DEF rolls the Exact same dice as the OFF in attempt to block the kick. See the chart below for the three possible blocking outcomes. |
| RESTRICTIONS | The longest Field Goal attempt possible is 60-yards. Double Ones are an Out-of-Bounds kick. See note below. |
| LOSS OF POSSESSION | Loss of possession can happen on a successful block in two ways only.<br>See the Outcome Charts below for the conditions. |
| DOUBLES RULE | Applies on DEF blocked returns only. |
| DOUBLE SIXES RULE | Applies, and results in a Blocked Field Goal where the DEF is eligible to roll for yards TPE. |
| 1/6 RULE | Does not apply. |
| CLOCK USE | Regular game timing. |
| STRATEGY APPROACH | Consider the score and time remaining in the game as well as how efficiently you are executing your game plan when you are faced with the decision of kicking a Field Goal or attempting to get a first down on fourth down or scoring a Touch Down. Putting points on the board should always be your most important concern. |

| BLOCKING SITUATIONS OUTSIDE THE 20 YARD LINE | | |
|---|---|---|
| DEF | OFF | OUTCOME |
| The Exact Play Dice and Field Goal Die total as OFF | Exact Dice as DEF | BLOCKED, DEF Recovers Behind the LOS, each team Two dice TPE |
| Double Sixes. | Any roll. | BLOCKED First Down at 20-yard line for the DEF. |
| Double Sixes and the Exact Field Goal Die total. | Any roll. | BLOCKED DEF Recovers Behind the LOS, DEF rolls Six times Alone before the OFF can roll to defend, then each team Two dice TPE |
| BLOCKING SITUATIONS FROM THE 20 YARD LINE TO THE GOAL LINE | | |
| DEF | OFF | OUTCOME |
| Any Doubles | Any Roll | BLOCKED. First Down at the 20-yard line for the DEF. |
| Double Sixes. | Any roll. | BLOCKED and RECOVERED at LOS, BY THE DEF each team rolls Two dice TPE. |
| No Doubles | Doubles | FAKE FIELD GOAL Optional for OFF |

FIGURE 12C

| FIELD GOAL Three Points | |
|---|---|
| HOW TO USE | This play is declared by the OFF before the roll. All Field Goal attempts are calculated from the Current LOS. |
| NUMBER OF DICE | 3. Outside the 20-yard line (21 and up) the OFF and the DEF use Three dice: the Field Goal/Punt die and Two play dice.<br>4. Inside the 20-yard line (20 to goal line), the DEF rolls Two dice and must roll any Doubles to Block the Field Goal. The OFF if they choose, may roll Two dice and must roll Doubles to have the option to Fake. If the Def also rolls doubles there is no fake, Field Goal Blocked |
| PROCEDURE | The OFF puts the Field Goal card down on the field face up and declares the Field Goal attempt. If outside the 20-yard line each team rolls the same combination of dice simultaneously.<br>2. The OFF must roll the total yards needed to reach the End Zone or better for a successful Field Goal. If not the attempt is no good.<br>The DEF rolls the Exact same dice as the OFF in attempt to block the kick. See the chart below for the three possible blocking outcomes. |
| RESTRICTIONS | The longest Field Goal attempt possible is 60-yards. Double Ones are an Out-of-Bounds kick. See note below. |
| LOSS OF POSSESSION | Loss of possession can happen on a successful block in two ways only.<br>See the Outcome Charts below for the conditions. |
| DOUBLES RULE | Applies on DEF blocked returns only. |
| DOUBLE SIXES RULE | Applies, and results in a Blocked Field Goal where the DEF is eligible to roll for yards TPE. |
| 1/6 RULE | Does not apply. |
| CLOCK USE | Regular game timing. |
| STRATEGY APPROACH | Consider the score and time remaining in the game as well as how efficiently you are executing your game plan when you are faced with the decision of kicking a Field Goal or attempting to get a first down on fourth down or scoring a Touch Down. Putting points on the board should always be your most important concern. |

| BLOCKING SITUATIONS OUTSIDE THE 20 YARD LINE | | |
|---|---|---|
| DEF | OFF | OUTCOME |
| The Exact Play Dice and Field Goal Die total as OFF | Exact Dice as DEF | BLOCKED, DEF Recovers Behind the LOS, each team Two dice TPE |
| Double Sixes. | Any roll. | BLOCKED First Down at 20-yard line for the DEF. |
| Double Sixes and the Exact Field Goal Die total. | Any roll. | BLOCKED DEF Recovers Behind the LOS, DEF rolls Six times Alone before the OFF can roll to defend, then each team Two dice TPE |
| BLOCKING SITUATIONS FROM THE 20 YARD LINE TO THE GOAL LINE | | |
| DEF | OFF | OUTCOME |
| Any Doubles | Any Roll | BLOCKED. First Down at the 20-yard line for the DEF. |
| Double Sixes. | Any roll. | BLOCKED and RECOVERED at LOS, BY THE DEF each team rolls Two dice TPE. |
| No Doubles | Doubles | FAKE FIELD GOAL Optional for OFF |

FIGURE 12D

| PUNT (KICK team is OFF and REC team is DEF) Pro | |
|---|---|
| HOW TO USE | This play is declared by the OFF before the roll. |
| NUMBER OF DICE | OFF/ DEF up to Three. The Punt/Field Goal Die with numbers 23 to 48 and Two play dice depending on the OFF field position. |
| PROCEDURE | The Kick team puts the Punt card down on the field face up and declares its intention to Punt. Each team rolls the same combination of dice simultaneously. This gives the REC team a chance to Block the Kick. See the chart below for the Blocking situations.<br>1. If the Kick team is before the 50-yard line, roll the Punt Die and Two play dice in attempt to get the maximum yards out of the kick.<br>2. If the Kick team is beyond the 50-yard line, they may select to use the Punt die and One play die in attempt to pin the REC Team close to their End Zone avoiding kicking into the End Zone which gives the REC team a First Down at the 20-yard line. The REC team after the initial roll, rolls the other play die to complete their initial return roll.<br>3. If the KICK team rolls Doubles 2 through 5 there is no return. |
| RESTRICTIONS | Double Ones rolled by the KICK team is an automatic Out-of-Bounds at the Kick Distance. The REC takes possession at that Spot, First Down. |
| LOSS OF POSSESSION | Loss of possession is a Blocked Kick. See the outcome charts below. |
| DOUBLES RULE | Applies, on the Punt Return only. |
| DOUBLE SIXES RULE | Applies. For the KICK team Double Sixes on the Punt results in a REC team FUMBLE, each team roll one die for possession at spot of the Kick Distance. For REC team see below. |
| 1/6 RULE | Does not apply. |
| CLOCK USE | Regular game timing. |
| STRATEGY APPROACH | A Punt is used when the OFF has not achieved a First Down and is out of Field Goal range. It is wise to Punt especially early in the game. By sending the opponent back into their territory gives you time to try and force a loss of possession.<br>BONUS: The REC team before the Punt attempts to line up at the Exact Kick distance. If the REC team guesses correctly, they roll Two play dice alone for every 10-yards to the Goal Line. Counting starts from the nearest 5-yard line in the direction they are going. After they have rolled all their Free rolls the KICK team can roll to defend TPE If the REC team rolls Double Sixes on their initial roll they get Six free rolls or in addition to the free rolls from the guess kick distance. |

| *REC Team* | OUTCOME |
|---|---|
| Exact Play Dice And Punt Die totals | BLOCKED Kick, each team roll One die for possession and then Two dice for yards TPE. |
| Double Sixes | BLOCKED Kick and Out-of-Bounds REC team takes possession at the current LOS. |
| Double Sixes/Same Punt Die total | BLOCKED Kick, the REC team takes Immediate possession at the Current LOS, each team roll Two dice for yards TPE. |

FIGURE 12E

| WEST COAST OFFENSE | |
|---|---|
| HOW TO USE | The play is revealed by the OFF after the initial roll. |
| NUMBER OF DICE | OFF Two Green play dice and DEF Two Red play dice. |
| PROCEDURE | OFF and DEF put this card face down and after each team rolls simultaneously, they flip their cards to reveal their play selections.<br>1. If OFF loses initial roll with Hi/Lo sums only and DEF does not have Man to Man or Nickel Defense, each team keeps their Higher die value rolled and each roll One die again in attempt to complete the Pass.<br>2. If DEF does have Man or Nickel, first roll counts with no further rolling. |
| RESTRICTIONS | None.. |
| LOSS OF POSSESSION | Loss of possession is an Interception. |
| DOUBLES RULE | Applies, but with some exceptions. See play outcome chart below. |
| DOUBLE SIXES RULE | Applies. |
| 1/6 RULE | Applies. |
| CLOCK USE | The Clock Stops after an Incomplete Pass. |
| STRATEGY OPTIONS | This Pass formation presents to the Defense several eligible receivers in professional Football. So by roll design you have a 2-receiver check off procedure. |

| OFF WINS | | | |
|---|---|---|---|
| OFF | DEF | COVERAGE | OUTCOME |
| Hi Sum | Lo Sum | Zone Coverage | OFF gains Sum of roll |
| | | Man-to-Man Nickel Defense | OFF gains Diff-between OFF and DEF roll |
| | | Change-Up 8-Man Box | OFF gains Sum of roll, each team roll TPE |
| | | Zone Blitz | DEF PENALTY: Holding 10-yards. |
| Doubles | No Doubles | Zone Coverage | OFF gains sum of roll, each team roll once more for yards. |
| | | Man-to-Man Nickel Defense | OFF gains Sum of roll, Next Down. |
| | | Change-Up 8-Man Box | OFF gains Sum of roll, an Extra Roll, each team rolls TPE |
| | | Zone Blitz | OFF gains Sum of roll, Two Extra Rolls, each team rolls DEF PENALTY after play ends |
| DEF WINS | | | |
| DEF | OFF | COVERAGE | OUTCOME |
| Hi Sum | Lo Sum | Change, Zone, 8 Man Box | OFF/ DEF keep higher die value rolled. Each team roll One die again to complete the pass attempt. |
| | | Man or Nickel | Incomplete, ND |
| | | Zone Blitz | OFF PENALTY: Holding 10-yards. Ball Behind the LOS. Remains Same Down. |
| Equal and Matched Sums | Equal and Matched Sums | All Coverage | QUARTERBACK Runs Up Middle, each team One die TPE. OFF can stop rolling for additional yards before their next roll at any time. (QB slides to end play). Clock does not stop. |
| Doubles | No Doubles | All Coverage except Zone Blitz | OFF PENALTY CARD |
| | | Zone Blitz | SACK CARD and LOY of DEF/ OFF roll |
| Hi/Lo and Equal Doubles | Hi/Lo and Equal Doubles | All Coverage | Incomplete |

FIGURE 12F

DICE RULES ON ROLLING FOR ADDITIONAL YARDS

1. This applies to the outcome of a Pass completion, Successful Run, Fumble, Interception, rolling Doubles or any other situation where there is eligibility for additional yards.
2. The following rules reflect the Sum of two dice rolled or one die rolled, any further details on these outcomes can be found in the appropriate play outcome chart.

Till Play Ends (TPE) indicates that the OFF has won the roll and can continue to roll any number of dice until the DEF beats the OFF roll, end of play.

DOUBLE DICE ROLLS

| OFF | DEF | OUTCOME |
|---|---|---|
| Hi Sum | Lo Sum | OFF advances sum of their roll, each team continues to roll till play ends. (TPE) |
| Lo Sum | Hi Sum | DEF stops gain, next down. |
| Equal or Match Sums | Equal or Match Sums | DEF stops gain, next down. Ties generally go to the DEF |
| Doubles | No Doubles | OFF advances sum of their roll and rolls two play dice alone once If they roll Doubles again they may continue to roll alone until no more Doubles are rolled and then each team continues to roll till play ends. (TPE) |
| Any Roll Except Double Ones and Sixes | Double Sixes | FUMBLE, each team rolls One die for possession and then one or two dice, depending on the particular play directive and circumstance, for yards till play ends. (TPE) |
| No Doubles | Doubles | DEF stops gain, next down. |
| Hi/ Lo or Equal Doubles | Hi/Lo or Equal Doubles | Defaults to Hi /Lo rolls. |

SINGLE DIE ROLLS

| OFF | DEF | OUTCOME |
|---|---|---|
| Hi Value | Lo value | OFF advances sum of roll, each team continues to roll till play ends. (TPE) |
| Lo Value | Hi Value | DEF stops gain, next down. |
| Equal Values | Equal Values | DEF stops gain, next down |
| Six | One | DEF PENALTY after the play ends |
| One | Six | Immediate OFF PENALTY. |
| Six | Six | Off setting Penalties on the play, Next Down. |

NOTE: Exceptions to a double six turnover are when the Offense has rolled double ones or sixes along with the DEF sixes, that is ruled a play out-of-bounds, next down, or when they are rolled on an "At Snap" penalty play or on a penalty pending play depending on the outcome of the penalty.

FIGURE 13A

SIXES RULE FOR SINGLE AND DOUBLE DICE ROLLS

NOTE: Exceptions to a Double Six turnover are when the Offense has rolled Double Ones or Sixes along with the DEF Sixes, see below, or when they are rolled on an "At Snap" Penalty play or on a Penalty pending play depending on the outcome of the Penalty.

DOUBLE DICE ROLLS: Initial Roll of play.

| OFF | DEF | PLAY AND OUTCOME |
|---|---|---|
| Any Roll including Doubles, Except Sixes or Ones | Double Sixes | PASS: INTERCEPTED at the Distance of the OFF roll, each team rolls Two dice for yards TPE, unless otherwise stated in the play charts. |
| Any Roll including Doubles, Except Sixes or Ones | Double Sixes | RUN: FUMBLE each team roll One die for possession and One die for yards TPE, unless otherwise stated in the play charts. |
| Double Sixes | Double Sixes | PASS: DEF DROPPED THE BALL, OFF maintains possession at current LOS, next down.<br><br>RUN: BALL FUMBLED OUT OF BOUNDS, OFF maintains possession at the Current LOS, next down. |
| Double Ones | Double Sixes | The play is OUT OF BOUNDS OFF maintains possession at the Current LOS, next down. |

ROLLING FOR ADDITIONAL YARDS

| OFF | DEF | OUTCOME |
|---|---|---|
| Any Roll including Doubles, Except Sixes or Ones. | Double Sixes | FUMBLE: each team roll One die for possession and Two dice for yards TPE, unless otherwise stated in the play charts. |
| Double Sixes or Ones | Double Sixes | FUMBLE: However Ball Goes Out of Bounds OFF Maintains Possession at the Current LOS, next down. |

SINGLE DIE ROLLS: Initial Roll of play (Applies for other than individual play book directives)

| OFF | DEF | OUTCOME |
|---|---|---|
| Six | One | DEF PENALTY after the play. |
| One | Six | Immediate OFF PENALTY. |
| Six | Six | Off Setting Penalties on the play, Next Down. |

Note: All plays start from the Current Line of Scrimmage

FIGURE 13B

DOUBLES RULE (Basic rules)

1. Anytime the OFF has rolled Doubles they get an Immediate extra roll before the DEF can roll to defend. This applies at all times during the game unless otherwise stated in a particular play chart directive..
2. The OFF may continue to roll alone as long as they roll doubles. As soon as no more Doubles appear the DEF may roll to defend.
3. If the DEF also rolls Doubles the roll defaults to Hi/Lo rolls and there is no free roll bonus from rolling doubles.
4. Doubles rolled by the DEF does not Warrant an Extra Roll in any situation.

| OFF | DEF | OUTCOME |
|---|---|---|
| Doubles | No Doubles | OFF gains Sum of roll and then rolls Two dice alone before DEF can roll to defend. Unless otherwise stated in a particular chart. |
| No Doubles | Doubles | DEF wins. The outcome will have a stronger advantage for the DEF than on Hi/Lo rolls. The charts show the outcomes. |
| Doubles | Doubles | Defaults to Hi/Lo rolls, the OFF is not Eligible for an Extra Roll. |

Example: A play involving the OFF winning the roll with Doubles and the DEF did not roll Doubles and the OFF rolling Doubles again on the Extra Roll.

Pass play, OFF 5+5=10, DEF thinking run 4+3=7: the Off gains 10-yards on the play and then rolls Two dice alone. OFF 3+3=6: the OFF gains 6-yards and continues to Roll Alone until they no longer roll Doubles. OFF 4+2=6: the Off gains another 6-yards and now the DEF can roll with the OFF to defend. OFF 5+2=7, DEF 5+3=8: Play Over. The OFF gains 22-yards on the play.

FIGURE 13C

MOST COMMON GAME RULES ADDRESSED DURING A GAME

Ties generally go to the DEF A few common exceptions are:

1. On a Fumble when rolling for possession, one team must win the roll.
2. Rolling for possession from a Ball Tipped or Bobbled, Equal or Match sums rules the play incomplete
3. Some Pass or Run plays provide for a second roll for the Offense to beat the Defense.

Fumbles: Each team rolls one die for possession and then one die for yards TPE unless otherwise stated on a particular play chart outcome.

Interceptions: DEF takes possession at distance of OFF roll and then each team roll two dice for yards TPE unless otherwise stated on a particular chart outcome Double Sixes: Automatic Fumble or Interception anytime during game with following exceptions:

1. DEF and OFF sixes on an Interception results in "Pass was dropped" OFF maintains possession.
2. DEF and OFF sixes on a Fumble results in "Ball goes out of bounds" OFF Maintains possession.
3. DEF sixes/ OFF double ones results in" Play out of bounds" OFF maintains possession.
4. Sixes rolled on an "At Snap" play or Penalty pending play depending on type of infraction and ruling.

Out Of Bounds Cards

1. The card is applied by DEF anytime during play series to take away an extra roll or stop any further rolling. See chart for further details. Once card is used return it to deck, all unused cards are turned in at the end of quarter
2. They can only take away free rolls on the Kick plays prior to the commencing of rolling.

Change-Up Defense Procedures

1. If DEF has the Change-UP and won the roll and OFF has Play Option, each team roll one die to see the OFF may use the alternate plays to keep play alive. See Change-Up chart for further details all ties go to the DEF on this roll.
2. If OFF wins roll they must proceed with their original Pass or Run play. SEE Option Outcome chart
3. If OFF lost roll and DEF does not have the Change-Up the OFF may use any of the alternate plays.
4. The change-Up permits the DEF to continually change the DEF on the Audible play Penalties: On the Kick-Off 1. If any dice leave board during initial roll of Kick-Off, DEF: 5-yard re-kick penalty, OFF: they return the kick the distance of remaining die on board, proceed with normal return rolling. OFF penalty after play ends. OFF draw card to be applied before the snap of the first down.
2. During return if any OFF dice leave board they gain only sum of remaining die, DEF marks the current LOS, continue in normal return procedures. After the play ends OFF draw penalty card to be applied from the spot of the foul. If DEF rolls any dice off board during return a Penalty is applied after play ends before the first down of the OFF Dice Leaving the Board at Snap of Play 1. For OFF/DEF it is an automatic 5-yards "OFF SIDES" penalty, remains same down.

Dice Leaving the Board During the play

1. OFF: Immediate Penalty at the current LOS
2. DEF: Penalty after play ends DEF remaining die counts as their defensive roll for the play.
3. Rolling for possession: Team who lost die/dice loses. If OFF/DEF each roll off board OFF maintains possession, next down.

Penalty Cards

1. If the card cannot be applied to the situation it is ruled a No Infraction
2. The DEF always has the Option to decline the Penalty Double Ones:

1. Earns the OFF or the DEF an Out of Bounds card at the time of rolling ones under any circumstance.
2. Stops any play engaged in additional yard rolling. Play option alternate play first roll not included.

Doubles on Kick-Offs and Punt Plays

1. There is no return by the OFF. REC team takes possession at spot of Kick. The only exception is on a Guess correctly Kick distance bonus play for Kick and Punt plays. Takes away one free roll as a result
2. OFF sixes on initial return roll on any Kick play earns them Six free undefended rolls before DEF can roll to defend.

FIGURE 14

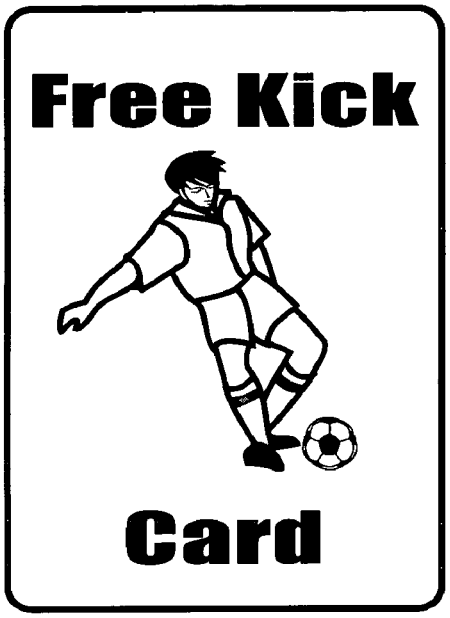
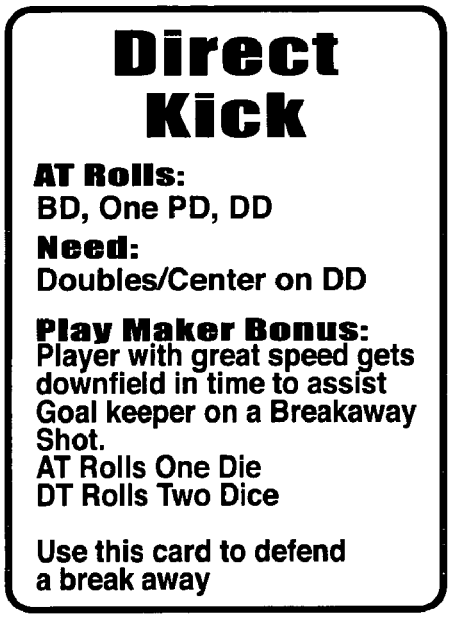
FIGURE 18

Soccer Advancement Chart

| AT | DT | OUTCOME |
|---|---|---|
| Hi Value | Lo Value | AT advances the Value of their roll. |
| Lo Value | Hi Value | The AT moves back the Value of their roll due to DT pressure or can pass if more than one player per team, and the pass recipient has rolled a six and beaten their defenders value. |
| Equal Values | Equal Values | Each team roll the BD for possession and then advance the Value of their BD in the direction of the existing DD, each team rolls in NPM |
| Six | One | DT violation against the AT, AT draws a Free Kick card |
| One | Six | AT violation against the DT, DT draws a Free Kick card |
| Six | Six | Breakaway, the DT steals the ball and advances 6 field lines in the direction of their choice, rolls once more alone and then each team rolls in NPM |

FIGURE 19

Soccer shot eligibility

Once in range of a shot (35-yard field marker to 5-yard field marker left and right of the penalty box) the AT must roll a Six to be eligible for a shot attempt. If they do not roll a Six, each team must roll once in Normal Play Mode (NPM) before the AT may attempt to roll a Six for a shot again. .

1/6 Rule does not apply

| AT | DT | OUTCOME |
|---|---|---|
| Six | Any roll but a Six | AT may take a shot |
| Six | Six | AT cannot take a shot |
| No Six | Roll irrelevant | AT cannot take a shot |

FIGURE 20

SOCCER SCORING

In the Penalty Box, 20-yard marker Center or closer

| AT ROLLS: BD, One PD and The DD. | DT ROLLS: BD, One PD | OUTCOME |
|---|---|---|
| AT NEEDS: Doubles and Center DD | No Doubles | AT Scores |
| Required Roll to Score. | Any Doubles | AT does not score, DT takes possession |

Shot attempts from the 25-yard line Center or closer on the Left or Right sides of the Box.
(Shots from Left and Right are Cross Kicks)

| AT ROLLS: BD, Two PD, The DD | DT ROLLS: BD, Two PD | OUTCOME |
|---|---|---|
| NEED: Doubles, Higher BD | No Doubles | AT Scores |
| Required Roll to score | Any Doubles | AT does not score, DT takes possession |

Shot attempts from the 30 and 35-yard line

| AT ROLLS: BD, Two PD, The DD | DT ROLLS: BD, Two PD | OUTCOME |
|---|---|---|
| AT NEEDS: Three of a Kind, Center DD | No Doubles | AT scores |
| Required Roll to Score | Any Doubles | AT does not score, DT takes possession |

Procedures for after all score attempts

| AT | DT | OUTCOME |
|---|---|---|
| AT required roll to score | Unsuccessful roll to block Goal shot | AT Scores and DT Takes possession |
| AT required roll to score | Any Doubles | AT does not score and DT takes possession with a great save. |

Shots that did not score and the DT have not taken possession.
Out of Box Shots

| AT | DT | OUTCOME |
|---|---|---|
| High Value BD | Low Value BD | AT maintains possession and moves to the location of the DD and the Value distance of their BD, each team roll NPM<br>If inside 20-yard field line, AT moves out towards Center field,<br>If outside 20-yard field line, AT moves forward towards Goal. |
| Low Value BD | High Value BD | AT does not score, DT takes possession |
| Equal Value BD | Equal Value BD | AT does not score, DT takes possession |

In the Box

| AT | DT | OUTCOME |
|---|---|---|
| High BD, Center on the DD | Low BD | AT still has possession, take another shot.<br>AT may continue to takes shots as long as they have the High BD and Center on the DD and the DT has not taken possession. |

FIGURE 21

V = VALUE
AT = ATTACKING TEAM
DT = DEFENDING TEAM
DD = DIRECTIONAL DIE
ATPD = ATTACKING TEAM PLAY DIE
DTPD = DEFENDING TEAM PLAY DIE
DG = DISTANCE TO DEFENDING GOAL

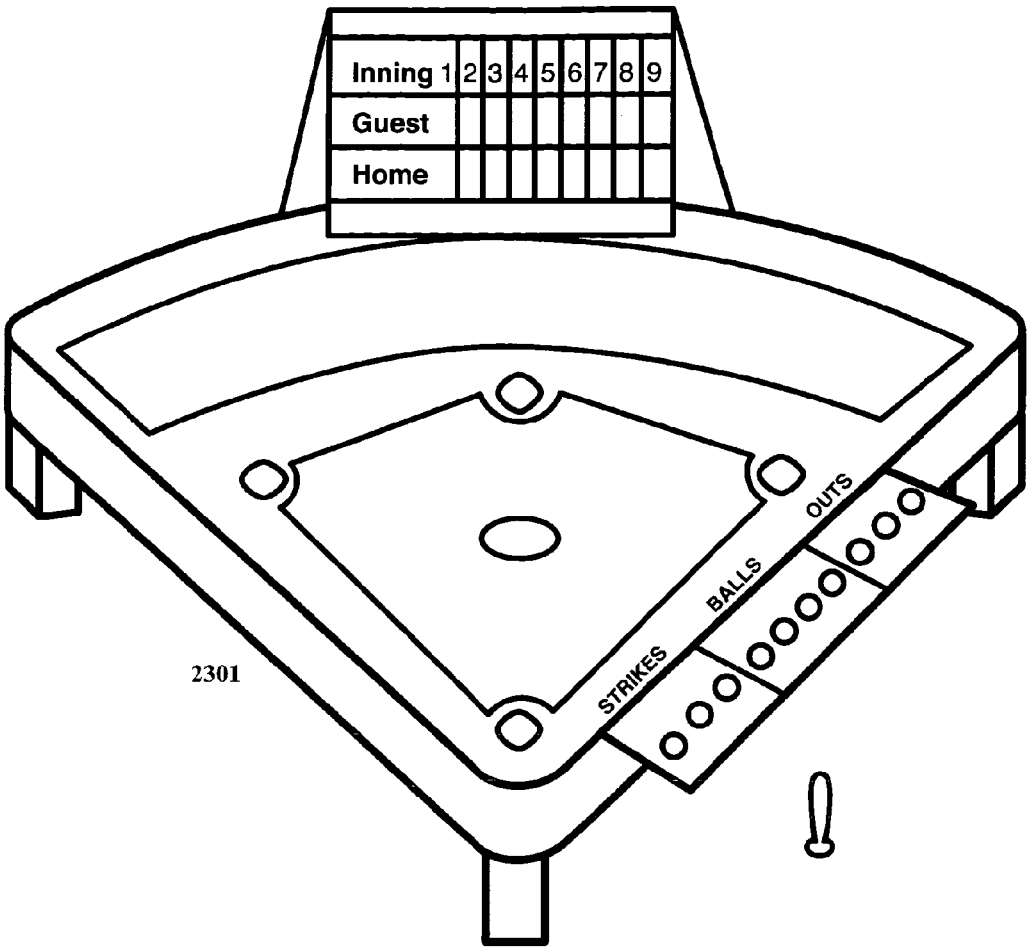
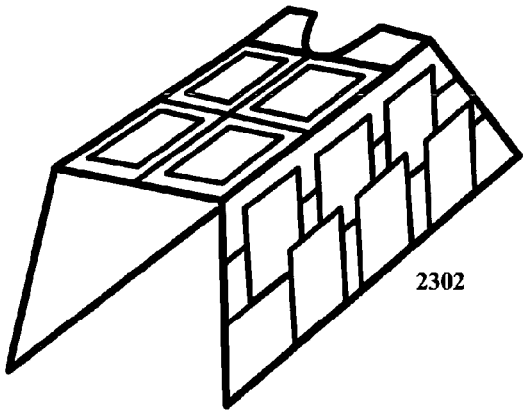
FIGURE 23

2401
Curve Ball
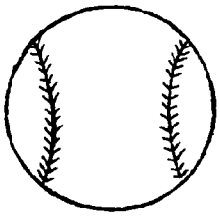
Inside
2402
Inside Curve Ball
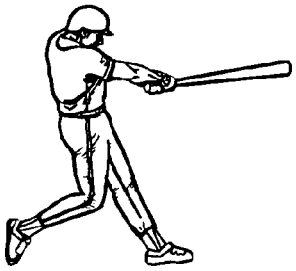
Hitter
2403
Field Error
Flyout:
FIELDER DROPPED BALL
Grounder:
INFIELDER LIFTS GLOVE TOO SOON BALL GOES INTO SHORT OUTFIELD
2404
Batter did not take a full swing
NO Strike!
Ball to Count
OFF
2405
Pick-Off
1st Base
2nd Base
3rd Base
DEF must declare base
SEE PLAY BOOK
FIGURE 24

| INITIAL GAME PLAY BETWEEN PITCHER AND BATTER, ONE DIE PRO | |
|---|---|
| WHEN TO USE | This chart is used for all initial rolling to play the game. In theory it is the batter up chart. The very first pitches thrown to the batter. |
| PROCEDURE | 1. The pitcher and the batter flip their initial cards together and then roll One Die each for the outcome. The pitcher turns over a card for each pitch until the batter is out or gets on base. The batter only flips once to reveal the batter up and does not flip again until the batter is out.<br>2. If a Match Up occurs on the initial flip of the cards, each team rolls Two Dice for the Best Out of Five Rolls.<br>See Initial Match-Up play chart.<br>3. If a Match-Up occurs during the pitching series, each team rolls the best out of three rolls One Die for a Win or Lose outcome.<br>See: Pitching Series Match-Up Chart |
| DOUBLE SIXES RULE | Does not apply |
| 1/6 RULE | Applies |
| NOTE | A Match-Up occurs when the type of pitch and the type of batter are the same. For example, the pitch is a Curve Ball and the batter is a Curve Ball Cracker.<br>On the initial flip of the cards this is an Initial "Match-Up".<br>During the pitching series it would be a "Pitching Series Match-Up". |

INITIAL GAME PLAY

| PITCHER | BATTER | OUTCOME |
|---|---|---|
| Hi Value | Lo Value | Strike |
| Lo Value | Hi Value | Ball |
| Equal Values | Equal Values | Foul Ball<br>DEF must roll a six for Foul Ball to be caught. |
| Anything less than Six | Six | Hit, each team rolls Two Dice to see if batter gets on base.<br>See Hit Outcome Chart. |

THE 1/6 RULE FOR THE INITIAL GAME PLAY

| PITCHER | BATTER | OUTCOME |
|---|---|---|
| Six | One | Batter Out. Line drive hit right back to pitcher.<br>DEF draw an UMP CARD |
| One | Six | Single. Batter hit with ball.<br>OFF draw DEF ERROR CARD |
| Six | Six | Pop-Up behind home plate, each player rolls One Die to see if the ball is caught.<br>OFF wins: Foul ball. DEF wins Batter Out. |
| One | One | Foul ball out of play |

FIGURE 27A

| PITCHING SERIES MATCH-UP | |
|---|---|
| WHEN TO USE | When a Match-Up has occurred during the pitching series. This can occur anytime after the first pitch has been flipped and the dice have been rolled and the pitcher is now on to their second or more pitch for the batter up. |
| PROCEDURE | The players proceed to roll the Best Out of Three rolls One Die with the last roll the roll that counts for the following outcomes. |
| DOUBLE SIXES RULE | Does not apply |
| 1/6 RULE | Applies |
| NOTE | |

Pitching Series Match-Up, each player rolls the best out of three rolls One Die for outcome.

| PITCHER | BATTER | OUTCOME |
|---|---|---|
| Hi Value | Lo Value | Batter Grounds Out.<br>If OFF has men on base refer to "Base Runners Chart" |
| Lo Value | Hi Value, 2 or 3 rolled | Single. |
| Lo Value | Hi Value, 4 or 5 rolled | Double. |
| Anything Less than Six | Six | Triple. |
| Equal Values | Equal Values | Line Drive to Infielder. Batter Out. |

1/6 Rule For Pitching Series Match-Up

| PITCHER | BATTER | OUTCOME |
|---|---|---|
| Six | One | Double Play if available, DEF may choose bases. DEF draw UMP CARD |
| One | Six | Home Run. OFF draw DEF ERROR CARD |
| Six | Six | Pop Up behind plate.<br>DEF wins: Batter Out.<br>OFF wins: Foul ball. |

FIGURE 27B

| INITIAL MATCH-UP PRO | |
|---|---|
| WHEN TO USE | Use this chart when the pitcher and the batter flip over a Match-Up.<br>For example, the pitcher flips a Curve Ball pitch and the batter flips a Curve Ball Hitter. |
| PROCEDURE | Each player proceeds to roll two dice for the best out of Seven rolls for the results |
| DOUBLE SIXES RULE | Applies |
| 1/6 RULE | Does not apply |
| NOTE | Equal and Match sums represent a Tie, which goes to the Defense.<br>If any dice leave the playing field during the rolling of the dice the other team wins that roll.<br>The Def may choose to walk the batter.<br>See "Intentional walk" in playbook.<br>If Double Sixes are rolled anytime during the Best Out of series see below. |

THE RESULTS FOR THE BEST OUT OF SEVEN ROLLS

| PITCHER | BATTER | OUTCOME |
|---|---|---|
| Wins | Loses | The hit is Popped Up and caught. Batter out. |
| Loses | Wins | Home Run, out of ballpark. |

DOUBLE SIXES RULING

| PITCHER | BATTER | OUTCOME |
|---|---|---|
| Sixes | Any roll except Sixes | Ball caught at the wall. Batter out.<br>DEF draws an UMP CARD |
| Any roll except sixes | Sixes | Home Run.<br>OFF draws a DEF ERROR CARD |
| Sixes | Sixes | Ball ruled foul. |

FIGURE 27C

| HIT OUTCOME CHART PRO | |
|---|---|
| WHEN TO USE | This chart is used to see what results the initial hit will bring. Following rolling a six, (a Hit) during the pitching series. |
| PROCEDURE | After a hit has been rolled (a Six) then each team proceeds to roll two dice for the following results. |
| DOUBLE SIXES RULE | Applies |
| 1/6 RULE | Does not apply |
| NOTE | |

AFTER A HIT, EACH TEAM ROLLS TWO DICE TO SEE IF THE BATTER GETS ON BASE

| OFF | DEF | OUTCOME |
|---|---|---|
| Hi Sum | Lo Sum | **SINGLE** |
| Lo Sum | Hi Sum | Ground Out.<br>If OFF has men on base refer to Base Runner Chart |
| Equal Sums | Equal Sums | **FLY OUT.** |
| Match Sums | Match Sums | Fly Out. |
| Double Ones | No Doubles | Single; High throw to First Base pulls defender off bag.<br>OFF draws a DEF ERROR CARD |
| Double Two's | No Doubles | Double,<br>OFF draws an UMP CARD |
| Double Three's | No Doubles | Triple,<br>OFF draws an UMP CARD |
| Double Fours And Fives | No Doubles | Single, Each team rolls Two Dice once for an Extra Base.<br>If DEF rolls Sixes, batter is thrown out at Second.<br>DEF draws an UMP CARD |
| Double Sixes | No Doubles | Home Run, unless DEF rolls Sixes, then caught at wall.<br>DEF draw an UMP CARD, |
| No Doubles | Double Ones | Ball went Foul, DEF draws an UMP CARD |
| | Double Two's | Double play 1st + 2nd if available, otherwise out at First.<br>DEF draws an UMP CARD |
| | Double Three's | Double play 2nd + 3rd if available, otherwise out at First.<br>DEF draw an UMP CARD |
| | Double Fours and Fives | Lead Man Out.<br>DEF draws an UMP CARD |
| | Double Sixes | Choice of Double play from 1st t to Home.<br>DEF draws an UMP CARD |
| High Doubles | Low Doubles | Held to a Single,<br>unless the batter rolls Double Ones, Foul Ball |
| Low Doubles | High Doubles | Fly Out, If OFF has men on base each team rolls Two dice once for a win or lose roll to see if the men on base can tag up and advance. |
| Matched Doubles | Matched Doubles | Ball goes Foul (except with Double Sixes, then ball caught at wall,<br>DEF draw an UMP CARD |

FIGURE 27D

| BASE RUNNER RESULTS Pro | |
|---|---|
| WHEN TO USE | After a Hit and a Ground Out has been rolled and the OFF has runners on base. |
| PROCEDURE | Each team rolls One Die for the following outcomes. |
| DOUBLE SIXES RULE | Applies |
| 1/6 RULE | Applies |
| NOTE | The following results are the most probable to occur based on several seasons of tracking professional baseball results, where men are on base and a ground out is hit. |
| | |
| OFF WINS THE ROLL | |
| MEN ON BASE | OUTCOME |
| Man on 1st | Man to 2nd and Batter Out at 1st |
| Man on 2nd | Man to 3rd and Batter Out at 1st |
| Man on 3rd | OFF has the choice to sacrifice the batter to 1st by attempting to bring man on 3rd home. Each team rolls Two Dice. If OFF wins its good, if DEF wins 3rd is Out at Home Plate and the Batter is Safe at 1st.<br>OFF Sixes, DEF ERROR CARD.<br>DEF Sixes, UMP CARD.<br>Each Sixes DEF wins, no card is earned. |
| Man on 1st and 2nd | Man to 3rd Safe, Man to 2nd Out and Batter Safe at 1st |
| Man on 1st and 3rd | 3rd base to Home Plate, Man to 2nd Out and Batter Safe at 1st. |
| Man on 2nd and 3rd | Man on 3rd to Home Plate, Man to 3rd Out and Batter Safe at 1st. |
| Bases Loaded | Man on 3rd Home, 2nd to 3rd Out, 1st to 2nd Safe and Batter to 1st Safe. |
| | |
| **DEF WINS THE ROLL** | |
| **MEN ON BASE** | **OUTCOME** |
| Man on 1st | Man to 2nd is Out, Batter Safe at 1st |
| Man on 2nd | Man at 2nd held, Batter Out at 1st |
| Man on 3rd | Batter Out at 1st, Man on 3rd held. |
| Man on 1st and 2nd | 2nd to 3rd is Out, 1st to 2nd Safe and Batter Safe at 1st |
| Man on 1st and 3rd | Man to 2nd Out, Man on 3rd held and Batter Safe at 1st. |
| Man on 2nd and 3rd | Men on 2nd and 3rd are held, Batter Out at 1st. |
| Bases loaded | 3rd Out at Home Plate, 2nd to 3rd Safe, 1st to 2nd Safe, Batter Safe at 1st. |

| 1/6 RULE FOR GROUND OUTS WITH MEN ON BASE | | |
|---|---|---|
| OFF | DEF | |
| Six | One | Field Error, all men on base advance one base, OFF DEF ERROR CARD |
| One | Six | Double play from lead man back, DEF UMP CARD |
| Six | Six | Lead man out. |

FIGURE 27E

Dice Rules and Rolling for Additional Movement of Play

1. The following rules apply to all OTR games and reflect the Sum of two dice rolled or one die rolled, further details on outcomes are found on appropriate play charts for the game being addressed.

Football: Till Play Ends (TPE) indicates the OFF has won the roll and can continue to roll any number of dice until the DEF beats the OFF roll, end of play.

Soccer, Basketball and Hockey: Normal Play Mode (NPM) the equivalent of TPE, which indicates the teams continue to roll simultaneously in continuation play, for instance after a shot attempt, pass or steal.

Golf, Baseball, Boxing and Racing: (TPE) or (NPM) continual play directives are applied through the rules of procedure to complete a play based on the particular sport type and authentic game play.

1. For instance where in Baseball, a player after rolling a six, (a hit) each team then rolls two dice for the results of type hit and possible further rolling if the team up at bat has men on base.
2. For instance where in Golf, a player lands in a hazard and must roll one die first for a toggle value, then two dice to try and roll toggle value needed or else continues rolling with a changing toggle value until player rolls what is needed and escapes hazard. Putting requires similar procedure.
3. For instance where in Boxing/Racing, players constantly roll simultaneously and rolling doubles or a higher odds roll supports additional free rolls and continuation of particular play moment.

Double dice rolls

| OFF/AT/Player 1 etc | DEF/DT/Player 2 etc | OUTCOME |
|---|---|---|
| Hi Sum | Lo Sum | Winner/Player advances/benefits by or from sum of roll and each team/player continues rolling in NPM, TPE, or until particular play occurrence is completed. |
| Lo Sum | Hi Sum | Winner/Player stops gain, ends/wins play, finishes play requirement |
| Equal or Match Sums | Equal or Match Sums | Winner/Player stops gain, ends/wins play. Ties generally go to the DEF in roll for roll game play. |
| Doubles | No Doubles | Winner/Player advances/ benefits by or from sum of roll and rolls again undefended or free roll with further free rolls if condition still exists or game play proceeds in NPM, TPE or until the particular play occurrence is completed |
| No Doubles | Doubles | Winner/Player stops gain, ends/ wins play, finishes play requirement with generally stronger advantage or damaging result to opposing player |
| Any Roll Except Double Sixes | Double Sixes | Winner/Player benefits largely by advantages of particular sport played and in many cases play continues in NPM, TPE or until the particular play occurrence is completed. |
| Hi/ Lo/ Equal Doubles | Hi/Lo/ Equal Doubles | Defaults to Hi /Lo rolls. |

Single Die rolls

| OFF/AT Player 1 etc | DEF/DT Player 2 etc | OUTCOME |
|---|---|---|
| Hi Value | Lo value | Winner/player advances/benefits by or from sum of roll, each team/ player continues to roll in NPM, TPE, or until the particular play occurrence is completed |
| Lo Value | Hi Value | Winner/Player stops gain, ends/wins play, finishes play requirement. |
| Equal Value | Equal Value | Winner/player stops gain, ends or wins play. Ties generally go to the DEF in roll for roll game play. |
| Six | One | DEF Penalty/Violation or in some other cases an OFF advantage |
| One | Six | DEF Penalty/Violation or in some other cases a DEF advantage |
| Six | Six | Off setting Penalties/Violations or in some other cases another type of DEF advantage |

Note: There are various special conditions for Double sixes and Double ones as well as for single die One/Six rolls. See Sixes rule chart for further details.

FIGURE 28

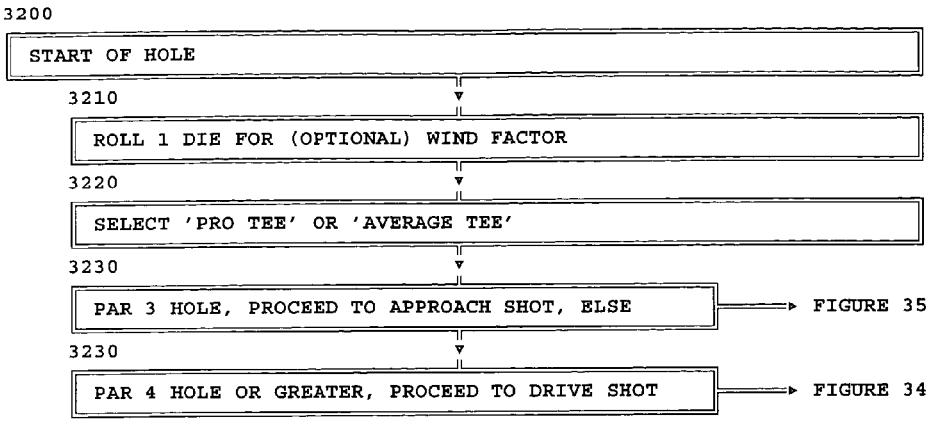
FIGURE 32: OTR GOLF — SYSTEM OF PLAY — START OF HOLE
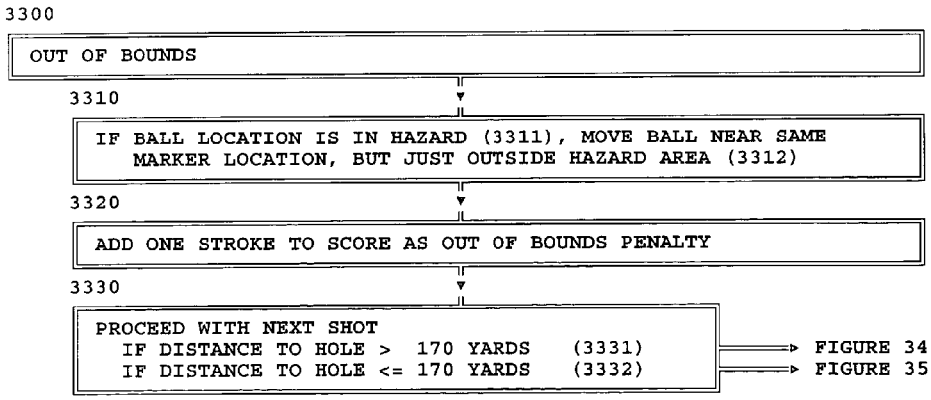
FIGURE 33: OTR GOLF — SYSTEM OF PLAY — OUT OF BOUNDS

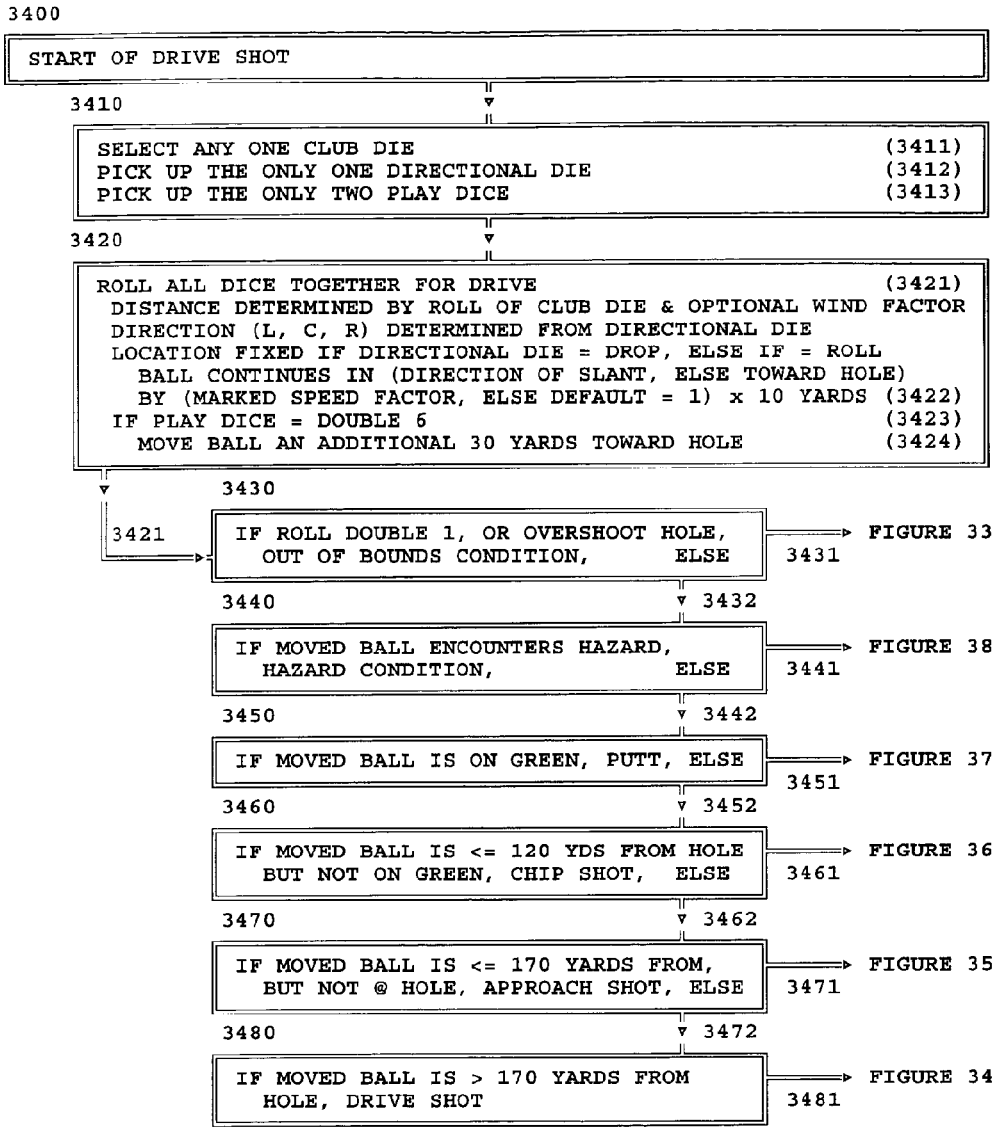
FIGURE 34: OTR GOLF — SYSTEM OF PLAY — DRIVE SHOT

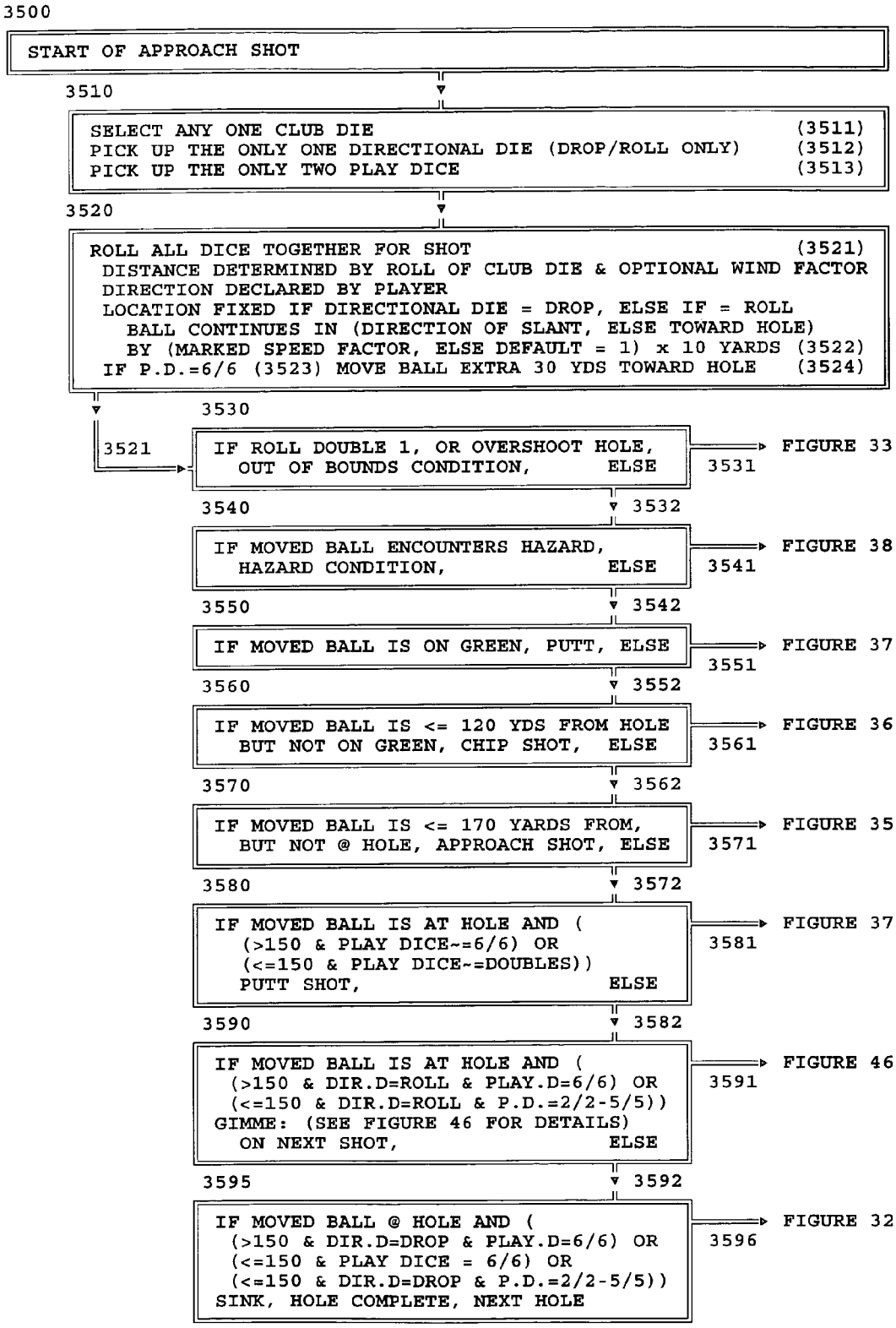
FIGURE 35: OTR GOLF — SYSTEM OF PLAY — APPROACH SHOT

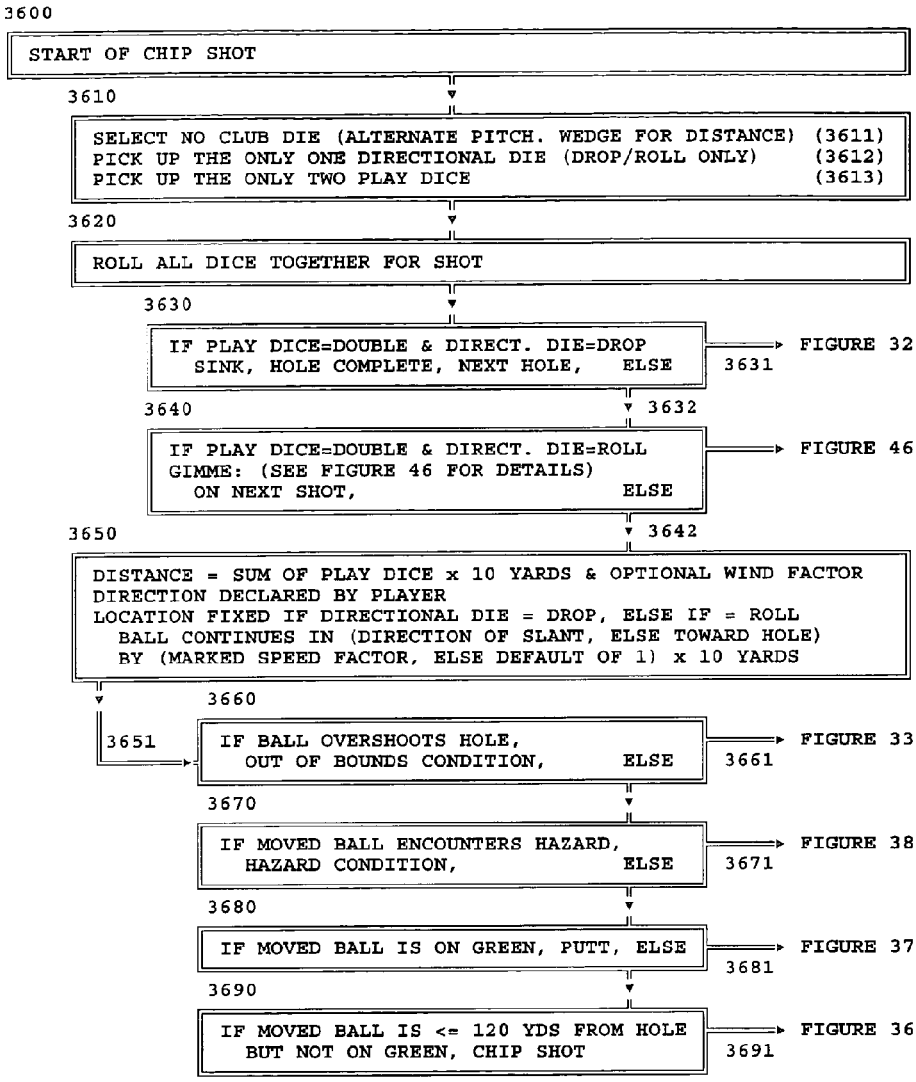
FIGURE 36: OTR GOLF — SYSTEM OF PLAY — CHIP SHOT

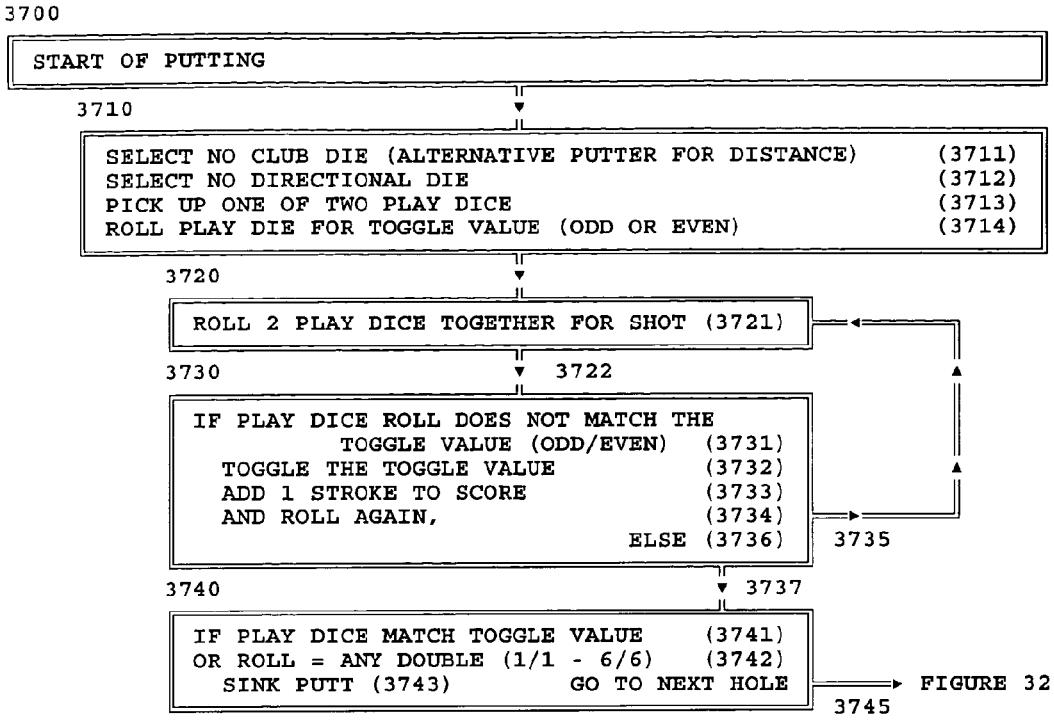
FIGURE 37: OTR GOLF — SYSTEM OF PLAY — PUTTING

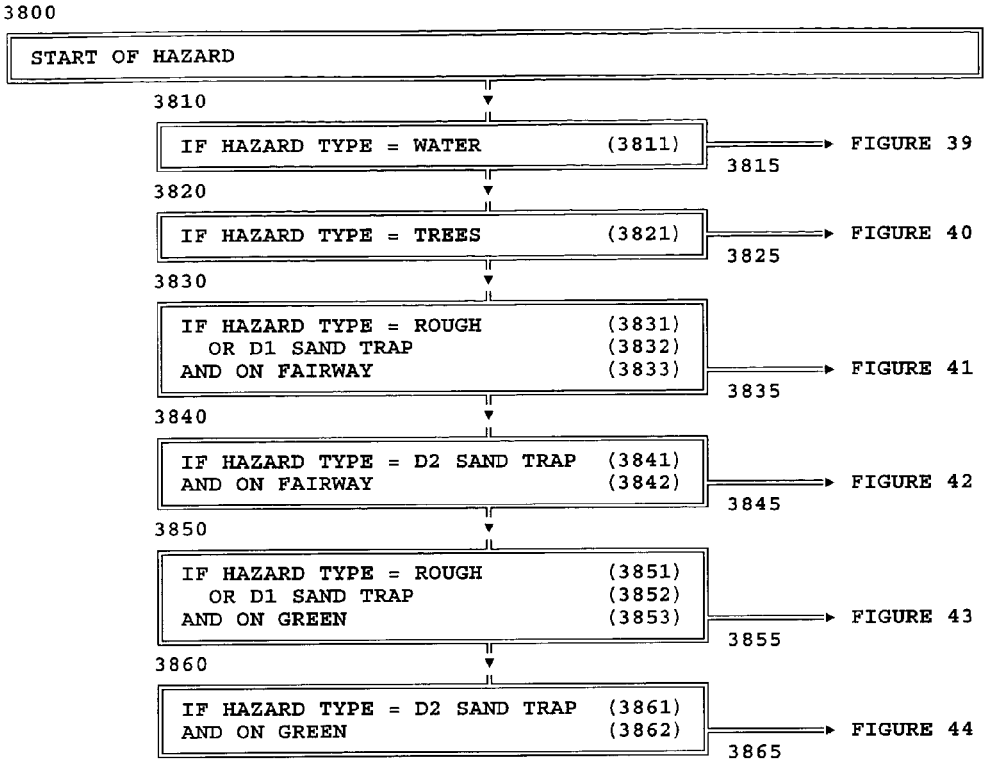
FIGURE 38: OTR GOLF — SYSTEM OF PLAY — HAZARD SELECTION

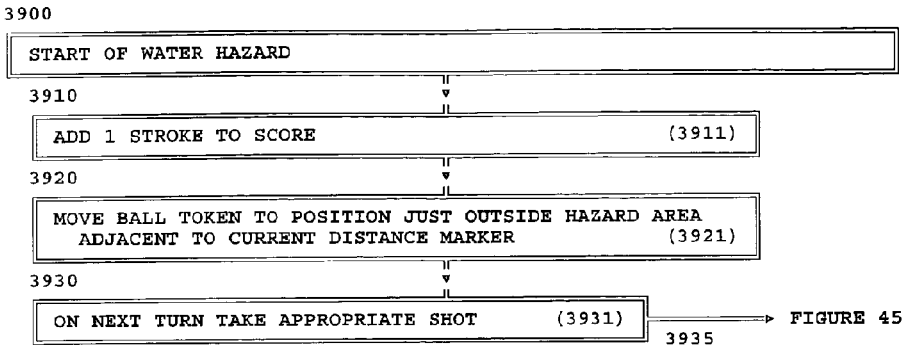
FIGURE 39: OTR GOLF — SYSTEM OF PLAY — WATER HAZARD
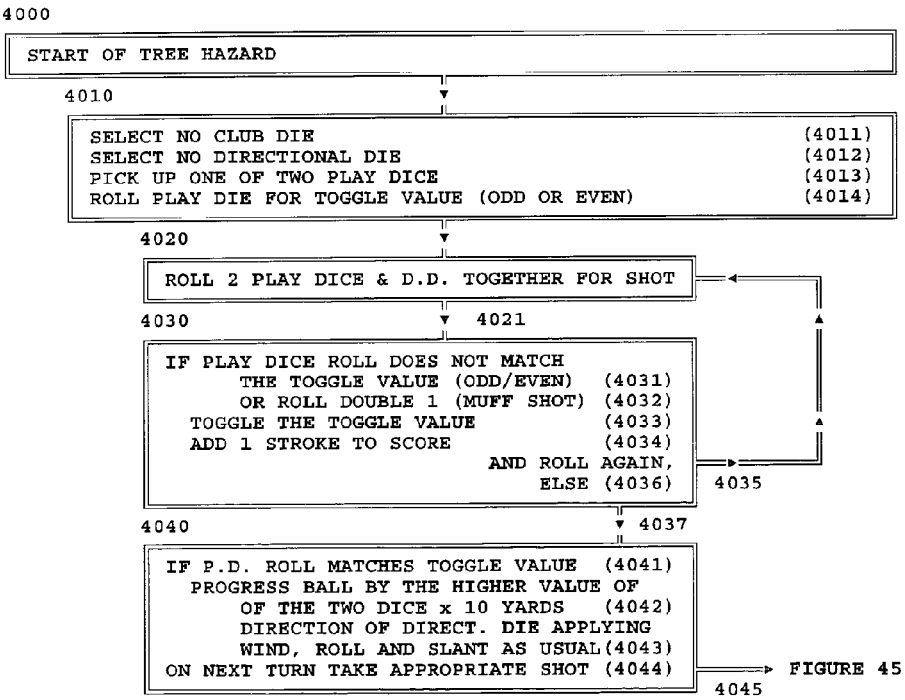
FIGURE 40: OTR GOLF — SYSTEM OF PLAY — TREE HAZARD

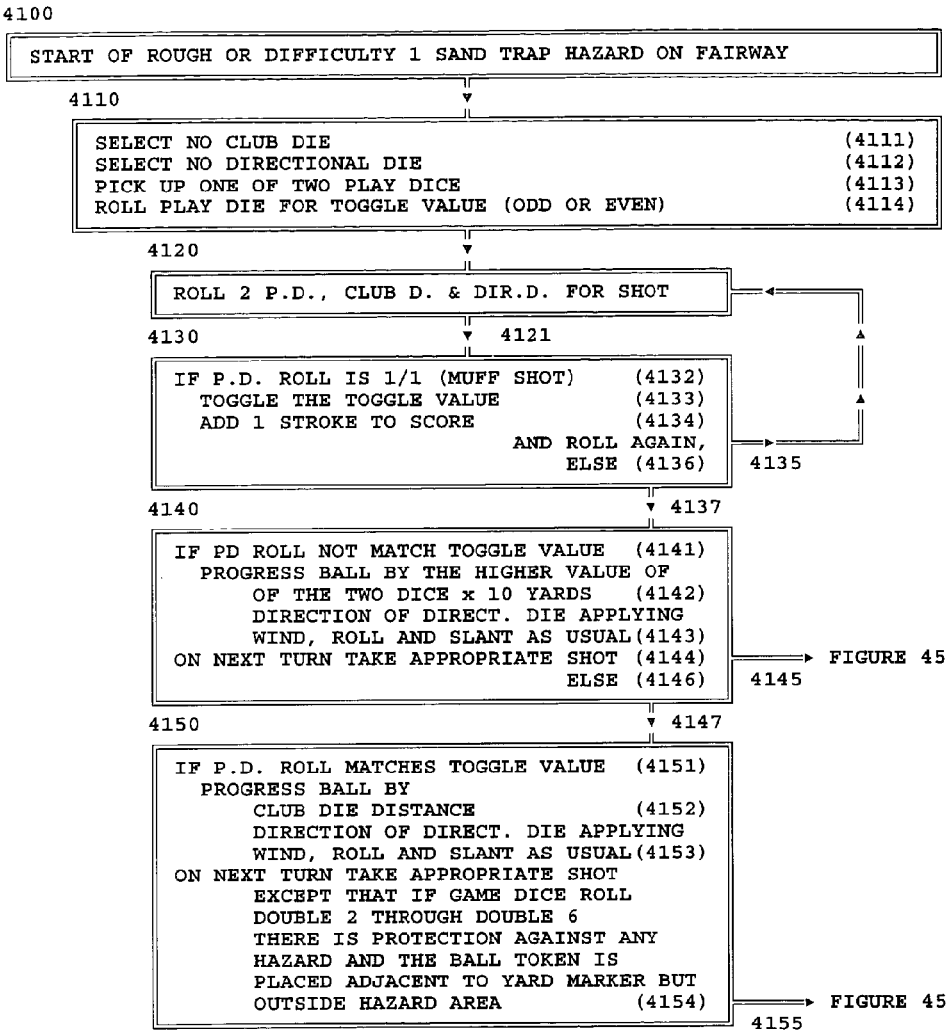
FIGURE 41: OTR GOLF — SYSTEM OF PLAY
FAIRWAY ROUGH/DIFFICULTY 1 SAND TRAP HAZARD

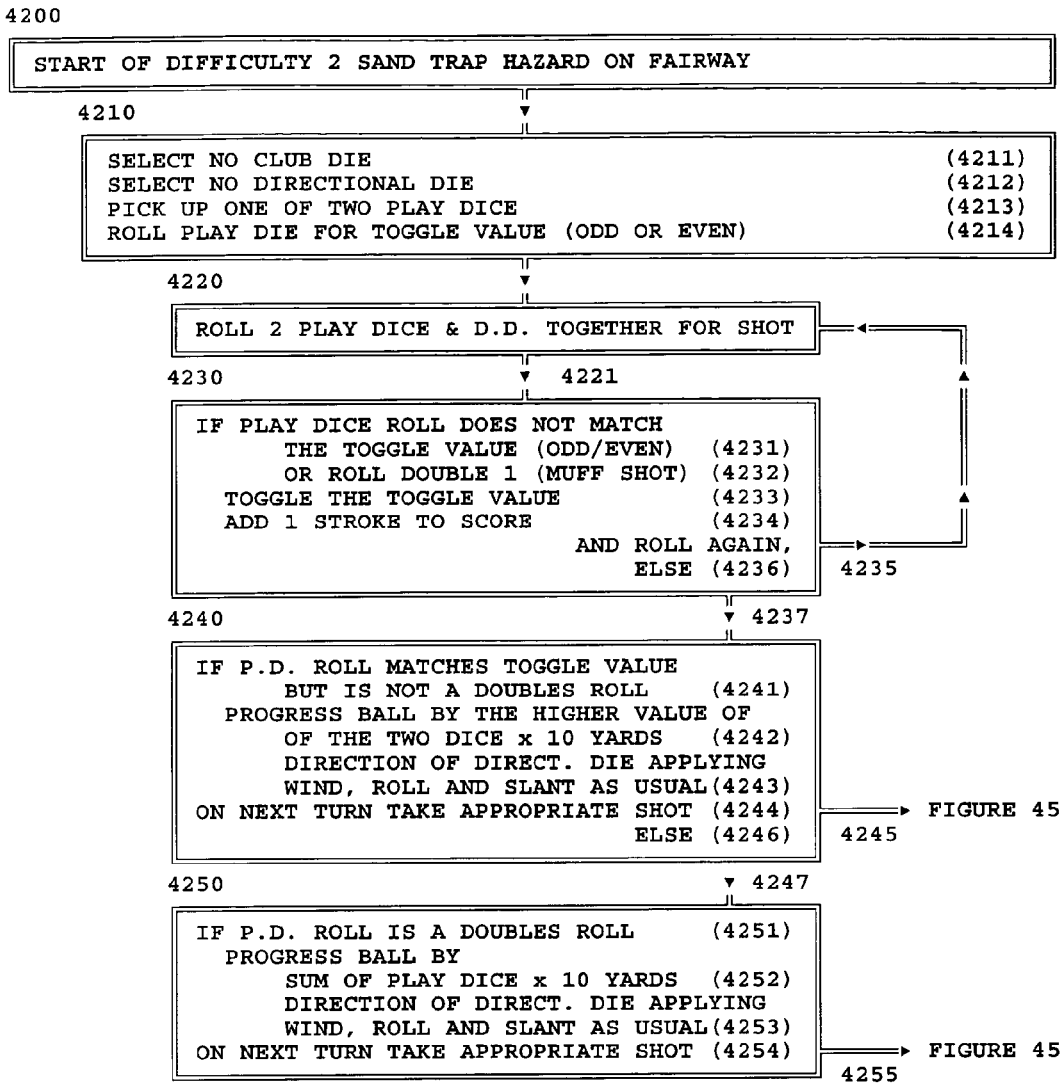
FIGURE 42: OTR GOLF — SYSTEM OF PLAY
FAIRWAY DIFFICULTY 2 SAND TRAP HAZARD

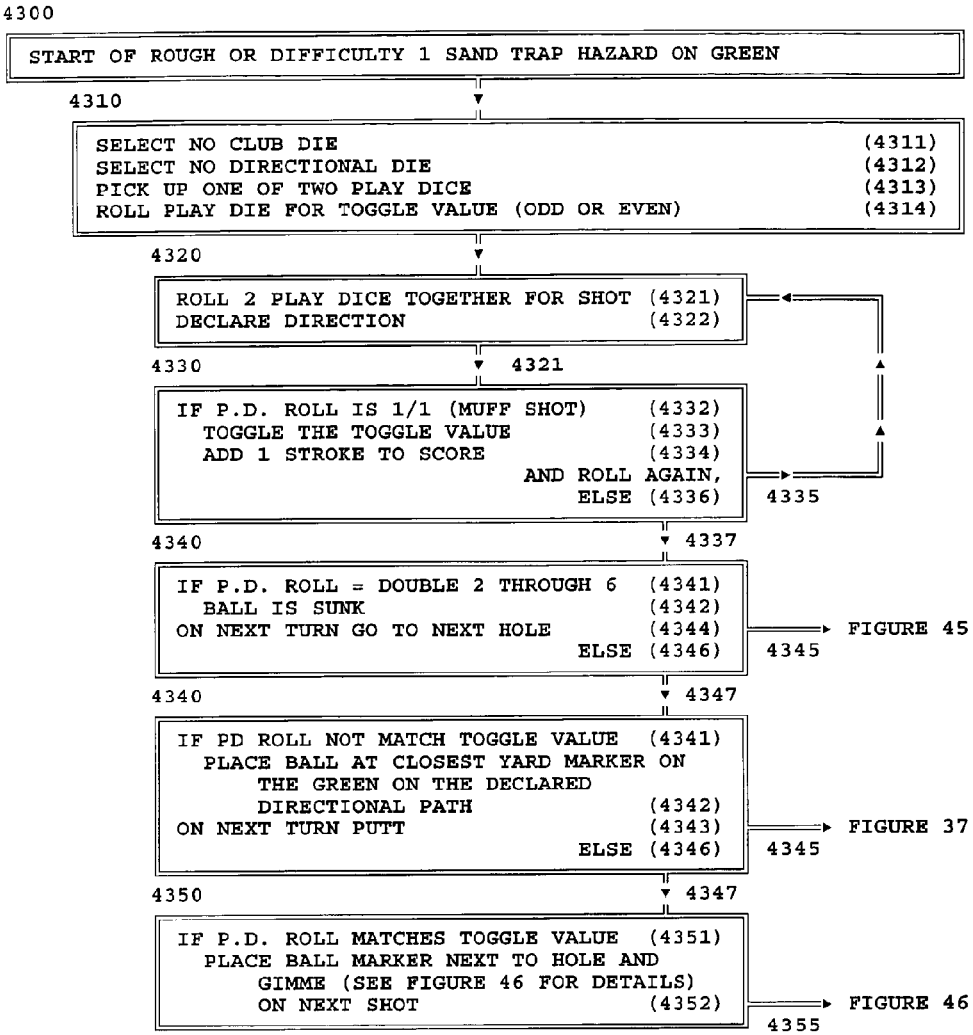
FIGURE 43: OTR GOLF — SYSTEM OF PLAY
GREEN ROUGH/DIFFICULTY 1 SAND TRAP HAZARD

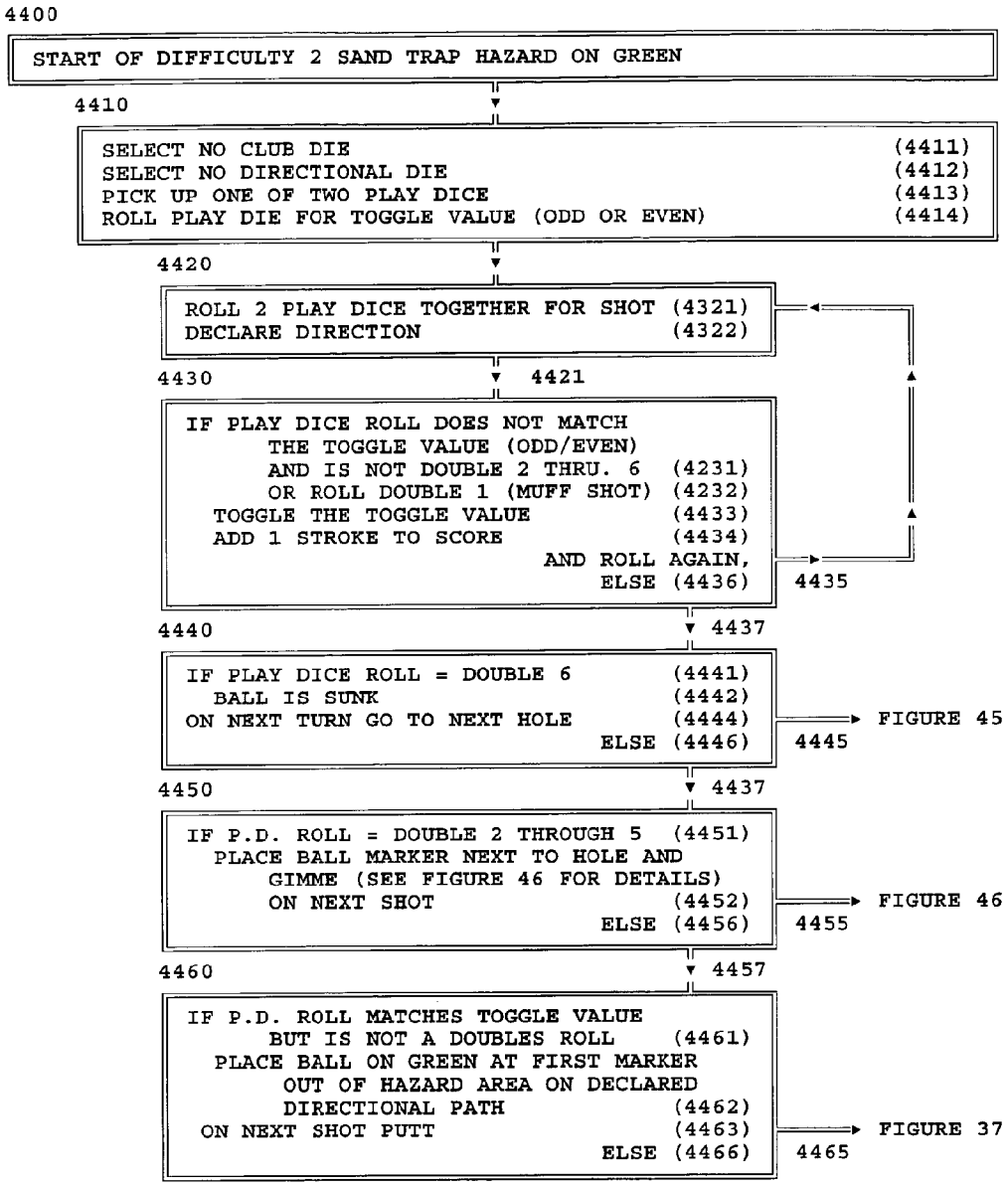
FIGURE 44: OTR GOLF — SYSTEM OF PLAY
GREEN DIFFICULTY 2 SAND TRAP HAZARD

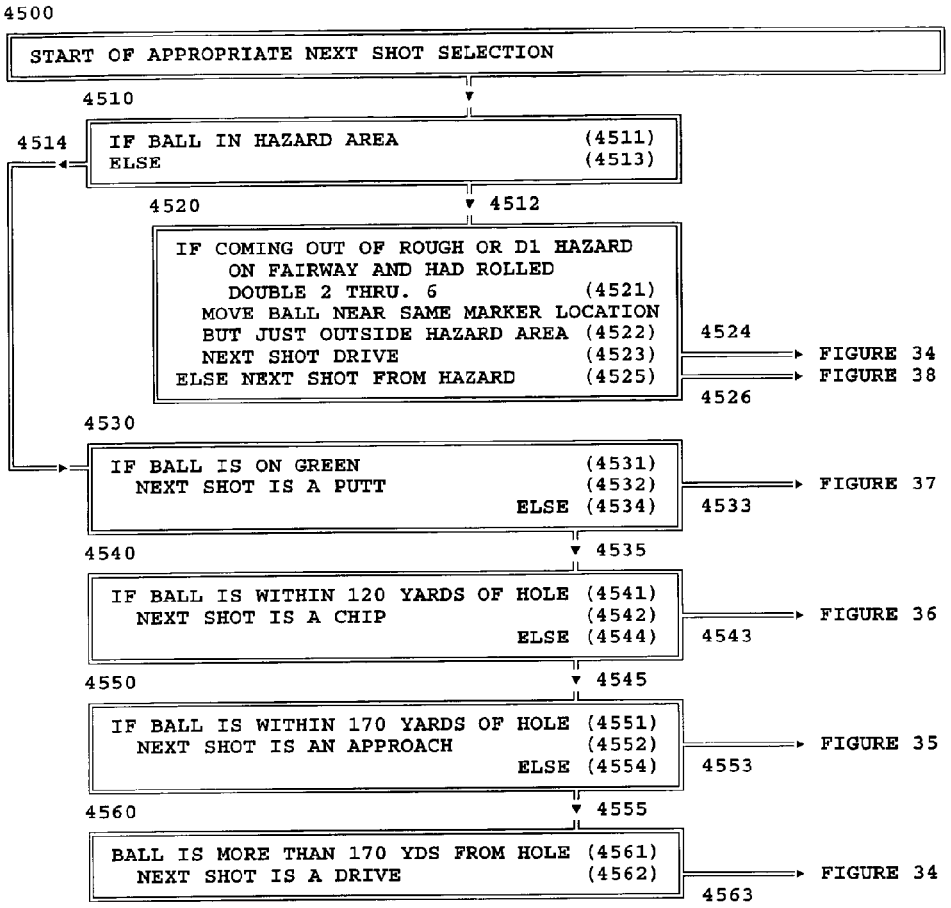
FIGURE 45: OTR GOLF — SYSTEM OF PLAY — APPROPRIATE NEXT SHOT SELECTION
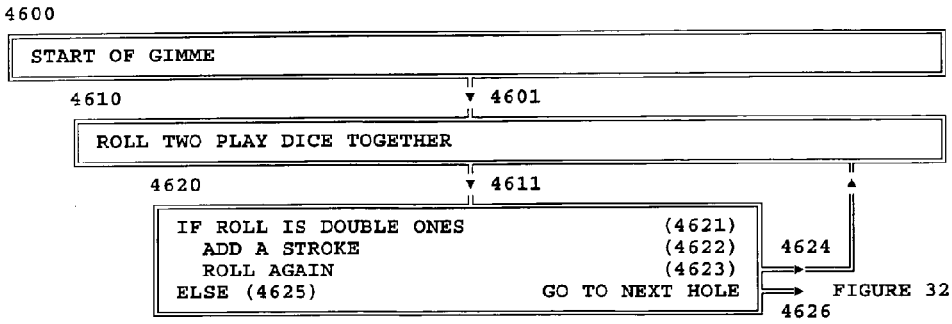
FIGURE 46: OTR GOLF — SYSTEM OF PLAY — GIMME SHOT

| DIE | WIND SPEED | WIND DIRECTION | DIRECT HEAD | INDIRECT HEAD | DIRECT TAIL | INDIRECT TAIL |
|---|---|---|---|---|---|---|
| 1 | 10 MPH | DUE NORTH | -10 YARDS | 0 DEDUCTION | +10 YARDS | 0 ADDITION |
| 2 | 20 MPH | DUE SOUTH | -20 YARDS | -10 YARDS | +20 YARDS | +10 YARDS |
| 3 | 30 MPH | DUE EAST | -30 YARDS | -20 YARDS | +30 YARDS | +20 YARDS |
| 4 | 40 MPH | DUE WEST | -40 YARDS | -30 YARDS | +40 YARDS | +30 YARDS |
| 5 OR 6 | 0 MPH | NO WIND | N/A | N/A | N/A | N/A |

FIGURE 47

| AT ROLL | DT ROLL | OUTCOME |
|---|---|---|
| 1 | 6 | OFFENSIVE FOUL: OFF DRAWS AN OFF VIOLATION CARD |
| 6 | 1 | DEFENSIVE FOUL: DEF DRAWS A DEF VIOLATION CARD |

FIGURE 48

| AT ROLL | DT ROLL | OUTCOME |
|---|---|---|
| HI VALUE | LOW VALUE | AT ADVANCES THE VALUE OF THEIR ROLL |
| LOW VALUE | HI VALUE | DT TAKES POSSESSION & ADVANCES THE VALUE OF THEIR ROLL |
| EQUAL VALUE | EQUAL VALUE | NO ADVANCEMENT BY EITHER TEAM<br>BUT TEAM WITH POSSESSION MAY ATTEMPT TO PASS TO ANOTHER TEAMMATE IF MORE THAN ONE PLAYER PER TEAM ARE PLAYING, OR MAY CONTINUE TO ROLL<br>ONCE IN SCORING POSITION A SHOT MAY BE ATTEMPTED |

FIGURE 49

| AT ROLL | DT ROLL | OUTCOME |
|---|---|---|
| HI VALUE | LOW VALUE | AT ADVANCES THE VALUE OF THEIR ROLL |
| LOW VALUE | HI VALUE | AT ADVANCES THE DIFFERENCE BETWEEN THE VALUE OF THE ROLLS (DT IS PLAYING TIGHT COVERAGE) |
| EQUAL 1-5 | EQUAL 1-5 | NO ADVANCEMENT BY AT<br>BUT THEY MAY ATTEMPT TO PASS TO ANOTHER TEAMMATE IF MORE THAN ONE PLAYER PER TEAM ARE PLAYING, OR MAY CONTINUE TO ROLL; ONCE IN SCORING RANGE, A SHOT MAY BE ATTEMPTED |
| EQUAL 6 | EQUAL 6 | DEFENSE TAKES POSSESSION OF BALL AND ADVANCES ON UNDEFENDED ROLL |

FIGURE 50

| FIGHTER 1 | FIGHTER 2 | OUTCOME |
|---|---|---|
| HI SUM, 7 | LOW SUM, 3 | FIGHTER 1 THROWS JAB TO SHOULDER AREA, DOES NOT SCORE |
| DOUBLES | NO DOUBLES | FIGHTER 1 LANDS TYPE OF PUNCH WHICH SCORES BIG & ROLLS ALONE A SECOND TIME FOR ANOTHER PUNCH TO FIGHTER 2 UNDEFENDED IN A FLURRY OF HIGH SCORING PUNCHES |

FIGURE 51

METHODS AND DEVICES FOR ON-THE-ROLL SPORTS GAMES

This application is a continuation of U.S. patent application Ser. No. 13/752,182, filed Jan. 28, 2013, which is a continuation-in-part of U.S. patent application Ser. No. 12/748,919, filed Mar. 29, 2010, now U.S. Pat. No. 8,360,433, which is a continuation of U.S. patent application Ser. No. 10/817,119, filed Apr. 2, 2004, now U.S. Pat. No. 7,686,304, which claims the benefit of U.S. Provisional Application No. 60/459,863, filed Apr. 2, 2003, the full disclosures of which all are incorporated herein by reference. The above referenced documents are not admitted to be prior art with respect to the present invention by their mention herein.

CROSS-REFERENCES TO RELATED APPLICATIONS

The present application is related to U.S. patent application Ser. No. 13/752,182, filed Jan. 28, 2013, which is a continuation-in-part of U.S. patent application Ser. No. 12/748,919, filed Mar. 29, 2010, now U.S. Pat. No. 8,360,433, which is a continuation of U.S. patent application Ser. No. 10/817,119, filed Apr. 2, 2004, now U.S. Pat. No. 7,686,304, which claims the benefit of U.S. Provisional Application No. 60/459,863, filed Apr. 2, 2003. The above referenced documents are not admitted to be prior art with respect to the present invention by their mention herein.

BACKGROUND OF THE INVENTION

1. Field of the Invention

The present invention relates generally to board games that schematize competitive sports; and more particularly to schematizing professional American football.

2. Background Art

The instant invention has been made in the general realm of games. However, these are board games based on sports (e.g., football, baseball, basketball, boxing, etc.) as opposed to: abstract strategy board games (e.g., chess, checkers, Othello, etc.); theme board games (e.g., Monopoly or Careers); other strategy games such as those utilizing cards (e.g., Gin, Poker or Mille Bornes) or tiles (e.g., Mah Jongg); video action games or games of skill (e.g., Doom or Pacman); physical games (e.g., jacks or Twister) or role playing games (e.g., Pokemon or Dungeons and Dragons).

More particularly, the instant invention is a board game based on sports that employs a novel use of dice, unlike any game currently known to inventor, called On-The-Roll™. One particular preferred embodiment is a game that schematizes professional American NFL football.

A number of sports games, including football games, are already extant and patented. Several bear particular mention in that they share some elements with the instant invention; yet, the instant invention is patentably distinct from each.

U.S. Pat. No. 5,769,419, Football Board Game, issued Jun. 23, 1998 to Thomas Hill is unlike the instant invention in that it utilizes decks of cards to gain yardage. It also has cards that are irrelevant to football such as Jack, King and Ace that affect the outcome of the game, particularly the ace which provides for an automatic touchdown without possibility of defense. The game also does not require dice for each play and denies the opportunity for the offense to continue gaining yardage on plays. This game further fails to provide for important elements of football such as fumbles on punts and kickoffs and does not provide for returns after a fumble. Penalties are assessed by colored chips visible to the players which allow a player to know in advance how many yards they would be assessed for a penalty. Most importantly Hill does not have the dynamic "On The Roll" element which allows for a play to continue until the offense loses a roll of the dice.

U.S. Pat. No. 5,217,229, Football Board Game, issued Jun. 8, 1993 to Francisco Jaime is unlike the instant invention in that this game instructs the offense to roll the dice and then show their play selection chip. The defense has a chance to defend on a play, but from a sideline standpoint. The defense does not roll any dice along with the offense but rather resort to guessing the offense's roll and play by means of a play chip placement along with the offense on a chart. There are several plays and rules that present restrictions that otherwise do not exist in professional football. This includes preventing an interception from being returned if it occurs at a certain section or zone on the field, or limiting a sack to a range of 1 to 9 yards only through a special game rule. Further kick-off returns are limited to just two rolls for the receiving team. Again this game does not contain the "On the Roll" element of the instant invention. U.S. Pat. No. 4,989,879, Football Board Game, issued Feb. 5, 1991 to James L. Nigh is unlike the instant invention in that there are no play cards used to illustrate the intent of the opposing teams in respect to their play type selection. A predetermined amount of time is automatically deducted from the clock for many plays removing the very need for precise clock management this is in contrast to the instant invention which uses the clock to simulate the tension and speed of a real football game and makes the clock an integral part of game tactics and strategy. The game includes the use of three degrees of offensive and defensive dice for field movement. The totals rolled by the players are then subtracted from each other for every play to demonstrate the yards gained on that play. Additionally, several plays are formatted so that the offense rolls and then the defense rolls taking away the simultaneous interaction that is football. These are in contrast to the "On the Roll" element of the instant invention which involves dice rolls on each play and continued rolls for additional yardage.

U.S. Pat. No. 4,203,605, Football Game, issued May 20, 1980 to Joe W. Moody is unlike the instant invention in that the players use a rotating selector cup to declare their play intent, with no detail on the play. For instance, the defense has no specific play to match up to the offense play outside of rotating the selector cup to "defense". Unlike the instant invention which uses charts to increase the complexity and interest of the game, Moody has very simple and limited play action using dice. Further, during play the dice are compared and various dice are eliminated by color. This game also has only limited penalties and fails to cover the possibilities present in real football. Again this patent lacks the "On the Roll" element of the instant invention.

U.S. Pat. No. 4,173,346, Board-Type Game Simulating Football Game, issued Nov. 6, 1979 to William D. Godwin is unlike the instant invention in that this game is designed to prevent one side from becoming dominant, as occurs in real football. Unlike the instant invention which through the "On the Roll" mechanism allows for breakaway situations the Godwin patent tries, for example, on run plays, to contain the yardage gained on plays through complicated dice calculations. A further distinction is the lack of a clock, with the time of the game being determined by counting possessions of a team. Because of this Godwin lacks the dynamic play found in the instant invention and in real football. This patent also differs in that on pass plays only the offense uses cards and the defense is not involved at all with kick plays and extra points. Some plays also require the offense to roll first and then pick a card. Generally, Godwin lacks a consistent method of play, such as that found in the instant invention.

Generally what can be said of the prior art is that it fails to capture the dynamic nature and complexity of a real football game. The instant invention by having the offense and defense each select plays, using the clock to create pressure to select plays and roll quickly, having both sides roll dice for each play, and most importantly using the "On the Roll" mechanism to continue a play for indeterminate amounts of time, more closely simulates a real football and the elements that make it exciting and interesting to watch and to play.

It is assumed, in the discussion below, that the reader is familiar with the rules of football, and the other games which have been, or can be, adapted to the On-The-Roll model of the instant invention. For those not familiar with, for example, the rules of professional American NFL Football, upon which the primary preferred embodiment is based, the reader is referred to the Official Playing Rules of the National Football League, published by Triumph Books, Chicago.

The intended practitioner of the present invention is someone who is skilled in designing, implementing, building, creating, printing or publishing board games. That is, one skilled in the art required to practice the instant invention is capable of one or more of the following: design, graphics production, printing, publishing and/or construction of game boards, pieces and/or packaging.

Several versions of the games derived from the instant invention are available: low-cost mass-market board games; a roll-up board with sports-type duffel bag to package the various game components; deluxe versions; table-top versions; etc.

The details of accomplishing such standard tasks are well known and within the ken of those skilled in those arts; are not (in and of themselves, except where noted) within the scope of the instant invention; and, if mentioned at all, will be referred to, but not described in detail, in the instant disclosure.

Rather, what will be disclosed are novel configurations of boards and pieces, and move or play algorithms or rules of play.

In summary, the disclosure of the instant invention will focus on what is new and novel and will not repeat the details of what is known in the arts.

SUMMARY

The present invention is directed to an approach to realistically schematizing professional team sports embodied as board games, and particularly a preferred embodiment schematizing American football, baseball and basketball, as well as soccer, ice hockey and golf. One key to the realistic play of the game is the On-The-Roll™ ("OTR") mechanism where, once play begins, real time play continues, generally against a clock, where both teams, generally, continue to roll dice continuing sub-play actions or elements, until a play is completed, as by a touchdown, tackle, or otherwise. Other games employ a one-player OTR mechanism for processes such as putting or hazard escape in golf. An additional essential element is a series of rules and charts, based on statistical compilation of many actual professional games, that map various combinations of offensive and defensive strategy options and dice rolls onto realistic game situations and the progression among them. Further, a mechanism is often employed where both teams: secretly choose a strategy, generally by selecting a card placed face down; roll one or more dice; reveal strategy choices by turning cards face up; determine a situation chart to consult, and further determine which result is selected from within the chart, based on some combination of which cards were played and the results of the dice rolls. An additional element is a variety of play cards that affect the overall game momentum of either team. Additional authenticity is achieved in golf, for example, by constructing a variety of dice roll mechanisms and progress rules that each correspond to the specific performance of an environmental or landscaping element such as wind magnitude and direction, ground slant, grass roll speed, and various hazards of diverse properties and difficulties including water, trees, roughs, and sand traps of various depths.

DRAWINGS

These and other features, aspects, and advantages of the present invention will become better understood with regard to the following description, appended claims, and accompanying drawings where:

FIG. 9 depicts samples of the Various Offensive and Defensive Play Cards, and other cards used during the game;

FIGS. 10A, 10B and 10C depict three of the Technical Charts: Game Clocks (A); Dice Combinations (B) and Dice Rules for Rolling for Additional Yards (C);

FIGS. 11A-11D depict samples of the most commonly used Play Book Charts for the Pro version of the game: Pass Play Offense Wins (A), Run Play Offense Wins (B), Pass Play Defense Wins (C), Run Play Defense Wins (D);

FIGS. 12A-12F depict samples of the Play Book Charts explaining how to use several of the most commonly used play cards: Play Option Run Card (A), Change Up Defense (B), Kick-Off (C), Field Goal (D), Punt (E), and West Coast Offense (F);

FIG. 13A-13C depict Play Book Charts containing the Dice Rules;

FIG. 14 depicts the Most Common Rules During the Game;

FIG. 18 depicts a typical OTR Soccer card;

FIG. 19 depicts OTR Soccer advancement chart;

FIG. 20 depicts OTR Soccer shot eligibility chart;

FIG. 21 depicts OTR Soccer (Pro) scoring chart;

FIG. 23 depicts OTR Baseball Board (2301) and Dugout Card Holder (2302);

FIG. 24 depicts a sample of OTR Baseball Cards;

FIGS. 27A-27E depicts OTR Baseball play charts;

FIG. 28 depicts a chart showing Dice Rules and Rolling for Additional Movement of Play;

FIG. 32 depicts OTR Golf Algorithm Chart: Hole;

FIG. 33 depicts OTR Golf Algorithm Chart: Out of Bounds;

FIG. 34 depicts OTR Golf Algorithm Chart: Drive Shot;

FIG. 35 depicts OTR Golf Algorithm Chart: Approach Shot;

FIG. 36 depicts OTR Golf Algorithm Chart: Chip Shot;

FIG. 37 depicts OTR Golf Algorithm Chart: Putting;

FIG. 38 depicts OTR Golf Algorithm Chart: Hazard Selection;

FIG. 39 depicts OTR Golf Algorithm Chart: Water Hazard;

FIG. 40 depicts OTR Golf Algorithm Chart: Tree Hazard;

FIG. 41 depicts OTR Golf Algorithm Chart: Fairway Rough or D1 Trap Hazard;

FIG. 42 depicts OTR Golf Algorithm Chart: Fairway D2 Sand Trap Hazard;

FIG. 43 depicts OTR Golf Algorithm Chart: Green Rough or D1 Trap Hazard;

FIG. 44 depicts OTR Golf Algorithm Chart: Green D2 Sand Trap Hazard;

FIG. 45 depicts OTR Golf Algorithm Chart: Appropriate Next Shot Selection;

FIG. 46 depicts OTR Golf Algorithm Chart: Gimme Shot;

FIG. 47 depicts the OTR Golf Wind Chart;

FIG. 48 depicts the OTR One Versus Six Chart;

FIG. 49 depicts the OTR Hockey Advancement Chart;

FIG. 50 depicts the OTR Basketball Advancement Chart;

FIG. 51 depicts an Example of a Boxing Chart.

DESCRIPTION

Figure 65:
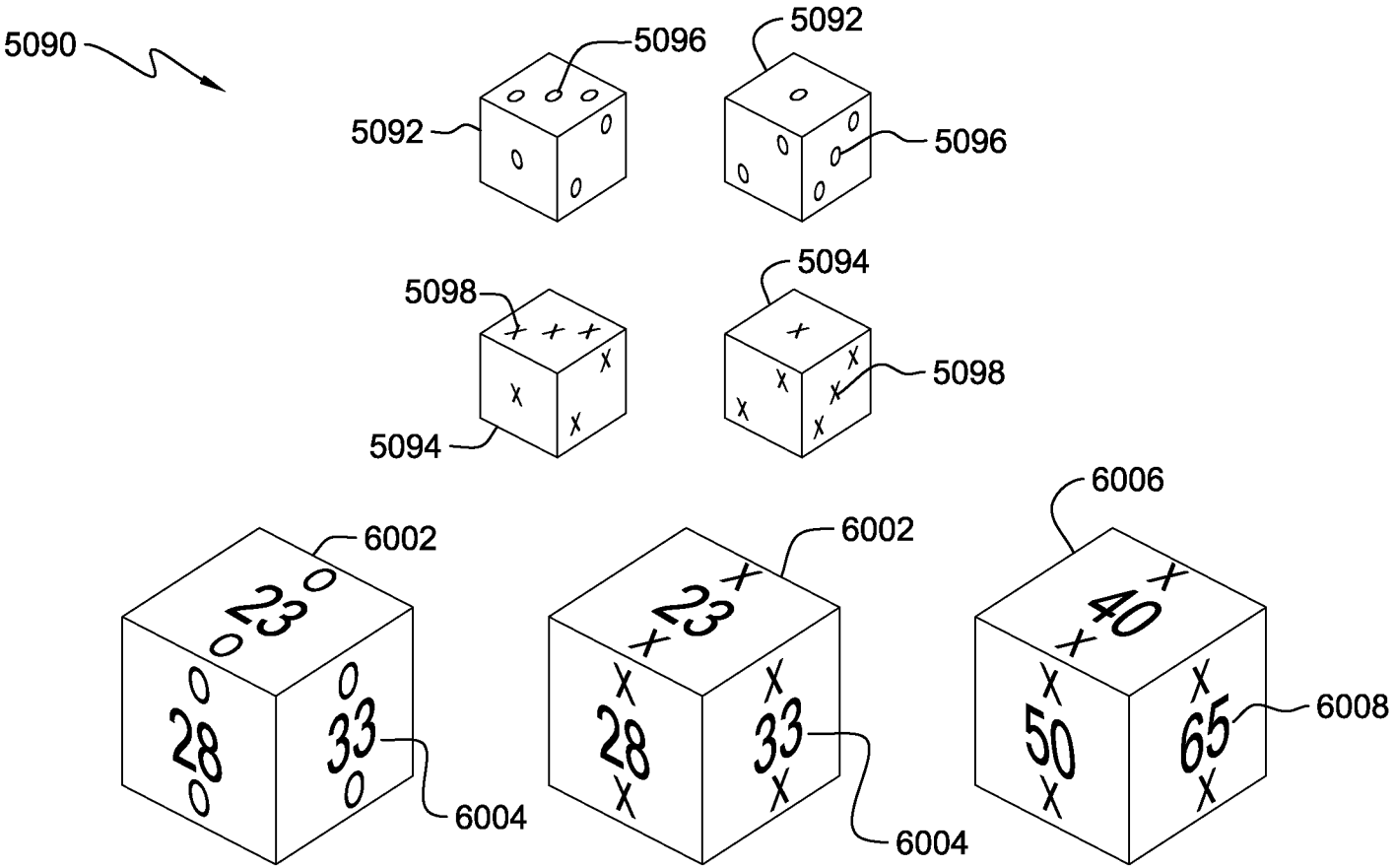
FIG. 65 is a perspective view of sets of specially marked opposing team dice of the alternate embodiment of the football board game of FIG. 52.

The preferred embodiments of the present invention will be described with reference to FIGS. 1-65 of the drawings. Identical elements in the various figures are identified with the same reference numbers.

The On-The-Roll approach of the instant invention realistically schematizes professional team or competitive, sports; and, in particular, a primary preferred embodiment schematizes professional American football. These are embodied as strategic board games, and provide the tension and excitement of a real game as actually played, viewed live or via television.

As with a live game, completely unpredictable circumstances are achieved using play selection, field position, possession control and clock management. Key to achieving this realistic feel to the play of the game is the On-The-Roll™ mechanism where, once a play begins, real time play continues, generally against a clock, where both teams, generally, continue to roll dice continuing sub-play actions or elements, until a play is completed, as by a touchdown, expiration of time, or otherwise. This mechanism is shown in the Dice Rules on Rolling for Additional Yards. See FIG. 10C.

An additional essential element is a series of rules and charts, based on statistics compiled from the play and outcomes of many actual professional games, that map various combinations of offensive and defensive strategy options and dice rolls onto realistic game situations and the progression among and between these situations.

Further, a third inventive element of some On-The-Roll games is a mechanism whereby, for a substantial majority of plays, particularly in the football embodiment, both teams:

- secretly choose a strategy, generally by selecting a card and placing it face down, with the offense (OFF) controlling the timing of this procedure;
- start the game clock or determine that it is running;
- roll one or more dice simultaneously—the dice rolls are compared with ties generally going to defense;
- reveal their strategy choices by turning their cards face up;
- the offense card (and, in some circumstances, which team wins) determines which situation chart to consult; and,
- some combination of which defensive option has been played, and which team won the roll, determines which result is selected from within the chart currently in use or directs the two teams to progress to another series of functions within the same play as a result of the offense using a changeable play with its own chart directives and outcomes.

Figure 15:
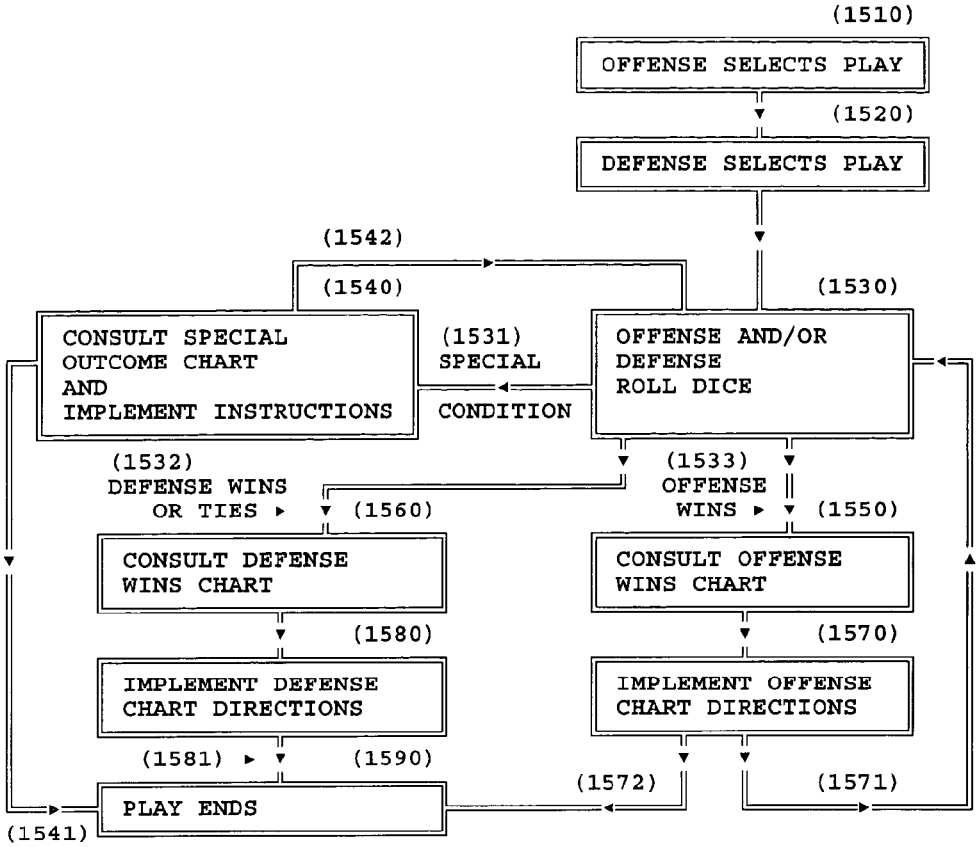
FIG. 15 depicts the Basic Play Algorithm for the "On The Roll" (OTR) Mechanism.

FIG. 15 depicts the basic play algorithm for the On-The-Roll concept, in the abstract.

Generally, there are two sides which, in sport games, are usually referred to as the Offense and Defense.

Prior to the start of active play, one or both sides (1510, 1520), optionally, select a play strategy, as by choosing a card or other marker. Generally, these selections are made in secret (and declared, for example, after the first roll of the dice), but are, alternatively, declared at selection time, or otherwise. In alternative embodiments, play strategy is assigned, as by the roll of a die, or there are no strategy options, other than the default, available to a player.

Once the strategy option for each side has been determined, play begins (1530) by one or both players rolling dice (or by using some other randomizer such as a spinner, or card pick). In the OTR Pro Football preferred embodiment, the Offense and Defense simultaneously each roll a pair of uniquely colored but otherwise standard dice as the opening of active play.

Outcomes include: Offense Wins (1532); Defense Wins (1533, with ties generally going to the Defense in the preferred embodiment alternative); and, Special Conditions (1531) which include, for example, double sixes.

Depending on which of the three outcome conditions prevail (1531, 1532, 1533) an appropriate chart or other rule memorialization (1540, 1560, 1550) is consulted, which chart (or section of chart) will, optionally, also depend upon which strategy has been declared by one or the other or both sides. The rule is then implemented as directed by the appropriate chart (1540, 1580, 1570) where: Offense Wins results in further OTR play (1571) or a Play Ends condition (1572, e.g., as by a touchdown); Defense Wins (or, generally, ties) results in a Play Ends condition (1581); and, Special Outcomes result in further OTR play (1542) or a Play Ends condition (1541) as specified by the chart as modified by strategy selections.

Thus, the gist of the On-The-Roll algorithm is that play continues for an indeterminate number of rolls, until the Play Ends condition is met.

Football Preferred Embodiment

As with virtually all professional team sports (e.g., baseball, basketball, hockey and soccer) American football is an intensely competitive two-team activity where the level of engagement and emotions run high, for player and fan alike.

American football, in particular, is perhaps, however, the one that most closely resembles or markers with the tribal, feudal or societal elements of human culture which are manifested as warfare. Organized team sports (and the ultimate political/team sport of the Olympics) have evolved, some suggest, as a way to channel these instincts into a socially acceptable and safe outlet. Early analogs, such as jousting and gladiator exhibitions retained, to a great degree, the actual elements and danger of battle. In fact, several modern sports (e.g., la crosse or polo) are actually derived from tribal warrior training exercises.

Basically, football is a schematic of warfare, where two armies (teams) fight for possession of the flag (ball), and try to break through a defensive line with the 'goal' of placing the flag onto the home turf (end-zone) of the opposition to claim victory.

However, football has evolved into a highly ritualized activity—from the initial coin toss, to the half-time pageantry, to the end-zone victory dance, to the instant replay—which involves an offense, defense, special teams, officials and, most important, the opposing clans embodied as fans—that is regulated by an official, formal set of rules (See: Official Playing Rules of the National Football League).

American professional NFL football has, thus, become elevated from a relatively small-scale and safe schematic substitute for warfare, into a culturally iconic activity of its own.

The On-The-Roll™. Football Game, in a similar way, now provides a small-scale low-cost schematic substitute for owning your own football franchise and playing your team against an opposing team.

With the realistic On-The-Roll Football game, aficionados can create their own leagues and seasons with opponent teams/players, leading up to playoffs and, eventually, a local or regional Super Bowl. Players can use real game strategies to achieve clock management, ball control, field position, etc. Long-term records can be kept of a player's team's statistics. Players can purchase Team Marker and End Zone, or affixable stickers, representing the logos and colors of real teams (under appropriate license) which are, optionally, removable for use on your own home game, or at friend's away games. There are no batteries or electronics needed (excluding, optionally, an electronic clock) and the game can be played anywhere, anytime. Endless hours of completely unpredictable outcomes are achieved with On-The-Roll, just as with the real game of football, with gripping moments resulting from the confluence of play calling, the luck of the dice, and unexpected penalties.

Updates and enhancements to the game are available, including Beginner (Rookie) and Advanced (Pro) versions of the game, rules for wild card, division championships, college European and pro bowl games, etc. The On-The-Roll Football Game is highly educational about the game of football, and can help players of any level of experience develop insights into, and appreciation of, the strategy and tactics of the game. The book Official Playing Rules of the National Football League is recommended for use with this game as it will answer many questions that arise during play of the game, and is, optionally, supplied with the game.

Components of the Game: The standard edition of the preferred embodiment modeling a two-team professional American NFL football game comprises the following components:

- A board (101) representing a scale model of a standard football field with standard yardage markings and end-zones. The board further comprises:
  - racks or holders, at one end (102), optionally sunk into the end zone, to hold offense and defense penalty cards;
  - racks or holders, at the other end (103), optionally sunk into the end zone, to hold sack and out-of-bounds cards;
  - a rack or holder (104), along one sideline, for example, optionally slidable, to hold the offense and defense cards and dice for one team; and,
  - a rack or holder (105), along the other sideline, for example, optionally slidable, to hold the offense and defense cards and dice for the other team.
- Down Markers (301)(302), 10 yards long proportional to the filed dimensions with an adjustable down marker (306) for first, second, third and fourth downs attached to it, with a movable line-of-scrimmage indicator (307), for placement on the sidelines.
- Penalty Flags (304) and Coach Challenge Flags (305), generally flags on pins (or, for safety or manufacturing purposes, weighted markers) for placement on the sidelines.
- Each player preferably receives a pair (one offensive squad FIG. 5, one defensive squad FIG. 4) of 'string-of-players' tokens to indicate offensive and defensive teams.

Alternately, a single team token is supplied representing both offensive and defensive squads. Further a single scrimmage marker is, optionally, used during nose-to-nose play. Preferably, these each consist of an 11 man team arranged in a standard formation with a translucent base to facilitate seeing field positioning markings. Optionally, a lip in front and roll bar in the rear facilitate the coordinated movement of two team tokens (usually nose-to-nose, except during kickoff, for example) up and down the field. Additionally, team tokens are, optionally, marked with colors, names and logos of existing professional teams (under appropriate license) or fictional virtual teams. In practice, blank team tokens are supplied to which names, logos or color markers are attached (as by adhesive labels, or otherwise) by the game owner, or by the current players, on a permanent or temporary basis.

Each player receives (or, optionally, both share):

a pair of 'standard' (six-sided, labeled 1-6) play dice, preferably colored Red with X's in place of the customary pips, to indicate Defense (802).

a pair of 'standard' (six-sided, labeled 1-6) play dice, preferably colored Green with O's in place of the customary pips, to indicate Offense (801).

one six-sided die (803), marked 23, 28, 33, 38, 43, 48 (or optionally 18, 25, 30, 35, 40 & 45) preferably colored Green and larger than the play dice, for use during Punt and Field Goal Offense attempts.

one six-sided die (804), marked 23, 28, 33, 38, 43, 48 (or optionally 18, 25, 30, 35, 40 & 45) preferably colored Red and larger than the play dice, for use during Punt and Field Goal Defense.

one six-sided die (805), marked 40, 45, 50, 55, 60 & 65, preferably colored Red, and preferably the largest die, for use during Kick Off.

The figures on the last three dice were chosen by statistically compiling kick averages (long and short) of real NFL games over several seasons and then adjusting the numbers to work with the two play dice to achieve these averages. As the performances of real football players improve from year to year, the numbers on the various dice can be adjusted to more accurately simulate the state of real football play current at that particular time.

Each team/player receives or, optionally, both share, a set of cards designating offensive and defensive play options, which are used during play to implement play strategy, as well as some special cards.

Offense cards, examples of which are shown in FIG. 9, include:

a. PASS: CROSS PATTERN, CURL, POST, FLY (901), QUICK OUT b. RUN: SWEEP, PITCH, MISDIRECTION, TRAP (902), BLAST c. PLAY OPTION PASS, with alternative plays including Q.B. RUN, BOOTLEG and DRAW (904)

d. PLAY OPTION RUN, with alternative plays including BOMB, SCREEN PASS and SLANT e. WEST COAST OFFENSE (903)

f. HAILMARY g. QUARTERBACK SNEAK h. HURRY UP OFFENSE i. AUDIBLE, alternate offense formation strategy.

j. KNEEL DOWN PLAY (play is revealed after the roll and automatically takes 30 seconds off the play clock).

k. SPIKE THE BALL (play is revealed after the roll and immediately stops the clock as an incomplete play).

l. EXTRA POINT (play is declared).

m. TWO POINT CONVERSION (play is declared).

Offense Special Teams cards include:

a. PUNT (play is declared)

b. FAKE PUNT (play is declared)

c. FIELD GOAL (play is declared)

d. FAKE FIELD GOAL (play is declared)

e. ON SIDE KICK (play is declared)

Defense strategy cards include:

a. MAN TO MAN b. 8 MAN BOX c. ZONE COVERAGE (905)

d. ZONE BLITZ e. CHANGE UP DEFENSE f. NICKEL DEFENSE

Special cards include:

a. Timeout cards, generally 3 per team b. A Coaches Challenge card (906), used for all disagreements Other cards are supplied on a per-game, rather than per-term, basis and include:

Offense Penalty cards

Defense Penalty cards

Sack cards, obtained from different situations during the game and used to effect game momentum Out-of-Bounds cards, obtained from different situations during the game and used to affect game momentum Play Charts are provided, preferably, but not necessarily, for each team, that memorialize all (or most) Offense and Defense win results for all PASS and RUN plays. (See FIGS. 11A-11D.)

A Game Play Book, one per game or, preferably, one per team, which contains a host of charts designating the outcomes and procedures to be followed for many possible combinations of offensive and defensive plays; and, has rules and conditions for functions of the game designed for quick and easy reference.

Pads of Statistical Sheets, specially designed for quick notation of the games statistics for Offense, Defense and Special Teams.

Two clocks. One 'game clock' (701) times the hour game consisting of four 15 minute quarters controlled by the offense. The other 'play clock' (702) times the inter-play period, generally forty seconds controlled by the defense. Preferably the clocks will have easy start and stop mechanisms.

Figures 4, 5:
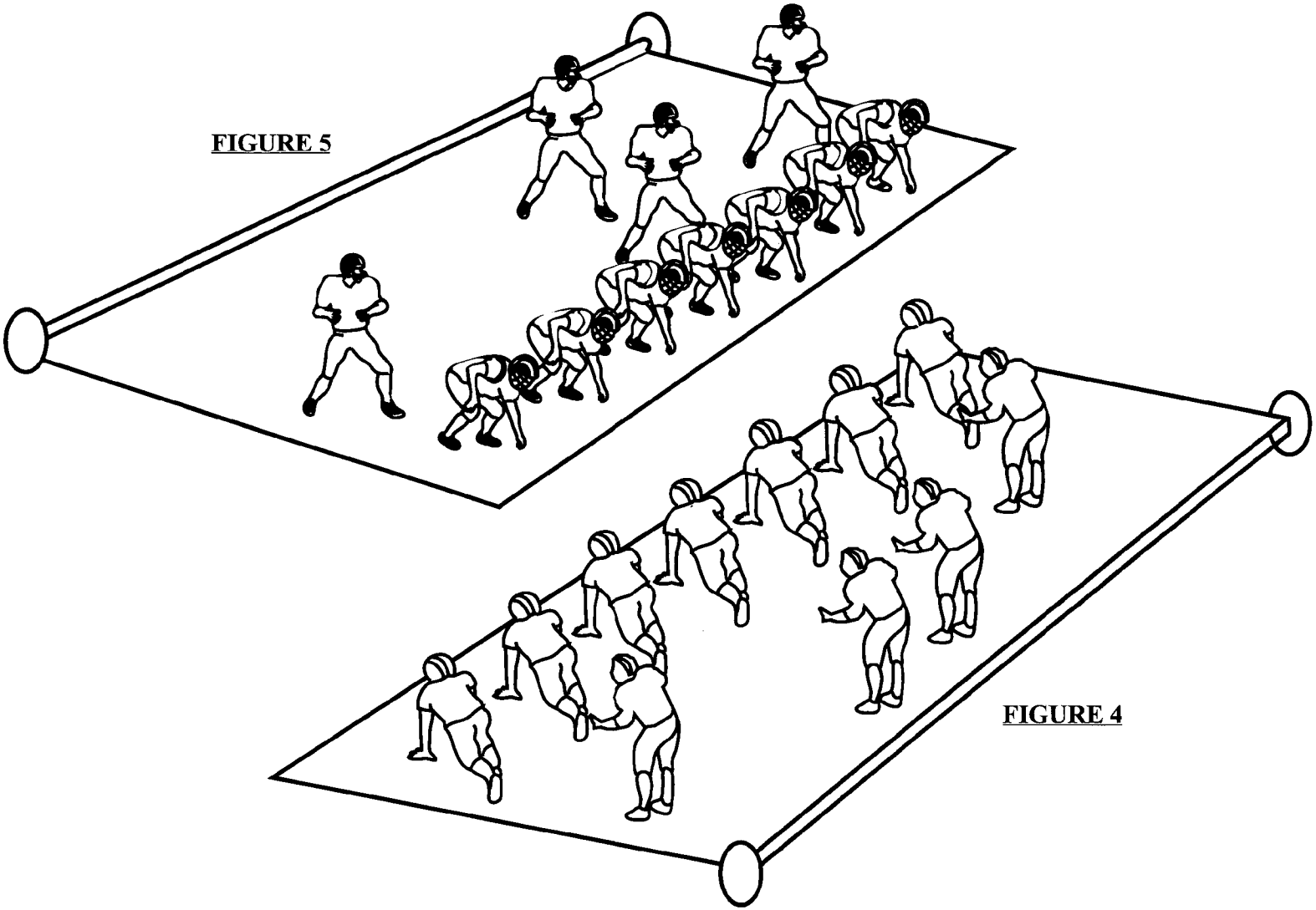
FIG. 4 depicts the OTR Football Defensive Team Marker with red figures (depicted with white Helmets)
FIG. 5 depicts the OTR Football Offensive Team Marker with green figures (depicted with black helmets)
Figure 6:
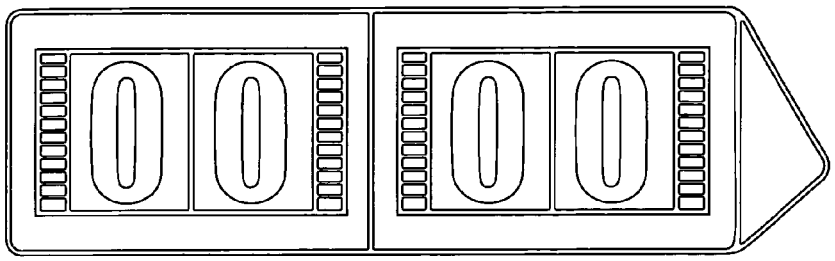
FIG. 6 depicts the OTR Football Score Wheel.
Figure 7:
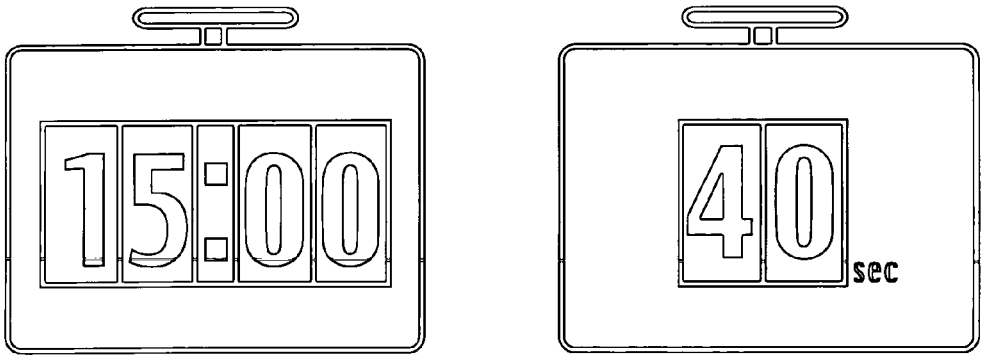
FIG. 7 depicts the OTR Football Game Clock (701) and OTR Football Play Clock (702)
Figure 8:
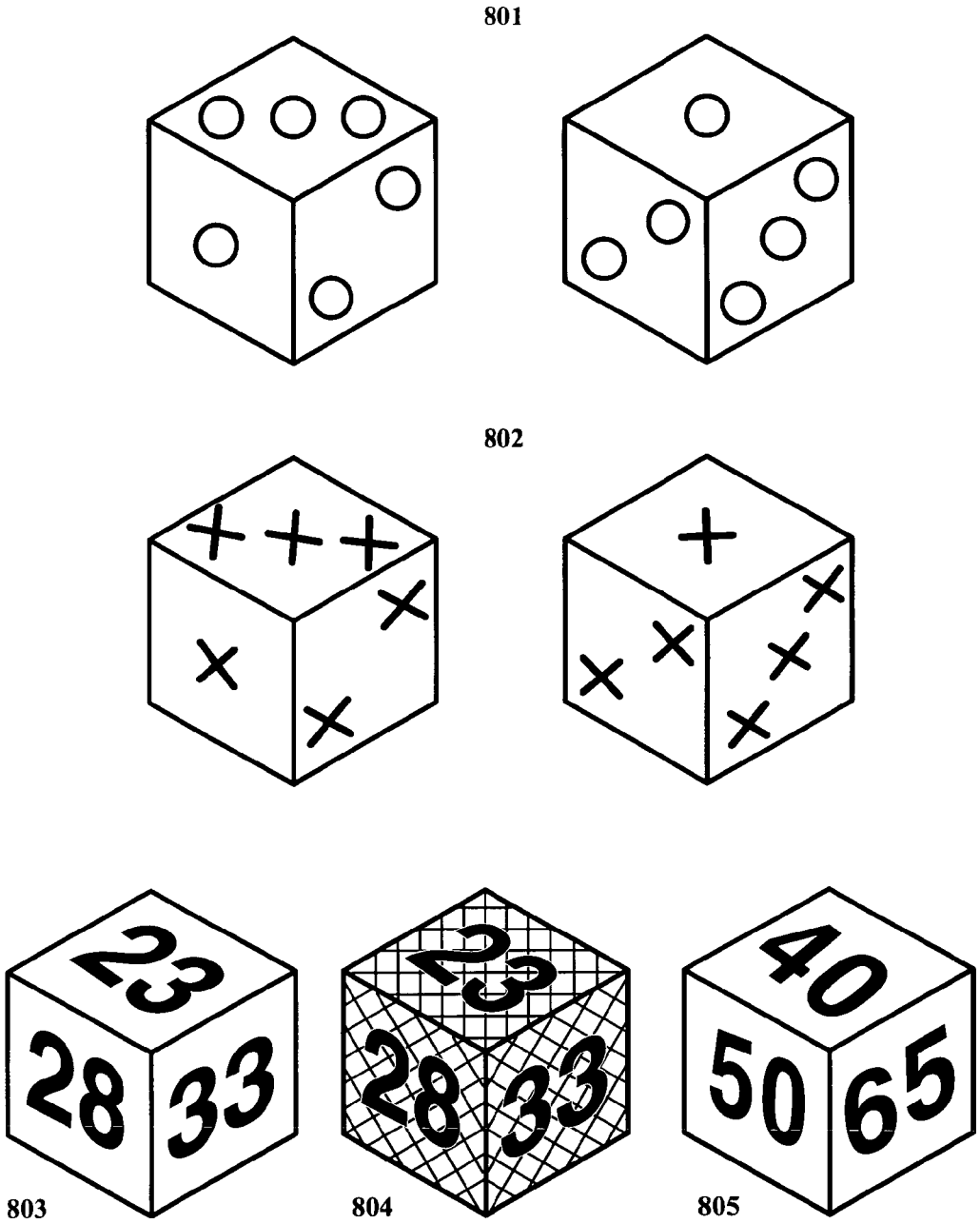
FIG. 8 depicts the Game Dice used by a Team During a Game Of OTR Football: Green Offensive Dice (801), Red Defensive Dice (802), Red Punt and Field Goal Die (803), Green Punt and Field Goal Die (804), Red Kick-Off Die (805)

During play the two team markers, FIGS. 4 and 5, are placed nose to nose (except during a kickoff) and move back and forth along the field as yardage is gained or lost during a play.

The 10 yard down marker (301) is placed to help determine when 10 yards or more have been gained and a new first down is achieved. This is used in conjunction with the hash marker (307) to indicate the loss or gain of each individual play during a four down series.

The cards in the end racks are held there until used in play.

On the side racks, each team places their dice; and, offensive, defensive and other special cards. Generally, due to space restrictions, either the offensive or defensive cards are spread out, with the other group stacked behind each other; which group of cards, depending upon whether the team is playing offense or defense at the time.

Definition of Terms: Regarding the standard edition of the preferred embodiment modeling a two-team professional American NFL Football game, the following of terms, phrases, and abbreviations, particularly when they appear in the charts and rule sheets included in the figures and disclosure, will, generally, be used herein with the meanings indicated in this section.

The color or word RED, indicates or is used to mean DEFENSE.

The color or word GREEN indicates or is used to men OFFENSE.

OFF is an abbreviation for Offense.

DEF is an abbreviation for Defense.

PT/FG die (or dice) is an abbreviation for the Punt and Field Goal die (or dice) where both functions are indicated on one die.

L.O.S. Line of scrimmage.

L.O.Y. Loss of yards.

P.A.T. Point after touchdown.

N.D.: Next Down, Play has ended.

Sum Of Roll is an abbreviation for Yards gained from initial roll of two dice.

Initial roll is an abbreviation for a player's first roll of a die or the dice.

T.P.E is an abbreviation for 'players keep rolling Till Play Ends'. In this embodiment: when the offense roll is greater than the defense roll, the offense gains the number of yards of their roll (or in some cases the difference between the offensive and defensive rolls or the higher or lower value of one of two dice rolled) and continues to roll 'till play ends, T.P.E. The play ends when the defense roll is greater than the offense roll, resulting in a 'tackle'.

Hi Value is an abbreviation for Higher Value of dice when each player is rolling one die.

Lo Value is an abbreviation for Lower Value of dice when each player is rolling one die.

Roll is defined as the action of throwing one or more dice and its result.

High Sum is an abbreviation for Higher Sum of the roll of multiple dice.

Lo Sum is an abbreviation for Lower Sum of the roll of multiple dice.

=Sums (or Equal Sums) is an abbreviation for a situation where both players roll an equal total, but where the individual dice numbers DO NOT match up; e.g., offense rolls 5 & 4, defense rolls 6 & 3.

Matched Sums is an abbreviation for a situation where both players roll an equal total, and where the individual dice numbers DO match up; e.g., offense rolls 5 & 4, defense rolls 5 & 4.

Difference Between OFF and DEF Roll is a situation where the offensive gain is the difference between the offense roll and the defense roll. This is used, for example, in an Offensive Pass play where Offense wins against a Nickel Defense. If, for example Offense rolls 5 & 4=9, and Defense rolls 3 & 2=5, then the Offense gains 9−5=4 yards. (Note: Defense was thinking PASS, but lost the roll. Proceed to Next Down.)

Diff-between is an abbreviation for Difference Between the values showing on two or more dice, for example as described above.

Game Clock: The On-The-Roll Football game timing is analogous to that of professional football and is an important element of the way that the On-The-Roll invention is applied to realistically simulate or schematize professional American football.

It is the function, and not the construction, of this clock that is important and, optionally, the clock is implemented: with a mechanical or electronic mechanism; as two separate clocks under manual synchronization, two inter-connected clock mechanisms, or a single integrated timing mechanism; with a sweep, digital and/or audible display; or, otherwise. Nevertheless, it is preferred that a single clock unit be provided that controls and displays both Game Clock (701) and Play Clock (702) functions in an integrated manner and is convenient to operate both to: switch from game time to play time during the inter-play period, and back again (also indicating an out of time penalty); and to stop the game time clock during called time-outs.

The 'clock' can also be provided as two separately controlled mechanisms. The Game Clock (701) keeps track of game time, generally measured in 15 minute quarters. The other Play Clock (702) is, nominally, set to 40 seconds, regulation time, but, optionally may be set for a different amount by default or agreed upon by the players. When a player stops the game clock the play clock is started immediately and will run (or run out) until the player starts the game clock again. The play clock automatically resets itself, for the next down or play, when the game clock is restarted.

It is essential that each team (player) must recognize and respect the elements of game timing, and recognize the benefits achieved thereby which result in the game having realistic and exciting momentum (i.e., being On-The-Roll). Therefore, timeouts are preferably exercised, with the options available to the requesting team, including:

a. Out of bounds card timeouts
b. Sack card timeouts
c. Team timeouts

The length of a timeout is on a negotiated basis between the teams/players of a particular instance or the game. Alternately, a chart of conditions and timeout lengths is, optionally, supplied to reduce the need for 'negotiation'. Further, clock resets are permitted, if time was lost or forgotten, on a negotiated basis between the teams/players.

Any time disputes that may arise which are difficult to settle warrant a condition and settlement by the rules of a Coaches Challenge Flag.

The Game Clock stops for:

- First down and field marker adjustments, unless there is more than one player per team, and only after the two minute warning.
- An incomplete pass.
- Penalties:
  - For an Offense penalty the Clock stops immediately.
  - For a Defense penalty the Clock stops after the play ends unless it occurs at the snap of a play.
  - A game penalty (e.g., involving the use of wrong dice, no cards, etc.) where the clock stops immediately to assess the penalty.
- Team called timeouts from any available source.
- Declared Fair Catch or Touchback.
- Change of possession.
- Turnover of downs, where Offense fails to get first down.
- Out of Bounds of any sort.
- Touchdowns.
- 2 Minute Warning.

Note that Offense controls the game clock and Defense controls first down and field markings and the 30 to 40 (as negotiated) second play clock. All other game operations are shared or assigned by prior agreement, or an optional set of published default assignments.

Structure of Play

On The Roll simulates the tension and excitement of a real game of Football—a game of strategy with completely unpredictable circumstances using play selection, field position, possession control and clock management. In general, the contents of the play chart outcomes and play rules are actual transcribed events that have been statistically compiled over several seasons.

The main action of the On-The-Roll Football game is organized into a series of Plays, generally analogous to plays or downs in NFL Football. Further, as with NFL Football, On-The-Roll Football is an Offense-driven game.

The object of the game is for the Offense to make their way across the field to the end zone for a touchdown, using clock management. The Defense attempts to stop the Offense, thereby giving them an opportunity to take possession of the ball. At the end of the game, the team that scores the greatest number of points during the entire game is the winner.

Points are scored as follows:

Touchdown=6 points

Extra Point (after touchdown only P.A.T.)=1 point

Field Goal=3 points

Safety=2 points

2 Point Conversion (after touchdown only)=2 points

The overall timing guidelines adhere to standard NFL rules. The timing elements of On-The-Roll are negotiable between the players; however, in general, by default:

Game time is 60 minutes, consisting of 4 quarters of 15 minutes each.

Negotiated timeouts between the first & second and third & fourth quarters.

Half time break is 15 minutes, or as deemed appropriate by the players.

Team time-outs are available, 3 time-outs per team per half.

Over-time is implemented as a 15 minute quarter of sudden death (the first team to score any points wins) with 2 team timeouts. If neither team scores, a draw is (generally) called. At the option of the players, alternate conditional rules can be used to break ties to simulate college and European football play or modified rules for professional NFL updated changes.

As stated, the basic unit of On-The-Roll Football is the 'Play' and the game is Offense-driven. Plays are of several types:

KICKOFF—used to open the game, or after scoring.

RUN—one of five 'standard' offensive run plays, selected by placing a card face down, with defense placing a card face down as well.

PASS—one of five 'standard' offensive pass plays, selected by placing a card face down, with defense placing a card face down as well.

OTHER UNDECLARED OFFENSES—selected by placing a card face down, with defense placing a card face down as well.

DECLARED OFFENSES—selected verbally, and by placing a card face up, and with defense not choosing a particular defense strategy card.

DECLARED SPECIAL TEAM OFFENSES—selected verbally, and by placing a double-sided card with one or the other side face up dependent upon the roll outcome and post decision making, and with defense not choosing a particular defense strategy card.

The Kickoff Play: The kickoff is a special circumstance that occurs at the start of the game, or after a score by one team. Each team rolls one die to determine who wins the toss.

The receiving team (going for a touchdown) and the Kicking team (trying to prevent the touchdown) place their respective strings of players (the team markers) on the field in position for the starting kick-off.

The kicking team is positioned at the 30 yard line, although, other default positions are, optionally, used and are within the scope of the instant invention. The receiving team places their string of players where they think the kick distance will be. Then, simultaneously, the kick team player (or designated player of a team of players) rolls the kick die and two (nominally red defensive) play dice, while the receiving team rolls just the two (nominally green offensive) play dice. At that point, the kicking team's marker is moved to be nose to nose with the receiving team's marker at the kick distance and the clock is started.

The receiving team then returns the kick-off by moving their marker from its initial position (the kick distance) to a new position, determined by the sum of the receiving team's initial roll, and moving that number of yards towards the receiving team's goal. The kicking team's marker is moved to be nose-to-nose with receiving term's marker at that position.

Then the On-The-Roll inventive mechanism is employed. With the clock still running, each team repeatedly rolls two play dice, nominally red/defense for the kicking team and green/offense for the receiving team. These rolls continue so long as the receiving team rolls a number higher than the kicking team; and, the team markers are moved toward the kicking team's goal by a number of yard markings equal to the roll of the receiving team. If the receiving team rolls enough 'rushes' to move the markers into the kicking team's end-zone a 'touchdown' has occurred and play ends; if, on a particular roll, the kicking team rolls higher than the receiving team a 'tackle' has occurred and play also ends. At either 'play end' condition, the game clock is stopped by the offense. The defense then starts the play clock to start. The play clock is nominally set to Count down from 40 seconds—the NFL standard—but any amount of time, negotiated and agreed to by the players, can be used.

The play clock begins at the end of a given play till the snap of the ball (the initial roll of the dice) for the next play. If the offense does not snap the ball before the play clock reaches zero, there is a 5 yard penalty to the Offense for 'delay of game'.

A 'Bonus' condition on Kick-Off exists, if the receiving team is positioned at the exact kick distance, as measured from the kicking team's 30 yard line. In this case, the receiving team may roll two dice for every 10 yards (or portion thereof) to the opponent's end zone, before the kicking team can roll to defend. If the receiving team has not achieved a touchdown, the receiving team, now the Offense, chooses a play for their first down and the kicking team, now the Defense, chooses a defense strategy play. See the Kick-Off Rule Chart, FIG. 12R, for additional details. See also FIG. 12E regarding Punts for a similar free rolls condition.

Figure 16:
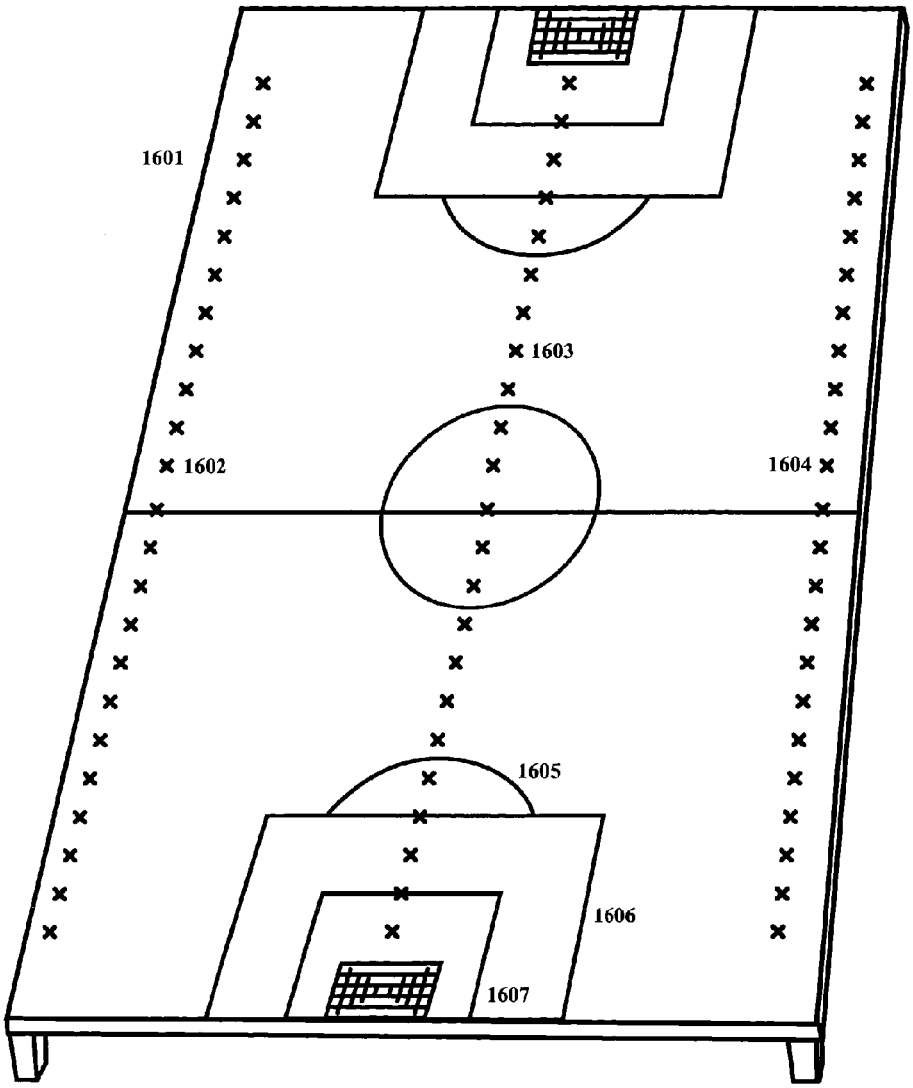
FIG. 16 depicts an OTR Soccer game board.
Figure 17:
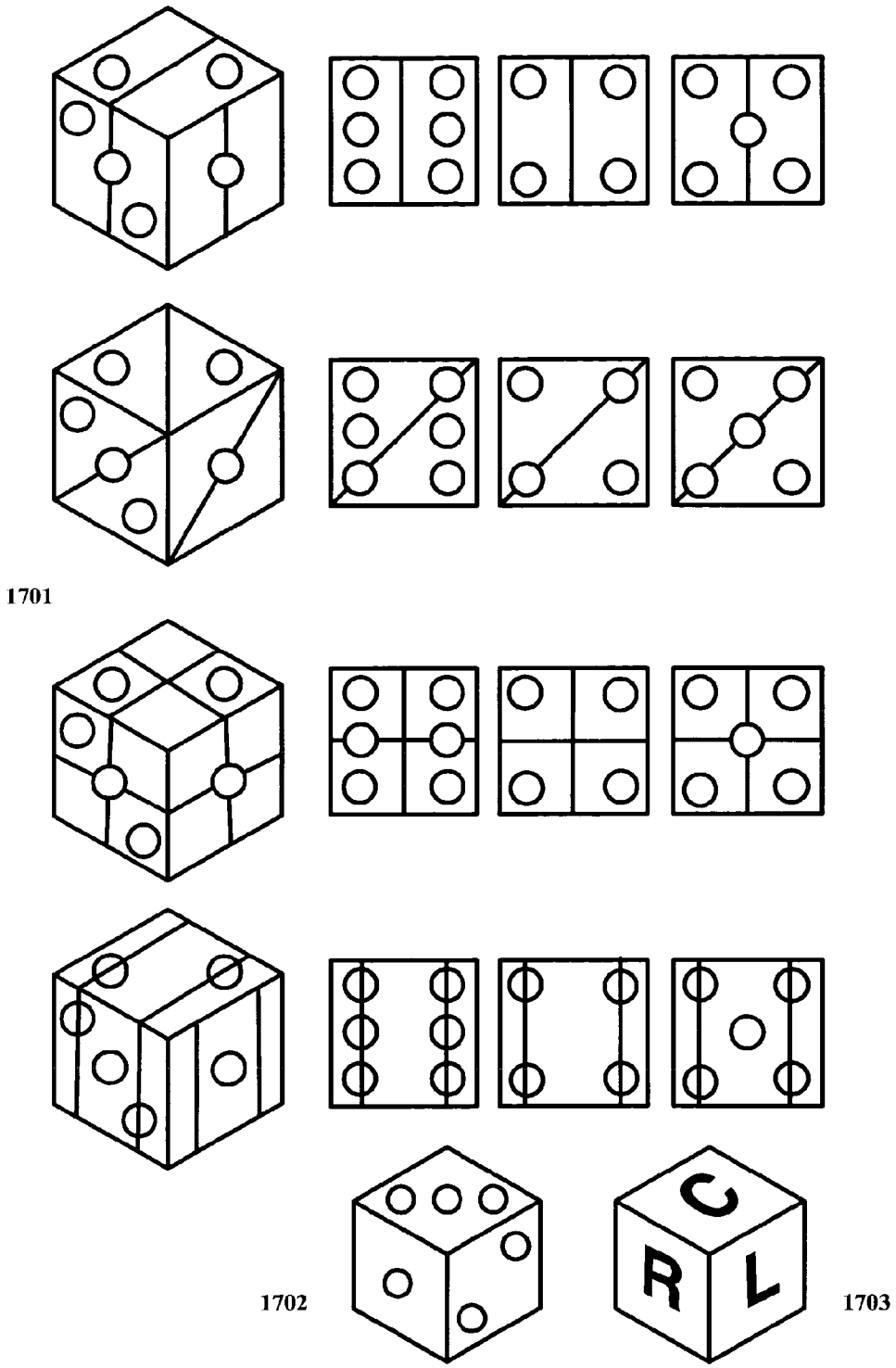
FIG. 17 depicts Dice Used for Multiple Teammates such as for OTR Soccer.
Figure 22:
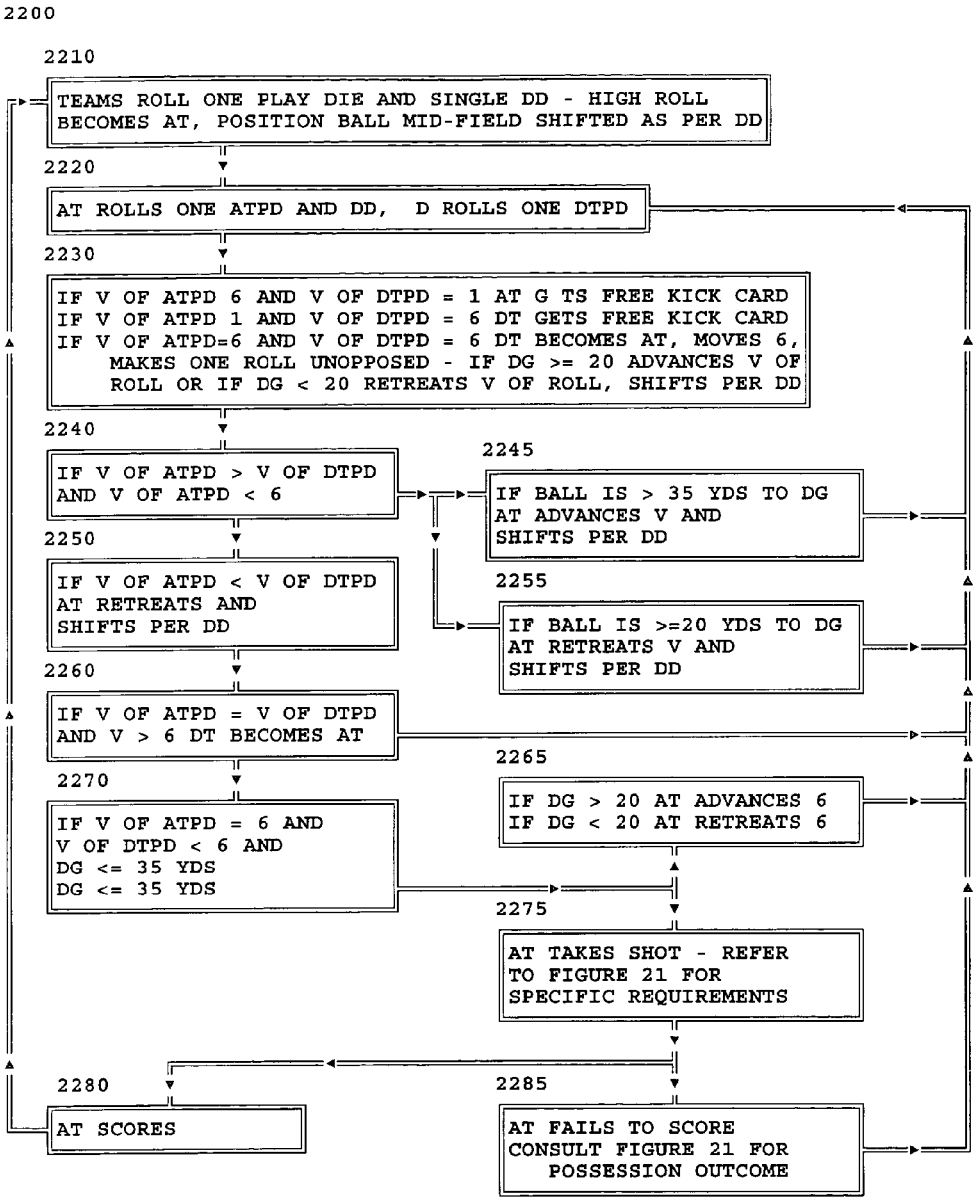
FIG. 22 depicts System of Play Diagram for OTR Soccer.
Figure 25:
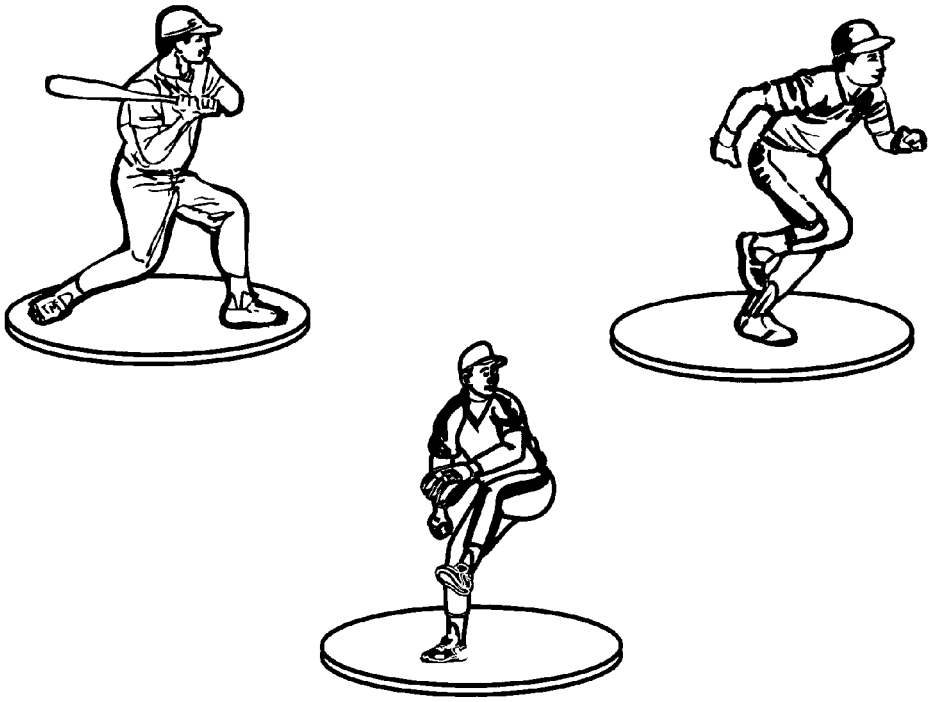
FIG. 25 depicts OTR Baseball Player Markers.
Figure 26:
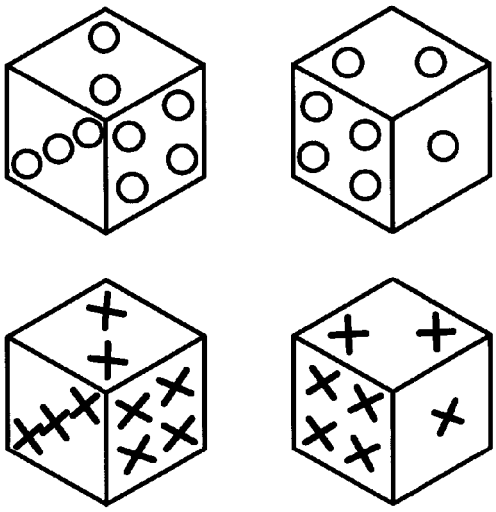
FIG. 26 depicts OTR Baseball Dice.

Additional Kick-Off rules are enumerated in the play book for Double Sixes conditions (See FIG. 16G) which include: Bonus rolls for offense sixes on the initial roll, Fumble, Safety, and Tackled at Spot of Kick no Return. If a play chart does not have any conditions for sixes present on a play, then the players would refer to the sixes rule chart.

First Down at the Line of Scrimmage: Each team, anticipating the opposing team's play, selects their play, placing their play cards face down. Offense starts the game clock and each team, simultaneously, rolls two play dice, Red for Defense and Green for Offense. After the roll of the dice they flip their cards face up, at the same time, to reveal their plays and then review the play charts, if that play has a chart outcome (not all combinations do). Each team repositions their string of players on the field, based on the outcome dictated by the appropriate chart entry. They then proceed with the On-The-Roll mechanism, and continue to roll two dice each for additional yards (if eligible) till the Defense beats the Offenses roll. If there is a Run play or completed Pass play, the game clock continues to run into the next play selection. If an incomplete Pass play was executed or a penalty assessed, then the game clock stops. If the players are using the clocks with coordinated mechanisms, stopping the Game clock will trigger the nominally 40 second Play clock. Otherwise, the offense will stop the Game clock and the defense will start the Play clock.

Second, Third and Fourth Downs at the Line of Scrimmage: The Offense proceeds with its Offensive drive across the field for a touchdown through a second, third and fourth non-kick-off play or 'down'. So long as at least 10 yards are gained by the offense by the end of the fourth down, a first down condition is obtained.

The Offense has 11 regular play cards (Fly, Post, Curl, Cross Pattern, Quick Out, Sweep, Trap, Pitch, Blast, Misdirection and West Coast Offense) and 2 play option cards (Play Option Run and Play Option Pass) (with 3 alternate play selections available if the option is exercised) and an audible play or hurry-up offense strategy in which to obtain a first down.

The Defense has 6 play cards matched up to the Offense play cards in which to defend against the attempted touchdown. For each offensive play there is an optimal defensive play such that even if the defense loses the roll, the offensive will only gain either the sum of their roll, next down, the higher or lower value of one or two dice rolled, next down, or the difference in the dice rolls, next down.

If the Offense does not make a first down in three plays, the Offense, on the fourth down, may attempt to go for the first down by running or passing, therefore running the risk of turning their possession over to the Defense if they do not make a first down. Alternately, the Offense may choose to Kick. If close to the opponent's end zone, a Field Goal or Fake Field Goal is generally used; if far from the opponent's end zone, a Punt or Fake Punt is generally used. In this circumstance the game clock would only stop after a successful Field Goal attempt and after a punt for change of possession.

Change of Possession: The Offense must turn over possession to the Defense if: a first down is not made; on an interception, punt, or safety; after a field goal; or, after a touchdown. In the event of a fumble—either by chart indication or by the Defense rolling Double Sixes—both teams roll one play die to determine possession (in one of the few exceptions to the rule, if a tie is rolled, each team continues to roll simulating the scramble for the football characteristic of fumbles). Once possession is determined, the players then roll two play dice for yards on most pass plays and one die for yards on most run plays unless otherwise stated in a chart directive. Yardage rolls continue (i.e., On-The-Roll) until the current Defense beats the Offense's roll.

If an interception has taken place—either by chart indication or by the Defense rolling Double Sixes, the Defense takes possession at the distance of the offensive roll unless otherwise stated in a chart directive. Then each team rolls two play dice till the current Defense beats the Offenses roll. Note that on a Run play, the presence of Defensive double sixes constitutes a Fumble at the current line of scrimmage; and, on a Pass play the presence of Defensive double sixes constitutes an Interception of the at distance of the offensive roll. Both these conditions are eligible for return or continuing yards till the play ends, or for immediate possession at the line of scrimmage, if there is no return.

General Rules of Play: The On-The-Roll Football Game Play Book contains many charts comprising the procedures, rules and regulations of the game. Examples of the most commonly used elements are shown in FIGS. 9-14. These charts are consulted to obtain the details for a particular play.

Some of the following rules correspond to official NFL game play rules, others have been modified to enhance play for this particular game.

To see which team will receive the kick-off at the beginning of the game—the 'Coin Toss'—each team rolls one play die, with the winner electing to kick or receive. If both players roll the same total they must continue to roll until one team wins the roll.

At the end of a quarter, players exchange end zones. This is an official NFL rule.

All dice rolls must be flat. Any leaning dice are not valid and all dice rolling must take place within the boundaries of the field board. If, while rolling, any of the dice leaves the field of play at any time during the game (even if it falls back onto the field of play) the other team places a penalty flag on the field. If the penalty situation occurs at the snap, where the play cards have not yet been revealed, a 5 yards OFFSIDES Penalty is immediately assessed for either Offense or Defense, as appropriate. (If both players mis-roll, there are offsetting penalties.) During the play, Offense or Defense cards are drawn from the appropriate deck of penalty cards: immediately for the Offense at the current line of scrimmage; and, for the Defense at the end of the play. The cards also reveal an official referee's down directive, which allows the players to know if the down remains the same or if it is the next down after a penalty has been assessed. They are:

Ball behind the line of scrimmage, the down remains the same.

Ball beyond the line of scrimmage, next down.

The second penalty mechanism also applies for any other function which is out of time with the normal game flow such as:

a. Failing to pick up one's last play card before one's next play.
b. Rolling the Offense dice if you are on Defense or vice a versa.
c. Using the wrong play card for your position.
d. Rolling the dice without a play card.
e. Rolling the dice while the Offense is rolling on an extra roll from rolling Doubles.
f. Using a Play Option twice without an intervening 1st down.
g. Optionally, any other exception conditions.

Team markers are repositioned on the field, based on the outcomes of the initial play roll before continuing to roll for additional yardage. The exception is when using The Hurry Up Offense.

At any time during the game, any disagreements involving any situations relevant to the game must be resolved by using a 'Coach Challenge Flag' (305) where the challenging team places the flag on the field. Then, each team rolls one play die and the higher roll wins the debate.

All penalties are Official NFL infractions.

The Offense controls the pace of the game, therefore the Defense must be ready when the Offense is within a reasonable amount of time, i.e., within a short time after the Offense is ready. If the Offense feels the Defense is delaying the game they can use a Coach Challenge to try and enforce a 5 yard Delay of Game Penalty. This is done with the Coach Challenge Flag (305).

A Safety is automatic when: any loss of yards puts the Offense on or past the goal line. A Safety is also automatic on a kickoff or punt when the Receiving team is in their end zone, the Kicking team rolls double sixes creating a fumble, and the Receiving team does not gain possession.

A tie when rolling dice generally goes to the Defense, except where otherwise indicated in a particular play rule chart. Several exceptions are: 1. when rolling for possession after a fumble; 2. the ball is tipped at the line of scrimmage and the players roll for possession; and 3. when using the West Coast Offense where the quarterback runs up the middle for yards until the play ends.

Rolling Double Sixes by the Defense, at any time during the game, causes an automatic loss of possession, representing either a Fumble (on a Run Play) or Interception (on a Pass Play). Some of the exceptions are 1. Where the Offense also rolls double sixes (for a Pass: the ball is dropped by the defender, and, for a Run: the Ball goes out of bounds); 2. The offense rolls double ones (the play is out of bounds, next down); and, 3. Sixes are rolled on an "At Snap" play or penalty pending play depending on the type of infraction and ruling.

All Timeouts must be within a reasonable amount of time deemed fair between the players. This can be done as a matter of courtesy, a pre-determined time can be established by the players or a standard can be set, particularly for league play.

Fumbles and Interceptions can be advanced, once possession is gained, unless otherwise stated in the appropriate play charts or play book.

Any function of the game that has not been exercised at its appropriate time in the game cannot be reversed.

Any combination of dice can be rolled by either team any time during the game, unless otherwise stated in the rules. For example, during a punt the Offensive team has the option to roll any combination of dice in an attempt to not kick the ball into the end zone. This will depend largely on the field position at the time of the kick. In a second example, if the Defense mistakenly rolls one die when they would be permitted to roll two under the rules, the play stands and the Offense may capitalize on that mistake.

With regard to Turnovers and dice, players may continue to use the dice in their possession until the play ends. There is no penalty. Then they must switch to either the Offense or Defense dice and optional offensive or defensive string of plays, depending on the position being played at that time.

All plays start from the line of scrimmage.

Out of Bounds Cards are received at any point during the game and under all circumstances whenever a player rolls double ones. Additional rules regarding out of bounds cards are contained in an Out of Bounds Card Use Chart.

Any penalties, extra points or other game functions, which are not exercised at the appropriate time during the game, cannot subsequently be utilized at any other point in the game.

A Two Point Conversion is effected by each player rolling two dice with the best out of three rolls determining the winner.

An extra point can only be prevented by the Defense rolling doubles of any value.

Penalties can be declined by the team in control of the ball. Penalties can be assessed for infractions that take place during Active play or at the Snap.

A kicking team that rolls doubles is not permitted an extra roll.

If the Offense rolls doubles during a play, the Offense is permitted an extra roll without defensive opposition before the Defense is permitted to defend again. This rule continues with the Offense continuing to be able to roll without opposition until the Offense fails to roll doubles. Some chart outcome directions will take away the extra roll from rolling doubles, and others will earn the team an extra roll as a result of the play in addition to the extra roll earned by rolling doubles.

If the Offense puts down a play and the Defense takes too much time to put a card down, forcing the Offense to wait on their clock time, the Offense being ready will roll the dice (snap the ball to begin the play) and the Defense will experience an automatic "5-yard Delay of Game" penalty.

After a touchdown, the players should be lenient regarding the length of the time out, bearing in mind that the average post-touchdown time outs in real football are approximately five to nine minutes.

In the event that the line of scrimmage coincides with the goal line, play is considered to be in the end-zone.

In the event that both teams roll doubles, the Offensive team is not awarded an extra roll. The dice default to the high/low values on the dice.

The PLAY—The Basic Unit of Game Structure: As stated, the basic unit of On-The-Roll Football is the 'Play' and the game is Offense-driven. Plays are of several types:

KICKOFF—used to open the game, or after scoring.

RUN—five 'standard' offense run play types, selected by placing a card face down, with defense placing a card face down as well.

PASS—five 'standard' offense pass play types, selected by placing a card face down, with defense placing a card face down as well.

OTHER UNDECLARED OFFENSES—selected by placing a card face down, with defense placing a card face down as well. These include:

1. Play Option Pass, where the three options (alternative plays) are: Bomb, Screen Pass and Slant (Defense has already been revealed when option is chosen)
2. Play Option Run, where the three options are: Q.B. Run, Bootleg and Draw (defense has already been revealed when option is chosen)
3. West Coast Offense (play is revealed after the roll)
4. Kneel Down Play (play is revealed after the roll)
5. Spike the Ball (play is revealed after the roll)
6. Hail Mary (play is revealed after the roll)
7. QB Sneak (play is revealed after the roll)
8. Audible Play (play is revealed after the roll)

DECLARED OFFENSES—selected verbally, and by placing a card face up, and with defense not choosing a particular defense strategy card. These include:

9. Hurry Up Offense (The defense selects one of two defenses also declared during this play)
10. Extra Point (declared)
11. Two Point Conversion DECLARED SPECIAL TEAM OFFENSES—selected verbally, and by placing a double-sided card with one or the other side face up, and with defense not choosing a particular defense strategy card. These include the double-sided cards:

12a. Punt (this play is declared)
12b. Fake Punt (this play is declared)
13a. Field Goal (this play is declared)
13b. Fake Field Goal (this play is declared)
14. On Side Kick (this play is declared)

The KICKOFF Play: The kickoff is a special circumstance that occurs at the start of the game, or after a score by one team. It has been described, above, in detail. No card is necessary.

The RUN and PASS Plays: The 'usual' offensive choice is to opt for:

type of Run—if close to a first down on the third down, for example; or), type of Pass—if more yardage is desired, as when trying to get in range for a touchdown, from considerable distance, on an early down, for example.

Of the six Defensive strategy patterns, some are geared to best respond to a Run Offense (8 Man Box & Zone Defense), and others are geared to best respond to a Pass Offense. (Nickel Defense & Man to Man). The Zone Blitz can work well with any play and the Change-up is best for the Play Option, although it is equally effective for the Audible offense or otherwise has traits of the zone coverage.

The basic strategy, then, is for the Offense to pick its best strategy, and for Defense to try to anticipate that and select the best defensive strategy.

For example, if Offense plays a type of PASS and Defense selects a Nickel Defense this is an appropriate defense against the pass but, due to the dice roll, is not guaranteed to win for Defense; but, it will tend to minimize damage in the event of a loss, because Offense only gets the difference between the two rolls in yardage, and play ends (i.e., the On-The-Roll mechanism is terminated). And, if the Defense wins the roll with the optimal defensive play, the outcome is highly desirable for the Defense and damaging for the Offense, in many cases affording the Defense the advantage of obtaining the highly desirable Sack cards and/or creating a Fumble or Interception on the play by chart directive.

On the other hand, for example, if Offense plays a type of PASS and Defense selects a 8 Man Box Defense (which is more appropriate to defend against an Offensive's type of RUN) in the event that Defense loses the roll, Offense gets its entire roll in yardage, and gets to continue to play On-The-Roll until Defense gets a roll equal to, or higher than, Offense. Ties generally go to the Defense here, except for the West Coast Offense, and some other PASS and RUN plays where a second chance for the offense to beat the defense roll is part of a play design or in the instance of a best of rolling series. The only roll that most consistently presents a tie is matched sums.

In all of cases the PASS and RUN outcomes can be determined from four well-organized charts. The four charts correspond to:

Offensive PASS and Offense Wins Roll, see FIG. 11A;

Offensive RUN and Offense Wins Roll, see FIG. 11C;

Offensive PASS and Defense Wins Roll, see FIG. 11B; and,

Offensive RUN and Defense Wins Roll, see FIG. 11D.

All combinations of dice rolls Defense options are enumerated in these charts.

Other Undeclared Offenses: In addition to the five PASS plays and five RUN plays, there are other Offense selections which are chosen by placing a card face down, with defense placing a card face down as well. Two of these: the Play Option Pass (with options of Q.B. Run, Bootleg and Draw) and Play Option Run (with options of Bomb, Screen Pass and Slant), provide three Offense options each and several conditions that customarily arise when using the Play option plays. Which of the three options occurs is determined as follows: both Offense and Defense place their cards face down; the dice are rolled; the cards are turned over; and, if Offense wins the roll, the Offense must proceed with its original pass or run play which by design will produce minimal gains and no until play ends (TPE) conditions. If Offense loses the roll and the Defense does not have the change-up, then the offense may select from the three option plays. If the offense loses the roll and the defense does have the change-up, each team most roll under the conditions of the change-up defense rules See FIG. 12 for examples of charts providing additional details.

The other single-sided Offense option cards that are played face down are: West Coast Offense, The Audible, Kneel Down Play, Spike the Ball, QB Sneak, and Hail Mary. for additional details.

Declared Offense Cards: Rather than playing these cards face down, in secret, these cards are 'declared' verbally, and placed face up. In these cases, the Defense's choice of a particular defense strategy card does not affect play. These include the On Side Kick, Extra Point and Two Point Conversion.

Declared Special Team Offenses: These cards are announced verbally, and placed face up. And, again, defense does not choose a particular defense strategy card. These include the on side kick, double sided cards Punt/Fake Punt and Field Goal/Fake Field Goal. The difference is that here, the two sides are related, and which one applies is determined by Offense choice in the event that Offense has rolled doubles (i.e., the same number of pips on both play dice). See FIGS. 12D and 12E for additional details.

Special Cards: In addition to Offense and Defense Play Cards are several types of special cards.

Offense Penalty Cards and Defense Penalty Cards are handed out under appropriate conditions, as described elsewhere, and move the line of scrimmage in favor of the non-penalized team.

Out-of-Bounds Cards are obtained by rolling double ones any time during the game and can be used at any time in the quarter they were received. They are used to stop the game clock during play or end a play and are used both offensively and defensively.

Sack Cards are earned by the Defense during play, as described elsewhere. They represent conditions Such as: Official Time Out, Fumble Ruled Out of Bounds, and other highly desirable conditions that may be used to change the momentum of the game. They can be used at any time during the game, except for the Time Out Card, which can only be used after the three Team Time Out Cards have been exhausted.

Rookie Football Preferred Embodiment

A variation on the primary On-The-Roll Football preferred embodiment is a simplified version of the game for Rookie players. This version introduces key concepts, and permits players to familiarize themselves with the basic structure of On-The-Roll Football without becoming mired down in an unfamiliar maze of details that are the key to making On-The-Roll Football as exciting and realistic as it is.

In particular, in the Rookie version use of the play clock is optional; the number of plays available is reduced; the double sixes rule is always in effect and the 6/1 rule has been eliminated. The reduced number of plays is reflected in the play chart for Run and Pass which have fewer variations to address.

Alternate Embodiment of Football Board Game

FIGS. 52-65 show an alternate embodiment of a football board game 5000, which is substantially the same as the football board game shown in FIGS. 1-15, except that the football board game 5000 has alternate opposing combination football team tokens and football team markers 5002 and 5004.

The football board game 5000 may optionally be of knock-down construction for ease of assembly, low cost, and/or portability. The football board game 5000 may also optionally have computerized tablets 5006, which are adapted to facilitate play and to provide additional information that may be useful to individuals or players playing the football board game 5000.

The computerized tablets 5006 may be computer client devices, such as tablets, personal computers, laptops, cell phones, client devices, client devices communicating with one another, stand alone client devices, wireless or wired client devices connected to the internet or other suitable network or networks, or combination thereof, or other suitable computerized tablets adapted to facilitate play and provide additional information to individuals or players playing the football board game 5000.

The football board game 5000, comprises:

a game board 5020 depicting a traditional football field 5022 comprising field markings 5024, the field markings 5024 comprising opposing sidelines 5026, opposing goal lines 5028, opposing end zones 5030, opposing end lines 5032, a plurality of substantially parallel yard lines 5034 that cross the depicted traditional football field 5022 between the opposing sidelines 5026, and a plurality of hash marks 5036;

opposing combination football team tokens and football team markers 5002 and 5004, the opposing combination football team tokens and football team markers 5002 and 5004 each comprising opposing football team tokens 5042 removably mounted on opposing football team markers 5044, the opposing football team tokens 5042 representing traditional opposing football teams and traditional team formations 5046, the opposing football team tokens 5042 comprising offensive football team tokens 5048 and defensive football team tokens 5050, the traditional team formations 5046 selected by each of the players from a plurality of traditional offense team formations and a plurality of traditional defense team formations, the opposing football team markers 5044 comprising an offensive football team marker 5060 and a defensive football team marker 5062, the offensive football team tokens 5048 removably mounted on the offensive football team marker 5060, the defensive football team tokens 5050 removably mounted on the defensive football team marker 5062, the offensive football team marker 5060 and the defensive football team marker 5062 each opposing one another, the offensive football team marker 5060 and the defensive football team marker 5062 each comprising a substantially translucent base 5064 straddling the game board 5020 between the opposing sidelines 5026, the substantially translucent base 5064 adapted to facilitate viewing the field markings, the offensive football team marker 5060 and the defensive football team marker 5062 each comprising a front lip 5066 and a rear roll bar 5068, the front lip 5066 and the rear roll bar 5068 of the offensive football team marker 5060 and the defensive football team marker 5062 each adapted to facilitate movement of the offensive football team marker 5060, the front lip 5066 of the offensive football team marker 5060 and the front lip 5066 of the defensive football team marker 5062 facing one another, the rear roll bar 5068 of the offensive football team marker 5060 and the rear roll bar 5068 of the defensive football team marker 5062 each facing a different one of the opposing goal lines 5028, the rear roll bar 5068 of the offensive football team marker 5060 and the defensive football team marker 5062 each comprising opposing rollers or wheels 5070 adapted to facilitate rolling or sliding movement on the traditional football field 5022, the rear roll bar 5068 of the offensive football team marker 5060 and the defensive football team marker 5062 each comprising an axle 5072, the opposing rollers or wheels 5070 rotatably mounted on the axle 5072, the offensive football team marker 5060 comprising a measuring wheel 5080 or other like device adapted to measure distance bidirectionally along the traditional football field 5022, the measuring wheel 5080 comprising a bidirectional yardage indicator 5082 adapted to indicate net distance travelled by the offensive football team marker 5060 as the offensive football team marker 5060 travels up and down the traditional football field 5022, the offensive football team marker 5060 further comprising a sliding scrimmage marker 5084 adapted to indicate a line of scrimmage along the traditional football field 5022, the offensive football team marker 5060 further comprising an adjustable down marker 6012 adapted to indicate one of four possible downs;

sets of specially marked opposing team dice 5090, the sets of specially marked opposing team dice 5090 comprising a set of offensive team dice 5092 and a set of defensive team dice 5094, the offensive team dice 5092 and the defensive team dice 5094 each having indicia 5096 and 5098, respectively, that distinguish the offensive team dice 5092 from the defensive team dice 5094 and vice versa, and that signify numerals one through six, a pair of combination punt and field goal dice 6002 having other indicia 6004 that signify other numerals in increments of five, kick off dice 6006 having yet other indicia 6008 that signify yet other numerals in increments of five;

a game clock 6020 adapted to indicate quarter time during each quarter and limit duration of the each quarter, the game clock 6020 limiting duration of the each quarter and duration of total game play;

a play clock 6030 adapted to indicate play time during each game play of a plurality of game plays and limit duration of each play selection period of a plurality of play selection periods, the play clock 6030 limiting duration of the each play selection period of the plurality of play selection periods for rolling the sets of specially marked opposing team dice 5090, the play clock 6030 synchronized with the game clock 6020, the game clock 6020 stopping the play clock 6030 at the end of the each quarter;

a plurality of game play strategy cards 6040 comprising a plurality of offensive strategy play cards 6042, a plurality of defensive strategy play cards 6044, and a plurality of special teams strategy play cards 6046, the plurality of offensive strategy play cards 6042 comprising a plurality of offensive game play strategy play types, each having a different offensive play comprising a different offensive play move, the plurality of defensive strategy play cards 6044 comprising a plurality of defensive game play strategy play types, each having a different defensive play comprising a different defensive play move, the plurality of special teams strategy play cards 6046 comprising a plurality of special teams strategy play types, each having a different special teams play comprising a different special teams play move;

a plurality of game play strategy look up tables 6050 comprising a plurality of offensive strategy look up tables 6052, a plurality of defensive strategy look up tables 6054, and a plurality of special teams strategy look up tables 6056, the plurality of offensive strategy look up tables 6052 comprising additional offensive plays, each of the additional offensive plays comprising additional offensive play moves, the plurality of defensive strategy look up tables 6054 comprising additional defensive plays, each of the additional defensive plays comprising additional defensive play moves, the plurality of special teams strategy look up tables 6056 comprising additional special teams plays, each of the additional special teams plays comprising additional special teams play moves;

movement and yardage of the opposing football team tokens 5042 during the each game play of the plurality of game plays during the each quarter determined:

first by score of one of the kick off dice 6006 and then by 1) score of the sets of specially marked opposing team dice 5090, which determines a game play winner and 2) a planned game play and planned movement selected by the game play winner, prior to rolling the sets of specially marked opposing team dice 5090, which determines movement of the opposing football team tokens 5042 removably mounted on the opposing football team markers 5044 and which determines game play outcome of the each game play of the plurality of game plays, the planned game play and the planned movement selected by the game play winner, prior to rolling the sets of specially marked opposing team dice 5090, the planned game play and the planned movement selected from a game play strategy card of the plurality of game play strategy cards 6040 in combination with an auxiliary planned game play and auxiliary planned movement selected by the game play winner from a game play strategy look up table of the plurality of game play strategy look up tables 6050, prior to rolling the sets of specially marked opposing team dice 5090, the score of the sets of specially marked opposing team dice 5090 and the planned game play in combination with the planned movement selected by the game play winner determining the game play outcome of the each game play of the plurality of game plays;

the opposing football team tokens 5042 removably mounted on the opposing football team markers 5044 being moved on the game board 5020, in accordance with the game play outcome of the each game play of the plurality of game plays;

the ten yard marker 6010, the adjustable down marker 6012, and the sliding scrimmage marker 5084 being moved along one of the opposing sidelines 5026, in accordance with the game play outcome of the each game play of the plurality of game plays;

a game winner determined by maximum number of goal line scores completed by a team of the opposing football team tokens 5042.

The football board game 5000 further comprises:

opposing sliding card holder racks 6060 slidably mounted to the game board 5020 adjacent the opposing sidelines 5026, the opposing sliding card holder racks 6060 adapted to removably receive the plurality of game play strategy cards 6040, each associated with the opposing football team tokens 5042, and slide along the opposing sidelines 5026 during play.

The football board game 5000 also comprises:

opposing recessed play action card holders 6070 recessed into each of the opposing end zones 5030 adapted to removably receive additional play cards 6072, comprising offense penalty cards, defense penalty cards, sack cards, and out of bounds cards.

It should be noted that the opposing football team markers 5044 are each adapted to facilitate coordinated movement of the opposing football team tokens 5042.

The football board game 5000 also comprises:

alternate embodiments of traditional football fields 6080 and 6082, which are substantially the same as the traditional football field 5022, except that the alternate embodiments of the traditional football fields 6080 and 6082 have different surfaces and/or surface textures and/or resiliency from the surface and/or surface textures of the traditional football field 5022, each of the different surfaces and/or surface textures and/or resiliencies affecting bounce and/or roll of dice thrown on the different embodiments of the traditional football fields 5022, 6080, and 6082, changing weather influenced field conditions dictated on various game play strategy charts, and/or appearance of the traditional football fields 5022, 6080, and 6082. The surfaces and/or surface textures of the different embodiments of the traditional football fields 5022, 6080, and 6082 may be constructed of carpeting, rubber, thermosetting polymers, polyethylene, vinyl, low, medium and/or high pile carpet, different density materials, materials having different resiliency, or combination thereof or other suitable materials adapted to affect the bounce and/or roll of the dice thrown thereon, changing weather influenced field conditions dictated on various game play strategy charts, and/or appearance of the different embodiment of the traditional football fields 5022, 6080, and 6082. Such materials may also be used to simulate appearance of, for example, indoor stadium fields and/or outdoor stadium fields.

The offensive football team marker 5060 further comprises:

locking mechanism 6090 adapted to releasably lock the sliding scrimmage marker 5084 into an extended position or a retracted position.

Soccer Preferred Embodiment

While NFL Football is quite popular in the United States and Canada, in Europe and the rest of the world the game of 'football' usually refers to Soccer, which has comparable popularity there.

Due to the dynamic nature of Soccer, the use of the OTR mechanism provides OTR Soccer with a level of excitement and speed not found in other soccer board games.

OTR soccer uses a board printed with a graphic of a soccer field (1601) and markers to designate field advancement in five yard increments on the left side (1602), center (1603) and right side (1604) of the field. It also indicates the location of the penalty box (1607) and the 20 yard mark (1606). A token representing the soccer ball is also provided to mark position on the field.

OTR Soccer is played with three types of dice: play dice (1701), ball dice (1702) and directional dice (1703). In this embodiment, four sets of play dice are provided for use by up to four players on a team. Each team is also provided with a ball die and a directional die. Preferably, all of a team's dice are the same color.

The game begins by each team rolling a single play die, possession going to the team with the highest die value. In addition, a single directional die is rolled to determine whether the attacking team will take position of the ball at midfield on the left right or center position.

Normal play mode proceeds with the attacking team rolling a single die and their directional die against the defending team's single die. The value of the dice are compared. If the attacking team has the higher roll, they move forward towards the opposing goal the value of their roll (in the increments marked on the board). Depending on the result of the roll of the directional die, the team moves to the left right or center position on the field. If the attaching team's roll is lower than the defending team's roll, the attacking team moves back towards their own goal the value of their roll. Again the attacking team moves to the position designated on the directional die.

If both the attacking team and defending team roll dice with equal values, possession of the ball reverses and the defending team becomes the attacking team. The now attacking team rolls their play die and directional die against the now defending team's single play die. If an attacking team gets within 20 yards of the goal, rather than advancing towards the goal, the team will move away from the goal the number of yards designated on their roll. Once the attacker has moved back beyond the 20 yard mark, they can again start moving forward on the roll as before. See FIG. 19.

Whenever the attacking team gets within 35 yards of the opposing goal, if the attacker rolls a six it may either take a shot at the goal or advance the six marks. See FIG. 20. If the attacker chooses to take a shot, depending where within the 35 yard marker the attacker is, different procedures apply. See FIG. 21.

If the attacker is at or within the 20 yard marker the attacker will roll one of its play dice, its ball die and its directional die. The defender will roll one of its play dice and its ball die. In order to score the attacker must roll equal values on it play and ball die, and a center on its directional die. If the defender does not roll doubles (equal values on the play die and ball die) the attacker scores. However, if the defender rolls doubles, the attacker does not score and players refer to the appropriate chart to determine who takes possession of the ball.

If the attacker is on the 25 yard line and chooses to take a shot, he rolls the ball die, two play dice and the directional die. The defender rolls his ball die and two play dice. For the attacker to score from this distance, they must roll doubles on the play dice, center on the directional die and his ball die must have a higher value than the ball die of the defender. If during this roll any two of the dice rolled by the defender have equal value, the attacker does not score and the chart is consulted to determine who takes possession.

If the attacker chooses to take a shot from the 30 or 35 yard line, he again rolls two play lice, the ball die and the directional die. In this situation however, the attacker must roll three of a kind, and get the center on the directional die. The defender also rolls three dice and will prevent the score by rolling equal values on any two dice. Again the chart is consulted to determine who takes possession.

Certain dice rolls create special conditions. If during normal play mode one player rolls a six and the other a one, the player rolling a six received a free kick card. If both players roll a six, the defending team receives possession of the ball, advances six field lines in the direction of their choice and the gets an unopposed roll. Play then resumes in normal mode. FIG. 19.

Play is timed as in regular soccer.

When more than two players are playing the game, each player takes one or more zones of the field and is responsible for rolling to advance, shoot or defend when the ball enters their assigned area. Specially marked play dice (1701) are provided to allow each player to have a uniquely marked play die. The team's ball die and die are used by whichever of the players has responsibility for play at the time. When a shot is taken that requires more than one play die, the attacking player uses the additional team dice if only two players. However, if there is more than one player per side, the additional teammates will roll simultaneously to fulfill the roll requirement.

Baseball Preferred Embodiment

A second primary preferred embodiment is On-The-Roll Baseball which schematizes professional Major League American Baseball.

A main difference between OTR Football and OTR Baseball is that, as with the live games, Football relies on a clock to delimit the game, and Baseball is delimited by nine innings.

Like football, the OTR mechanism can be applied to many other sports to produce more dynamic and interesting play than other sports board games. Below are examples of how OTR is used for baseball.

The players select a Pitching order (types of pitches) and a Batting order (types of batters) prior to the start of the game and maintain the circulation of that initially selected order throughout the game. In other words, the Pitcher flips the cards until they are exhausted and then starts at the top of the deck. The Batter flips their cards in the same fashion except another batter is not flipped until they get on base or are out. If the Batter has not exhausted their line up they put what was used at the bottom of the deck at the end of the inning to maintain the initial order set for the game. This operation produces an intriguing element of surprise, anticipation and unpredictable outcome, even though there is a strategy in their initial set up. There are several variables that can be introduced into the starting order during the game. For example, if the defense has received a DEF ERROR CARD awarded during the game for a "Pitcher steps off the mound" motion, that card could be used to allow the Pitcher to change the MATCH-UP by flipping over the next pitch then the one initially revealed. If a MATCH-UP again appears they must proceed with the game play for that situation. The interaction of the cards in this game are very powerful in effecting outcomes of many functions.

Other game elements that can affect the batting order, are, for example, the use of pinch hitters who can enter the game at any time. If on the initial roll, representing the first pitch, or two subsequent rolls, representing second and third pitches, the pinch hitter rolls a Six, the players proceed to roll two dice for the best out of five. If the offense the wins the series, the hitter gets a double. If the defense wins, the batter is out with no base runner advancement for any existing men on base. If a six is not rolled within one of the first three rolls play continues as normal.

A pinch runner can also be used when appropriate, but this requires that the batter for whom the runner is being substituted, come out of the game and be replaced in the batting order by the now pinch runner hitter. The disadvantage to this type of substitution is that there cannot be any type o Match-Up when this batter is up for the remainder of the game.

The use of a "Power Hitter" is a special case in the game. Here if the batter rolls a Six on its initial roll, the players roll two dice for the best of seven rolls. If the offense wins, it is a home run; if the defense wins, the batter is out with no base runner advancement for any existing men on base. If the batter did not roll a six initially, normal play continues. The use of this element creates a situation that varies from regular baseball rules in that when the offense uses a "Power Hitter", the offense must also change its current pitcher.

As in real baseball, relief pitchers may be substituted at any time during the game. Each reliever put in the game must pitch to at least one batter, and pitchers cannot be changed during an at bat. The starting pitcher and first relief pitcher must be chosen at the beginning of the game. Thereafter, any time the defense wishes to change a pitcher, the pitch cards (representing one pitch each) are shuffled and nine cards are selected without being looked at to determine the pitches available. In the current embodiment each card is unique, however, it is possible to have several cards the same or have some cards be subsets of others.

In addition to the relief pitchers, the defense can chose to use their closing pitcher, termed the Closer. The Closer gives the defense the most flexibility and consists of a set of nine cards. These cards are selected from the entire set of pitching cards (currently 31 cards) at the time the defense decides to substitute the closer for their pitcher. The selection and order of the cards for the closer should be determined based upon the characteristics of the offensive batting order, the selection of cards being those most likely to provide the defense with good Match-ups.

When using the Closer, the defense flips a first pitch. Unlike the situation with a regular pitcher, prior to rolling, the Closer may optionally flip a second pitch. The defense may chose this option if, for example, a disadvantageous Match-Up appears on the first pitch. If the defense chooses to flip a second pitch before beginning to roll, it must proceed with the requirements of that second pitch including a Match-Up.

As much as possible, the actual rules of baseball are maintained during game play except as otherwise designated such as with the use of a Power Hitter, explained above.

The Double sixes rule applies for the initial match-up rolling. If the DEF rolls sixes and the OFF has any other roll, the ball is caught at wall, the batter is out and DEF gets an UMP CARD. If OFF rolls sixes and the DEF rolls any other roll, it is a Home Run and OFF gets DEF ERROR CARD.

The On The Roll Mechanism works here as follows: After the initial flip of the cards and the roll where a batter gets a hit by rolling a six, each team proceeds to roll two dice to determine if the batter gets on base (Revealing the type of hit a single, double, etc.) Some of the outcomes on the "HIT OUTCOME CHART" require even another roll to complete the play. If the batter rolls into a grounder and they have men on base then each team rolls one die again to see if any men advance because the grounder may have gone down the first base line forcing the batter out but allowing for the man on second to advance to third, for example.

The main charts of Baseball are:

1. Initial game play between Pitcher and Batter (one Die) reveals whether Strike, Ball, Foul Ball or hit has occurred. FIG. 27A.
2. Pitching series Match-Up (One Die) contains the result of a best out of three rolls series. Under certain conditions it is the result of the last roll that determines the outcome of the Match-Up. FIG. 27B.
3. Initial Match-Up (Two Dice) contains the result of the best out of seven rolls and has the double sixes rule built in. FIG. 27C.
4. Hit Outcome Chart (Two Dice) contains all the possible outcomes as far as type of hit and results. FIG. 27D.
5. Base runner results. (One Die) contains the results of each team having to roll one die if the hit is a ground ball and the OFF has men on base. It also contains a 1/6 rule. FIG. 27E.

The OTR mechanism and over all style of game play has been applied in baseball in the following examples.

In baseball the basic principle or goal is to: offensively, match a specific type of batter to the specific type of pitch that batter hits; and, defensively, to try and produce a pitching lineup that will remain in contrast to the batter order lineup so no match-ups appear.

Offensively: An inside fast ball pitch and an inside fast ball hitter creates a match-up.

Defensively: An inside fast ball pitch and an inside curve ball hitter results in an ordinary pitch.

Play begins by each player flipping a card. This creates either an initial match-up between pitcher and batter if the type of cards match with a specific roll requirement and result or, if the cards do not match it is considered just a regular pitch to the batter.

If, on the initial turn of the cards for an at bat, the pitch matches the type of batter who is up, the situation is called an "Initial Match-Up". When there is an Initial Match-up each player rolls two dice up to seven times. Whichever player wins four out of the seven rolls, wins the at bat. If the Batter wins, it is considered a home run. If the Pitcher wins, the batter is out.

If the cards do not initially match-up, each player rolls one die and obtains a result for that single pitch (Ball, strike, foul or 1/6 outcome). The pitcher then flips another card constituting the next pitch to the batter (the batter does not flip a new card) and if there again is no match-up, the players each roll one die to determine the result of the pitch. This continues until the batter rolls a 6 (considered to be the hitter making contact with the ball) at which point the players each roll two dice and refer to the Hit Outcome Chart to determine whether the batter gets a hit, and if so what type, or is out; or has some other result as specified in the charts (e.g. is hit by a pitch or has a foul ball caught). If, at any time during the at bat (after the initial card turn) the pitcher flips a card which matches the batter, it is called a "Pitching Series Match-Up". In this case each player rolls one die for the best out of three rolls series and refers to the Pitching Series Match-Up Chart to determine the results of the pitch.

Examples of various scenarios follow:

Each team flips their card (No Match-Up); each team rolls one die for a result. The pitcher flips their next pitch card and it matches the type of batter up (Pitching series Match-Up); each team rolls one die for the best out of three rolls series and refers to the "Pitching Series Match-Up" chart for the results of either the batter gets on base or is out.

Each team flips their card (Match-Up) each team proceeds to roll the best out of seven rolls using two dice each for either a home run or an out.

Each team flips their card (No Match-Up); each team rolls one die for a result (Strike, Ball, Foul or 1/6 consequence). Then the pitcher flips their next pitch; each team rolls and the batter rolls a six (Hit); each team rolls two dice and refers to the "Hit Outcome" chart for the results of either the batter gets on base or is out.

Each team flips their card (No Match-Up) each team rolls one die for a result. The pitcher continues to flip pitches until the batter either gets a hit (Rolls a six) or is out by a strike out or fielded ball such as a ball popped up behind the home plate and caught by the catcher.

Each team flips their card (No Match-Up) each team rolls one die for a result (Strike, Ball, Foul or 1/6 consequence). The pitcher then flips their next pitch, each team rolls and the batter rolls a six (Hit). Each team then rolls two dice for the results and refer to the Hit Outcome Chart for the results. If the batter gets a single and has a man on 2nd and 3rd base, each team proceeds to roll one die after the hit to see where the base runners will go as a result of the single. If the Off wins the roll, the man on 3rd goes home and the man on 2nd goes to 3rd base. If the Defense wins the roll, the man on 3rd is out at home and the man on 2nd goes to 3rd. See the "Base Runner Results" chart.

Additionally, there are bonus cards such as "DEF ERROR CARDS" and "UMP CARDS" which are obtained through the results of certain play rolls and have game momentum changing bonuses that a player can use anytime during the game. These cards are the equivalent of the "Sack" cards and "Out of Bounds" cards of On the Roll Football. Each player will also have a set of manager cards which remain in their possession throughout the game and have managerial decision making plays to use at their discretion.

Other similarities to OTR Football are the style of charts using Hi/Lo sum and value listings and various conditions stemming from the initial roll leading to a series of following rolls to complete a play. Rules that are signature OTR include the Doubles Sixes rule and the 1/6 rule. Also found here are the dice structures of Equal and Matched sums, Equal Values, as well as Hi, Lo Sums and Values, and Equal doubles.

Golf Preferred Embodiment

Football and Golf are very different games. This is illustrated well by the technical use of the term 'drive' in each game. In Football, a 'drive' is a continuous press down the field which is modeled by the OTR simultaneous and continued rolls until the play is completed. In contrast, with Golf, a 'drive' is a single swing by a single player and is modeled (at the high level) by a single roll of the dice by a lone player, to be followed by a single roll by another player.

With OTR Golf, in contrast to OTR Football, much of the realistic play is embodied in the way a series of procedures interact with the landscape and environmental features embodied in a map of an individual hole of a golf course. Consequently, rather than an extensive series of charts, the golf game is best described as a series of flow charts depicting those procedures. Nevertheless, the OTR function is embodied in OTR Golf during the Hazard and Putting phases, where play is monopolized by a single player, in an open ended manner, until the end of that phase.

Figure 1:
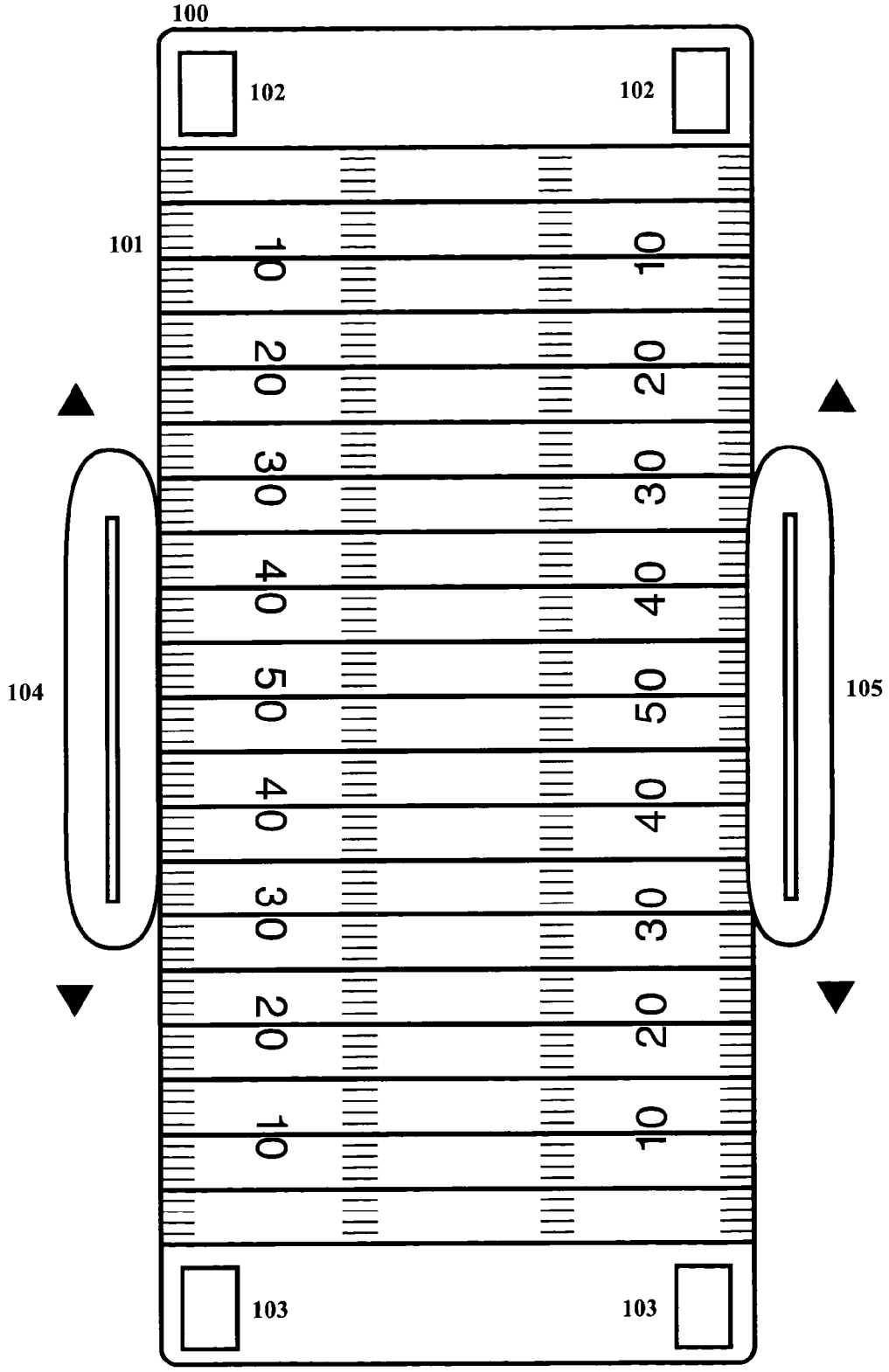
FIG. 1 depicts the On-The-Roll ("OTR") Football Game Board (100) showing an NFL Football Field (101), Racks for Cards (102)(103) and Side Line Clips (104)(105)
Figure 2:
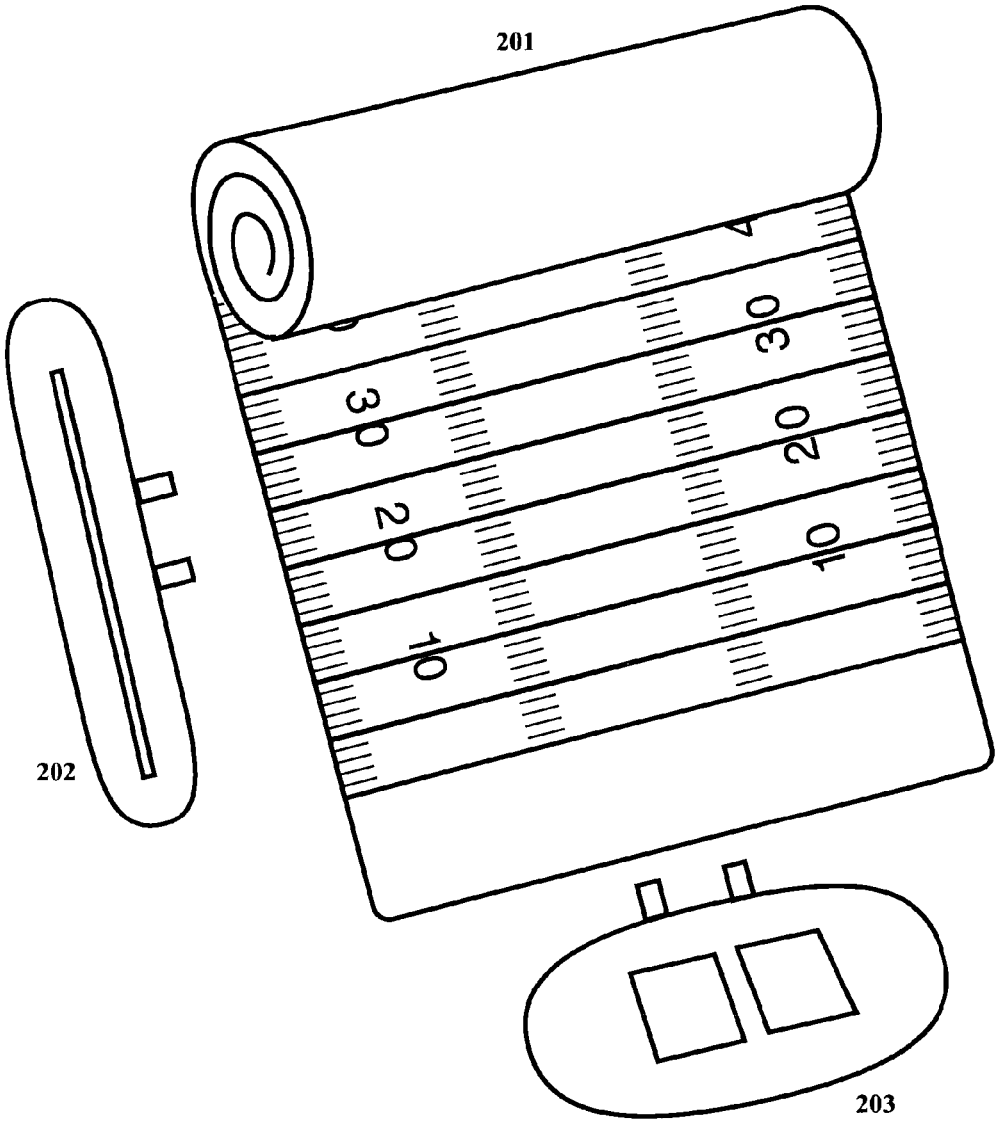
FIG. 2 depicts a Roll-up Version On-The-Roll Football Game Board (201) with an Example of Side Line Clip (202) and End Zone Card Holder (203)
Figure 3:
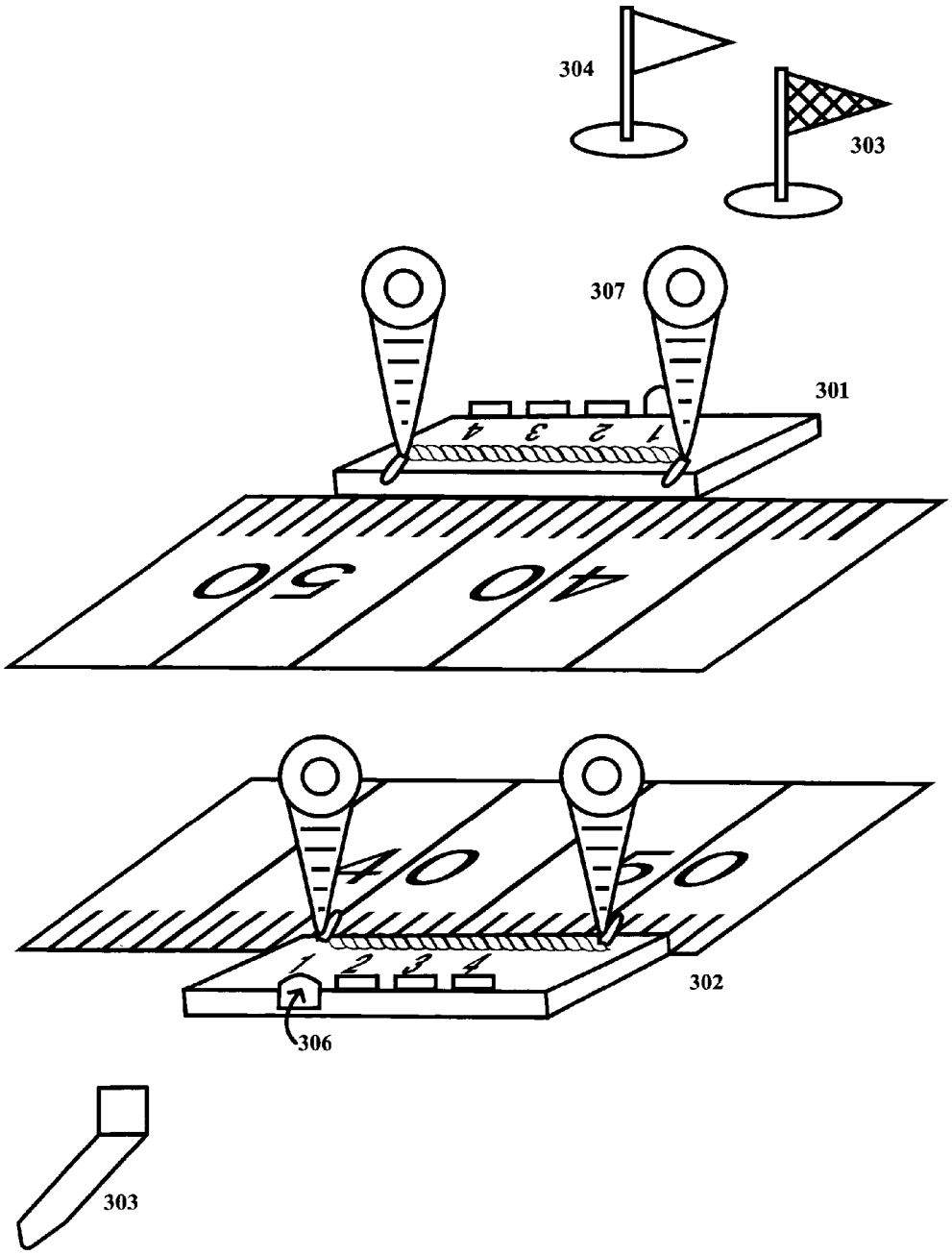
FIG. 3 depicts the Ten Yard Marker (Front View (301) and Rear View (302) with Down Marker) Field Hash Marker (303), Yellow Penalty Flag (304) and Red Coach Challenge Flag (305)
Figure 29:
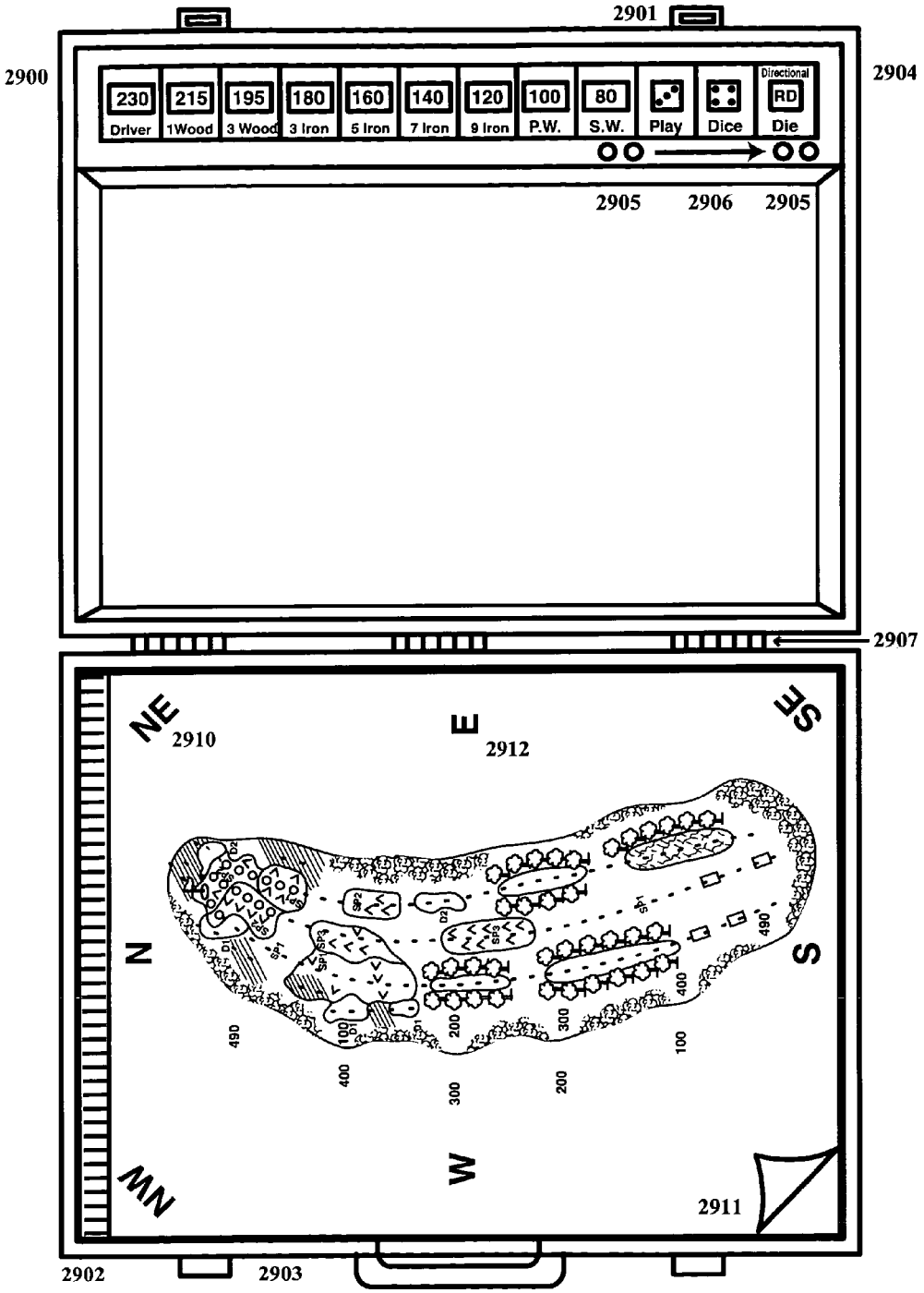
FIG. 29 depicts an OTR Golf Executive Game.

An OTR Golf game is optionally embodied in standard or deluxe boards, or a roll up version, similar to FIGS. 1 and 2 for OTR Football. Further, an 'executive' embodiment of OTR Golf (which embodiment may be used with other games as well) is depicted in FIG. 29.

A typical executive embodiment is housed in a hinged (2907) attaché case-like enclosure (2900) complete with locking closures (2901, 2902) and a carrying handle (2903). The top half of the case contains fitted compartments to hold the dice (2904) golf ball position tokens (2905) and wind direction marker (2906). The balance of that area comprises a typically felt-lined recessed tray for rolling the various dice. The bottom half of the case holds a typically spiral bound (as shown at left) book of golf hole maps (2910) with individual pages (2912, FIG. 30) that are turned (2911) to play various holes in the game, typically there are 9 to 18 holes in a complete course game. The spiral book of hole maps is, optionally, interchangeable. Books are Supplied that, optionally, correspond to actual golf courses and are, optionally, tied in with realistic depictions and simulations of the specific course hole designs and/or course names and other information associated with the course. Alternatively fictional courses are supplied; and, courses of various designs and difficulty are, optionally, supplied with, or as supplements to, the basic game.

Figure 30:
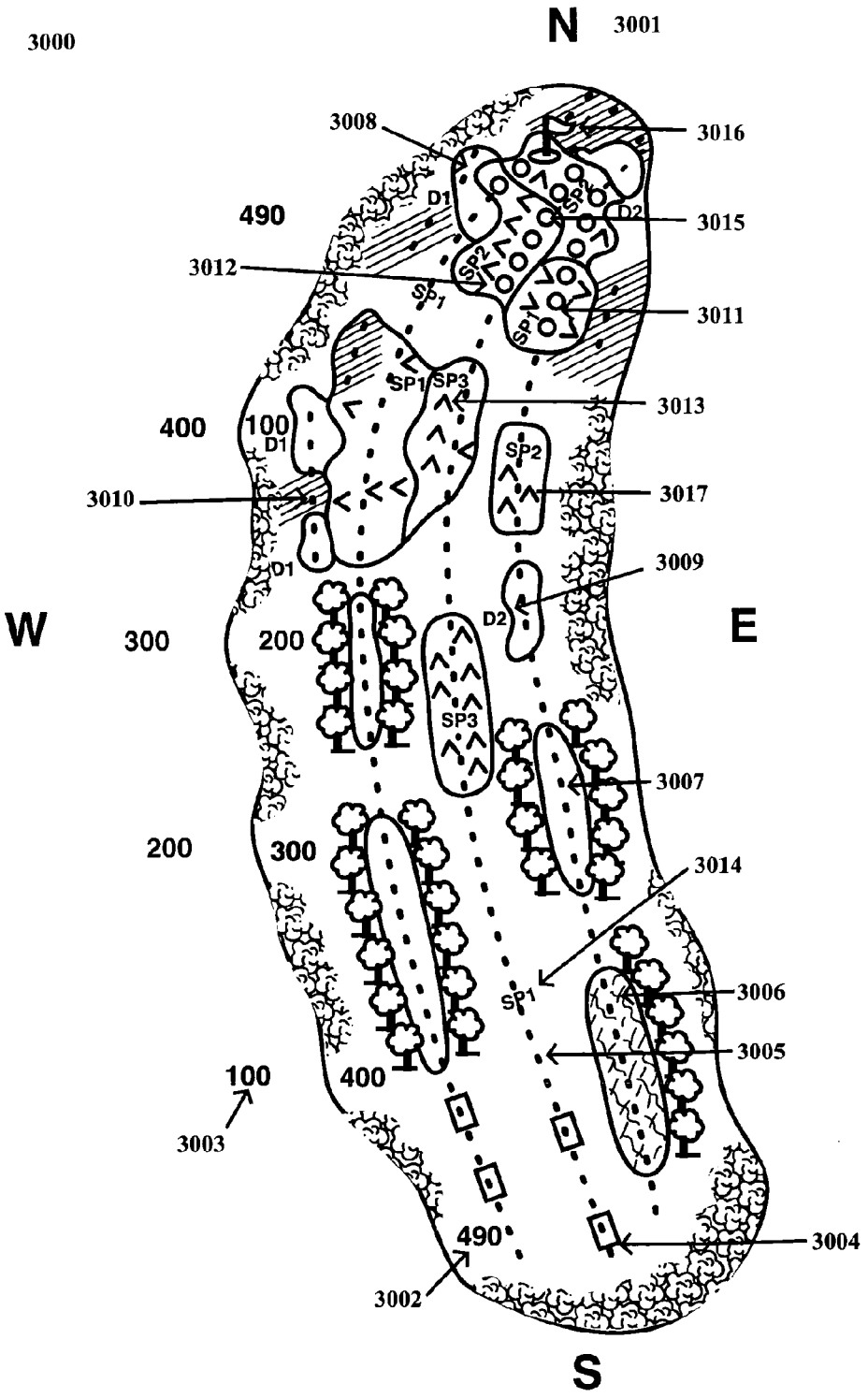
FIG. 30 depicts a typical OTR Golf Hole Map.

FIG. 30 shows a detailed view of element (2912), a typical golf hole map (3000). This specific graphic layout, and choice of symbols and depictions, is exemplary in nature, and not intended to be limiting. It embodies various environmental (landscaping and wind) features that are used in conjunction with the procedures embodied in the 'system of play' or algorithm diagrams of FIGS. 32 through 46.

Direction is indicated by cardinal (and, optionally, intermediate) points (3001) to be used in conjunction with the wind features (see 2906 and FIG. 47). Indicators of distance to hole (3002) and distance from farthest yard marker (3003) help locate individual yard markers (3005). Several tees (3004) marked by rectangles are provided, with those further from the hole being 'pro' tees. Various types of hazard areas are indicated on the hole map including:

- water hazards (3006) to be used with the algorithm of FIG. 39;
- tree hazards (3007) to be used with the algorithm of FIG. 40;
- sand traps of lower difficulty (D1) (3008) to be used with the algorithm of FIG. 41 on the fairway or FIG. 43 on the green;
- sand traps of higher difficulty (D2) (3009) to be used with the algorithm of FIG. 42 on the fairway or FIG. 44 on the green; and,
- rough hazards (3010) to be used with the algorithm of FIG. 41 on the fairway or FIG. 43 on the green (or optionally, algorithms distinct from those used with the sand traps of lower difficulty).

The green area, as opposed to the fairway and approach or other areas, is indicated by distinct yard markers such as the circles show (3015); the hole itself by an oval cap and flag (3016).

In addition, various areas of the green, approach and fairway are marked with slant (SP) factors. Shown here in three speeds SP1 (3011) SP2 (3012) and SP3 (3013). These are used in conjunction with the drop/roll markings on the directional die (3102), in the event of a roll, to add additional yardage (typically 1 yard marker times the SP factor) in the direction indicated by the V pointers (3017) or, otherwise, toward the hole. As shown, the default factor (unless otherwise indicated) for this hole is SP1 (3014), but is, optionally, otherwise, including no roll SP factor.

Figure 31:
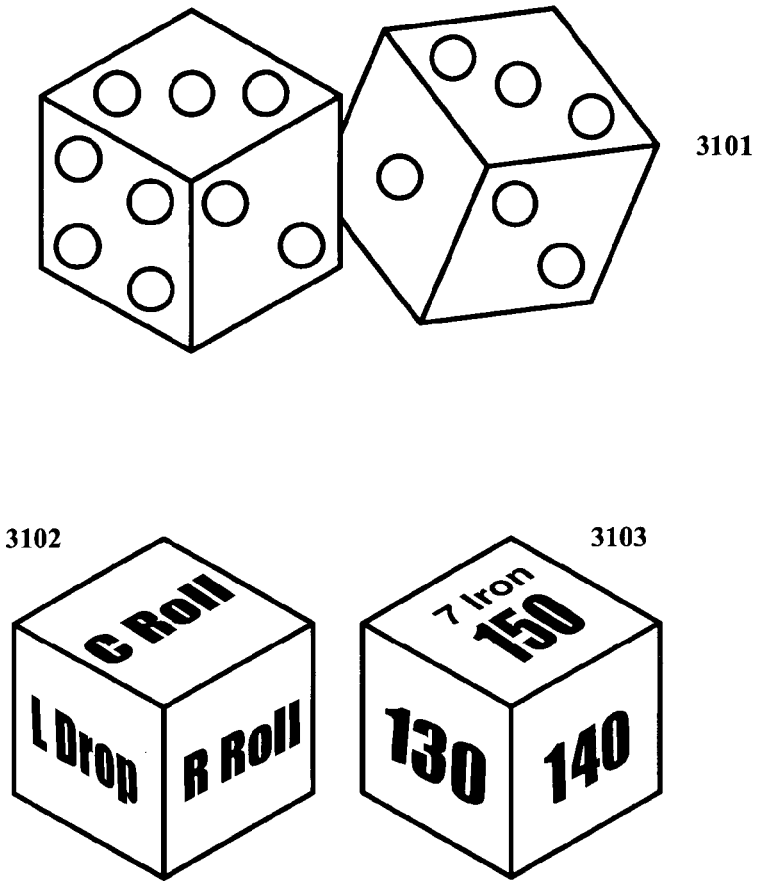
FIG. 31 depicts OTR Golf Dice.
Figure 52:
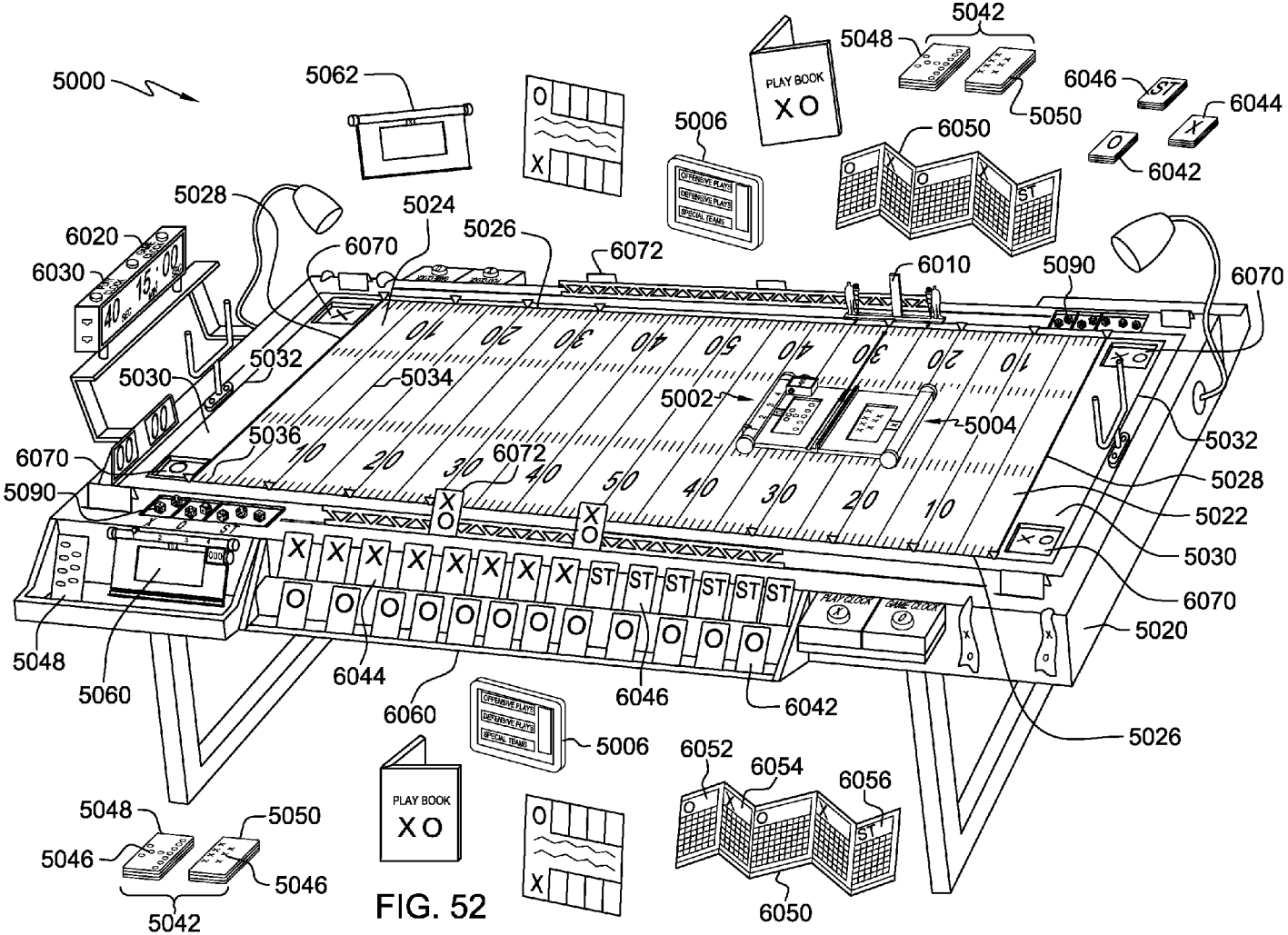
FIG. 52 is a perspective view of an alternate embodiment of a football board game, constructed in accordance with the present invention.
Figure 53:
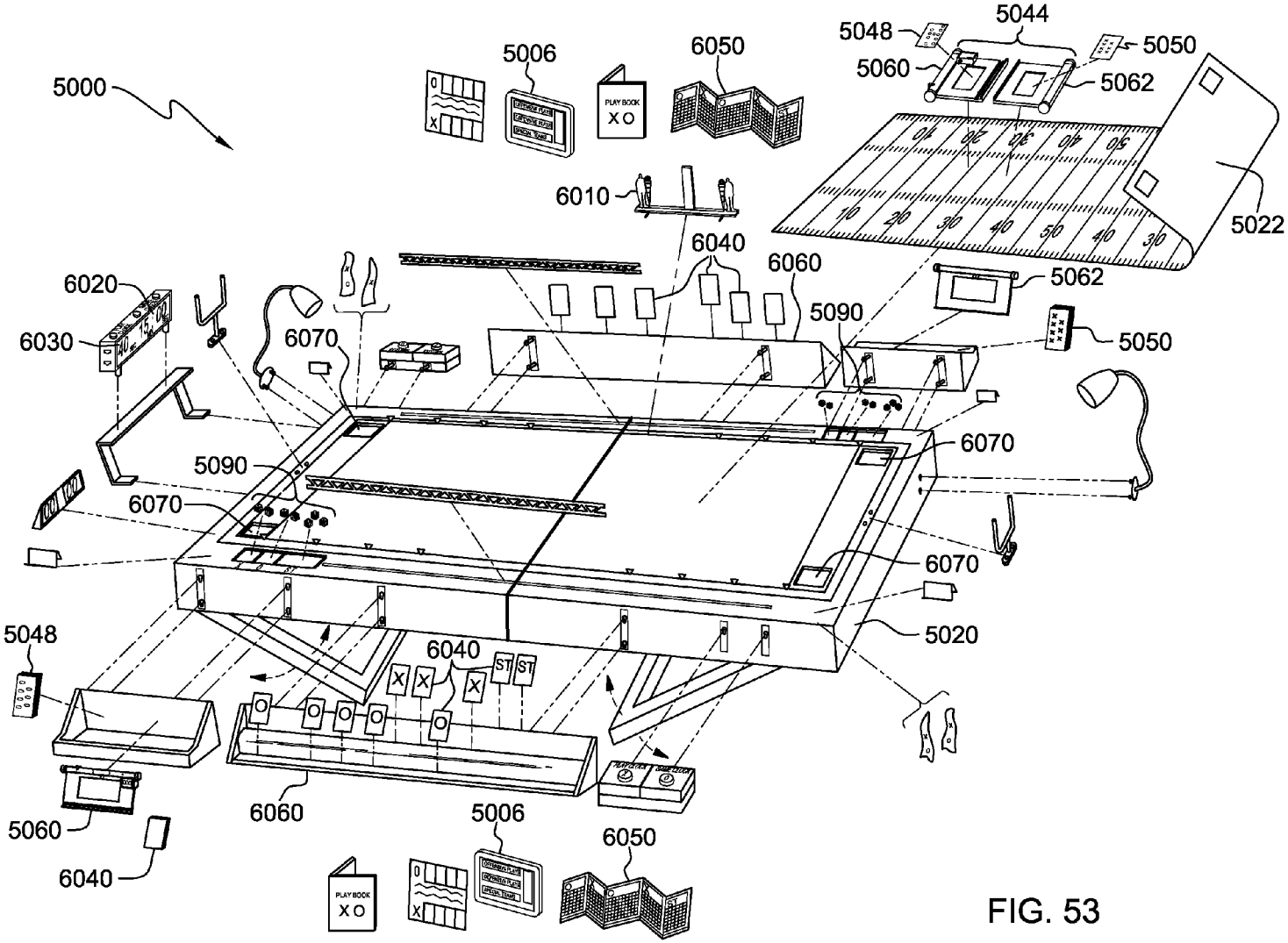
FIG. 53 is an exploded view of the alternate embodiment of the football board game of FIG. 52.
Figure 54:
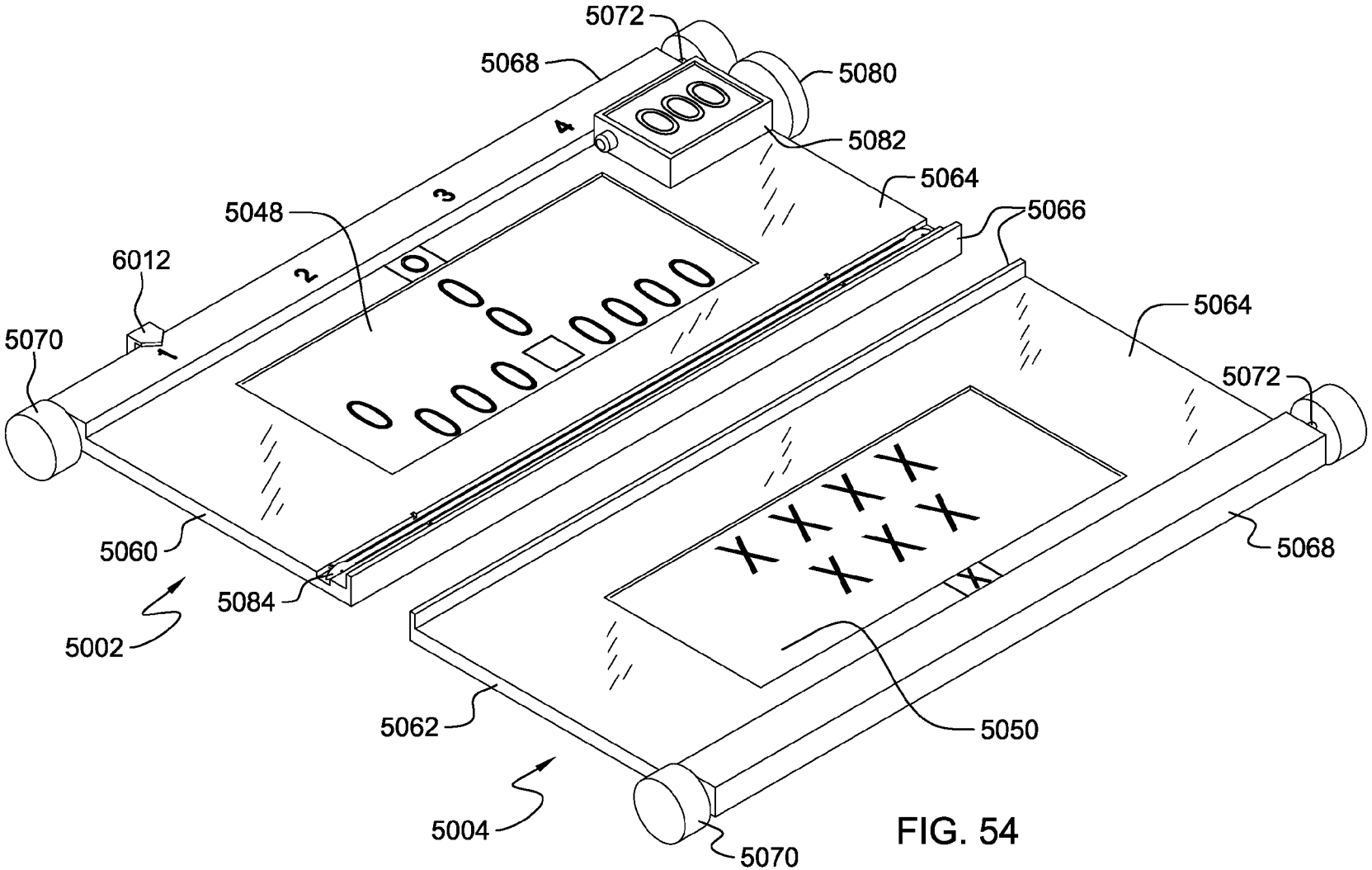
FIG. 54 is a perspective view of alternate embodiments of opposing combination football team tokens and football team markers of the alternate embodiment of the football board game of FIG. 52, showing an offensive combination football team token and football team marker and a defensive combination football team token and football team marker, each having front lips facing one another.
Figure 55:
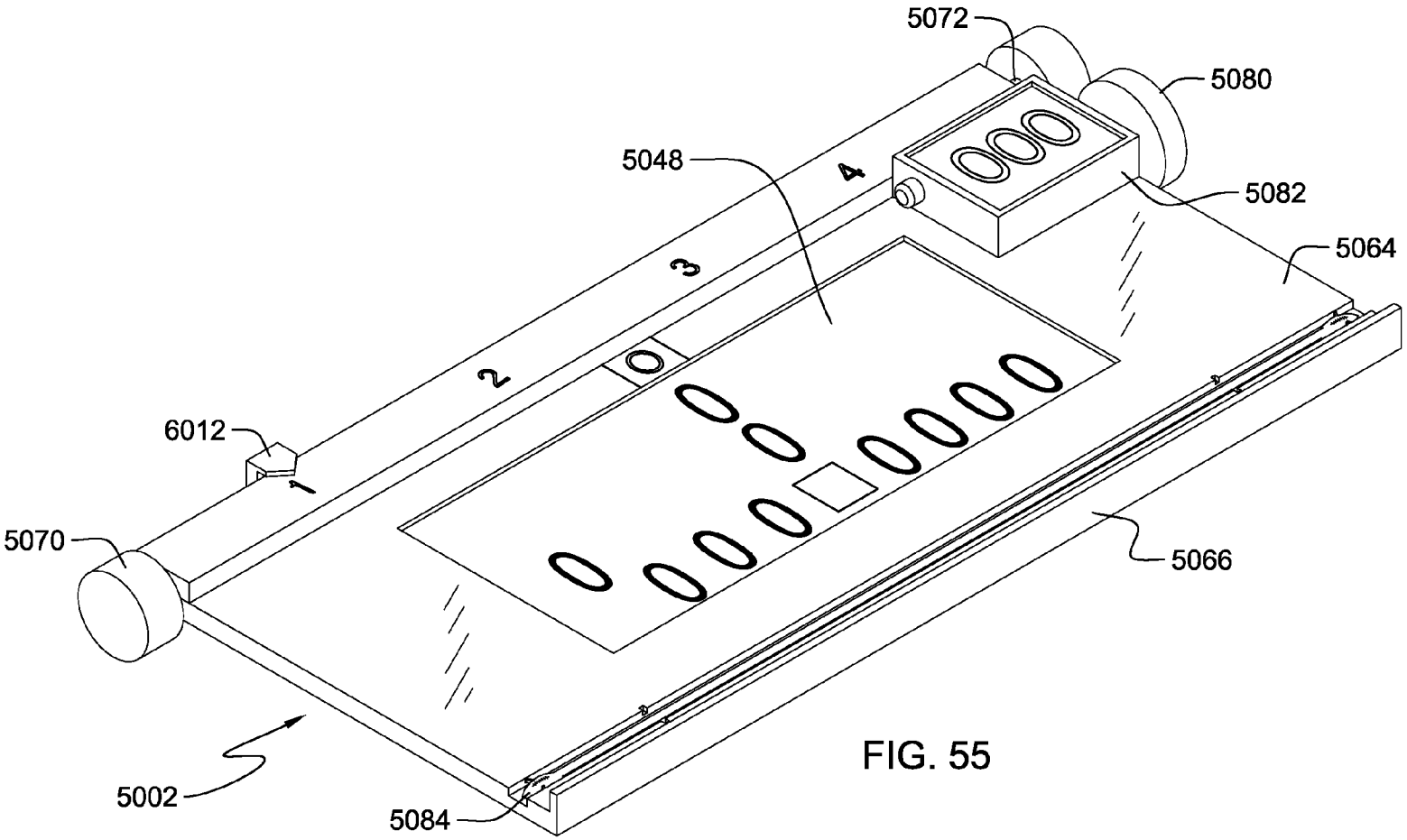
FIG. 55 is a perspective view of the offensive combination football team token and football team marker of FIG. 54.
Figure 56:
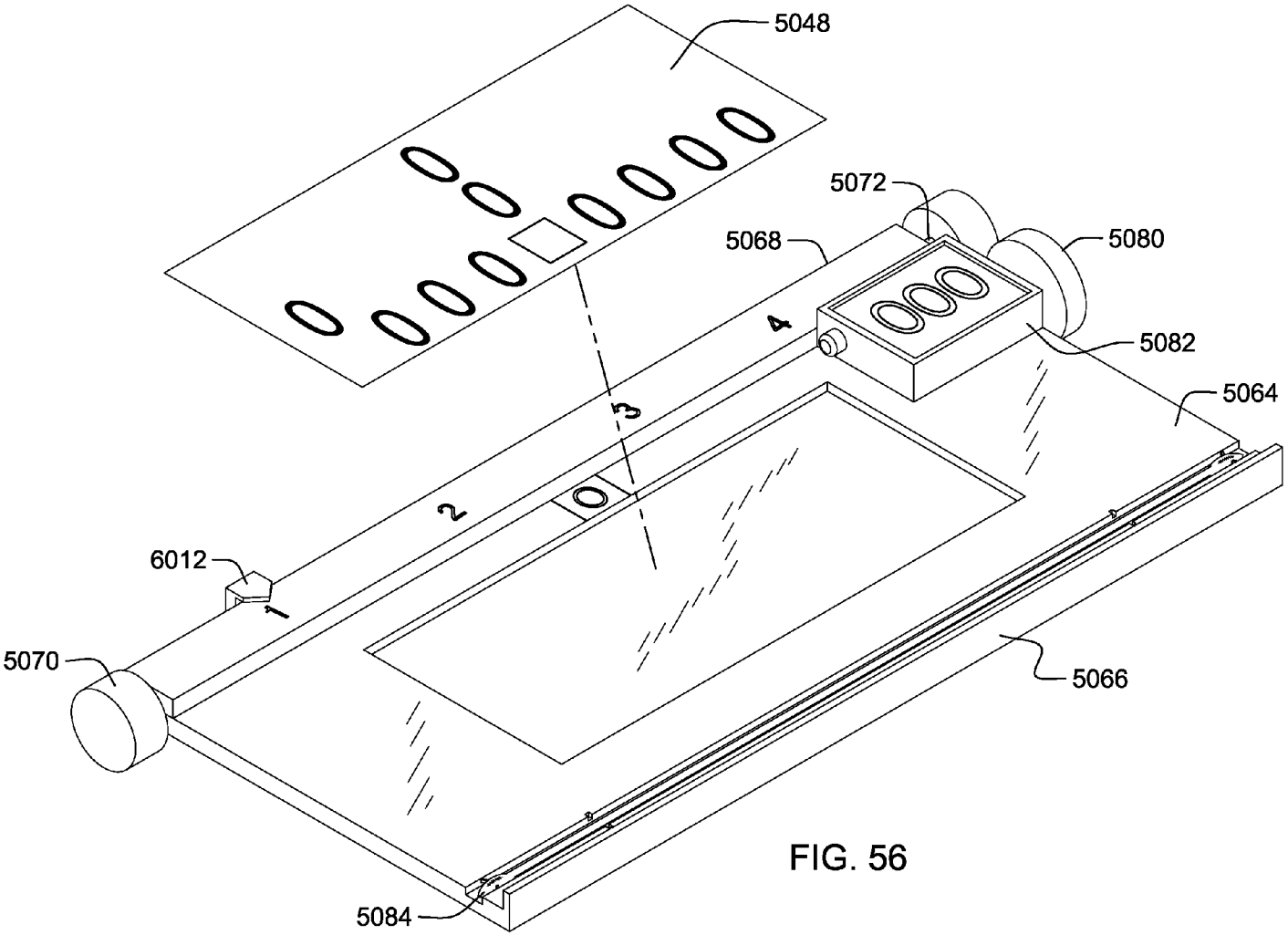
FIG. 56 is an exploded view of the alternate embodiment of the offensive combination football team token and football team marker of FIG. 54 showing an offensive football team marker and an offensive football team token.
Figure 57:
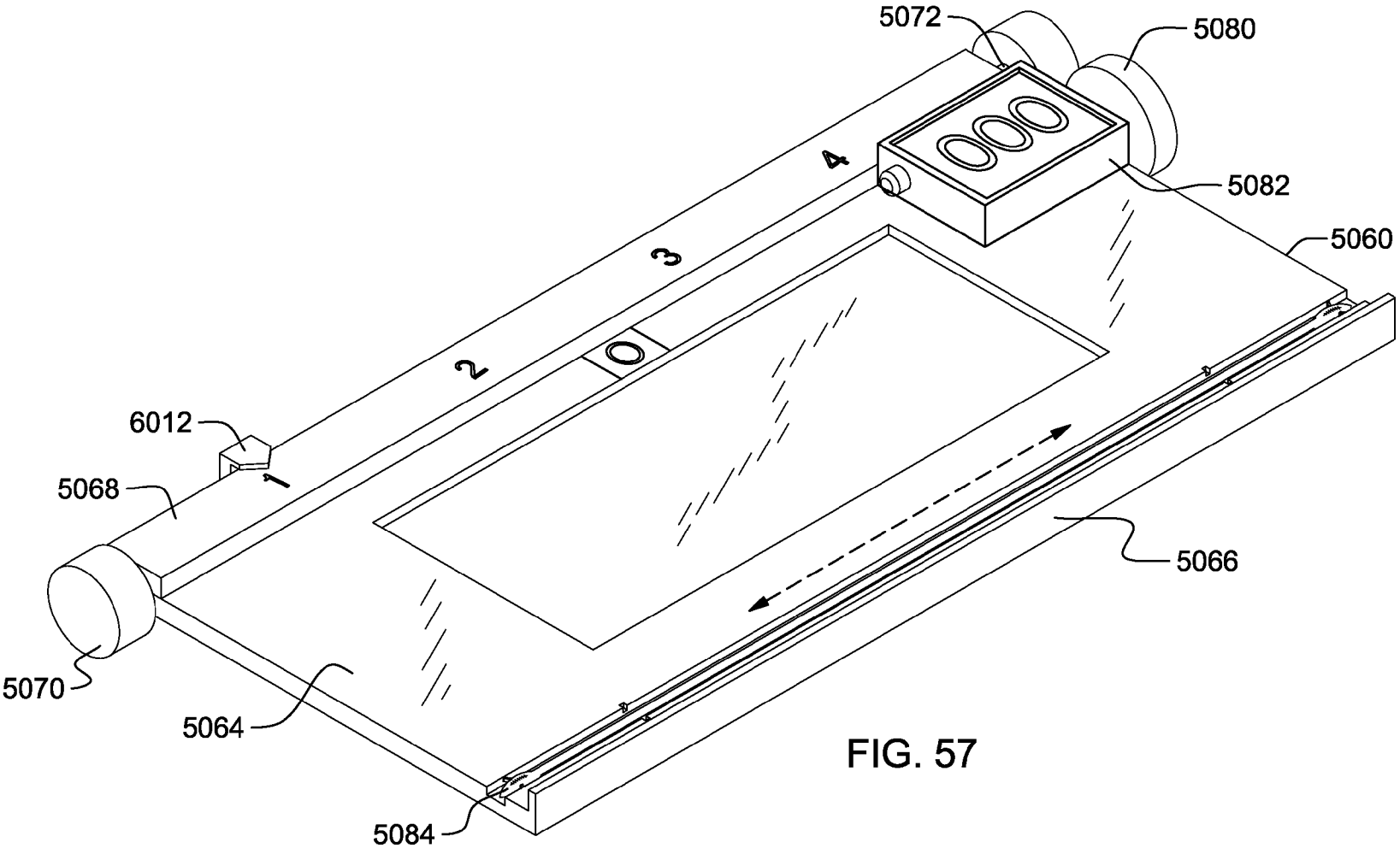
FIG. 57 is a perspective view of the offensive football team marker of FIG. 56.
Figure 58:
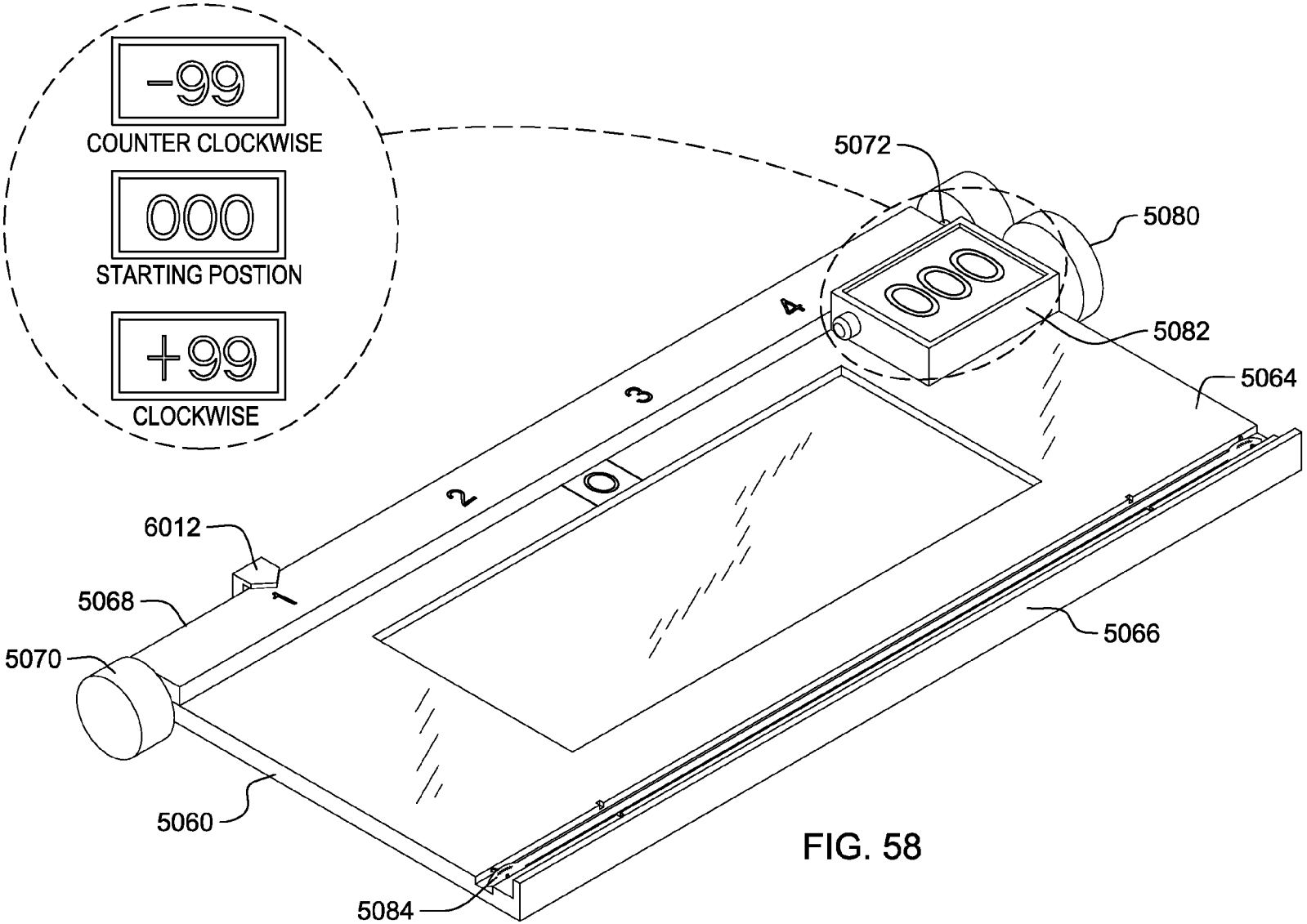
FIG. 58 is a perspective view of the offensive football team marker of FIG. 56, showing an enlarged view of a bidirectional yardage indicator of a measuring wheel of the offensive football team marker.
Figure 60:
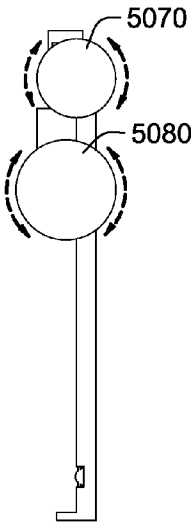
FIG. 60 is a side view of the offensive football team marker of FIG. 56.
Figure 59:
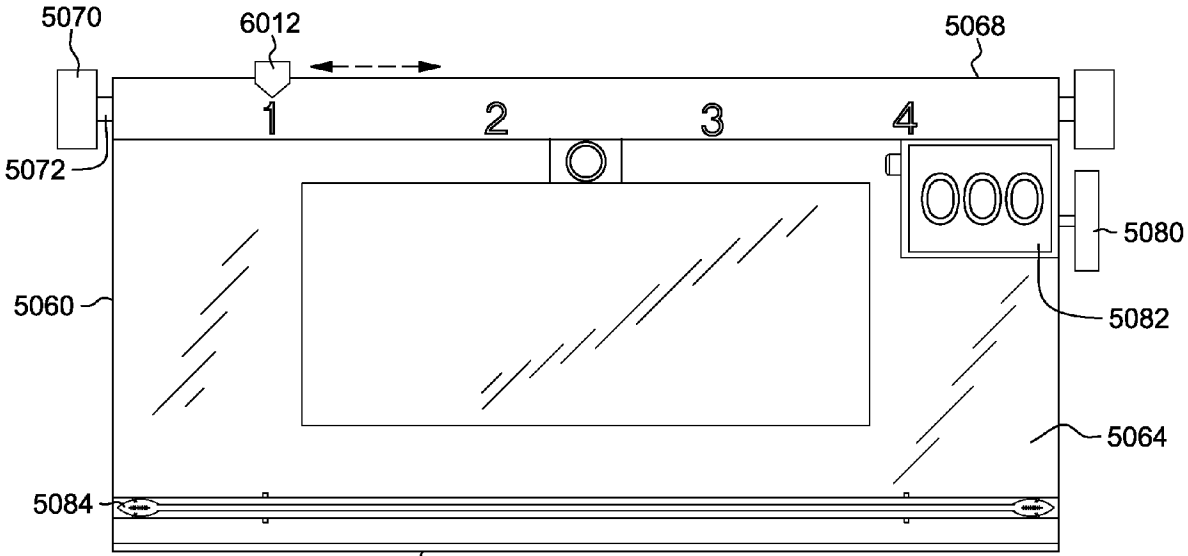
FIG. 59 is a top view of the offensive football team marker of FIG. 56.
Figure 61:
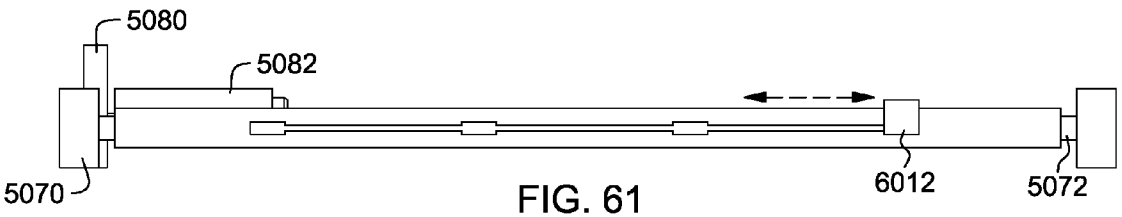
FIG. 61 is a rear view of the offensive football team marker of FIG. 56.
Figure 62:
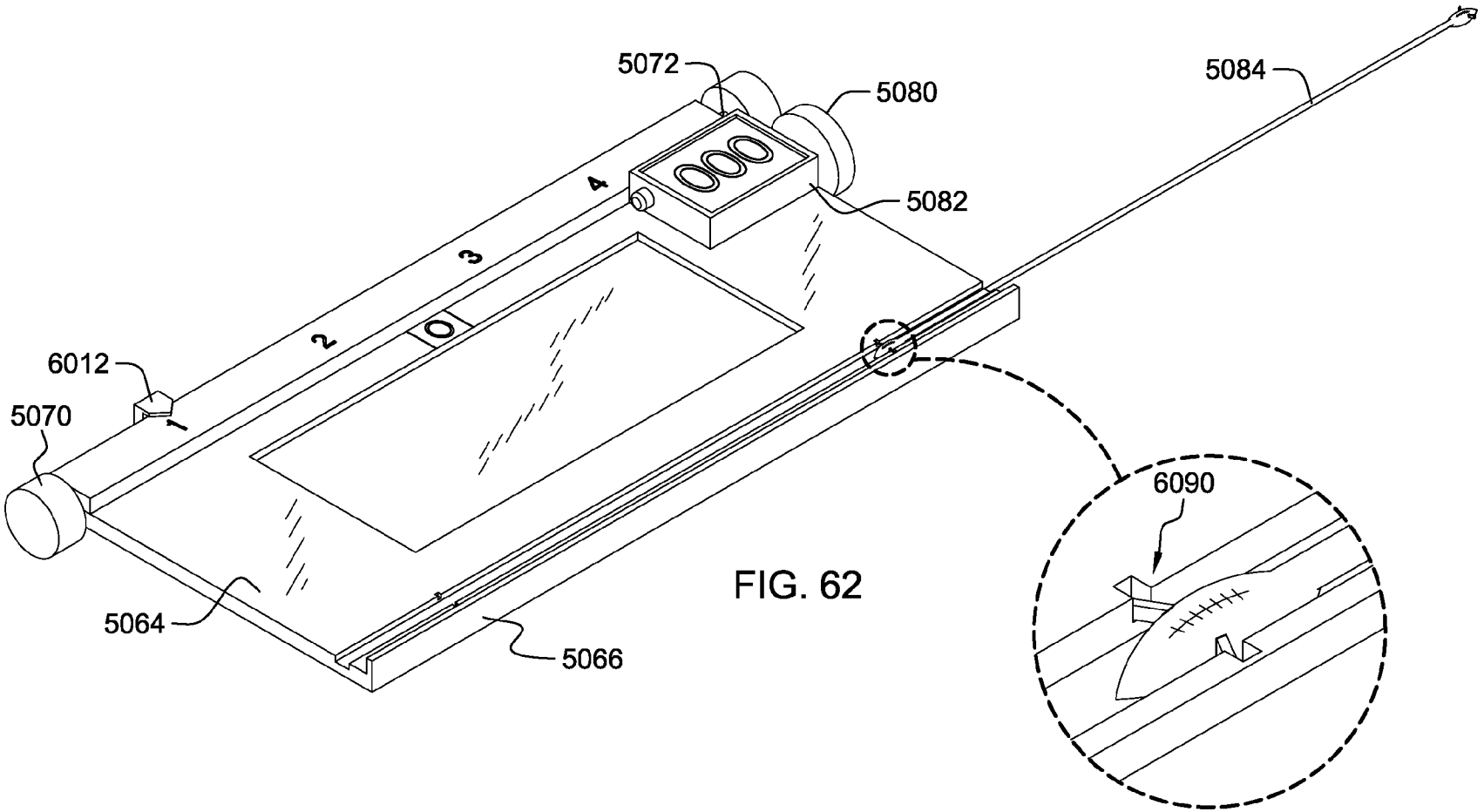
FIG. 62 is a perspective view of the offensive football team marker of FIG. 56, showing a sliding scrimmage marker and an enlarged view of a locking mechanism of the offensive football team marker and the sliding scrimmage marker.
Figure 63:
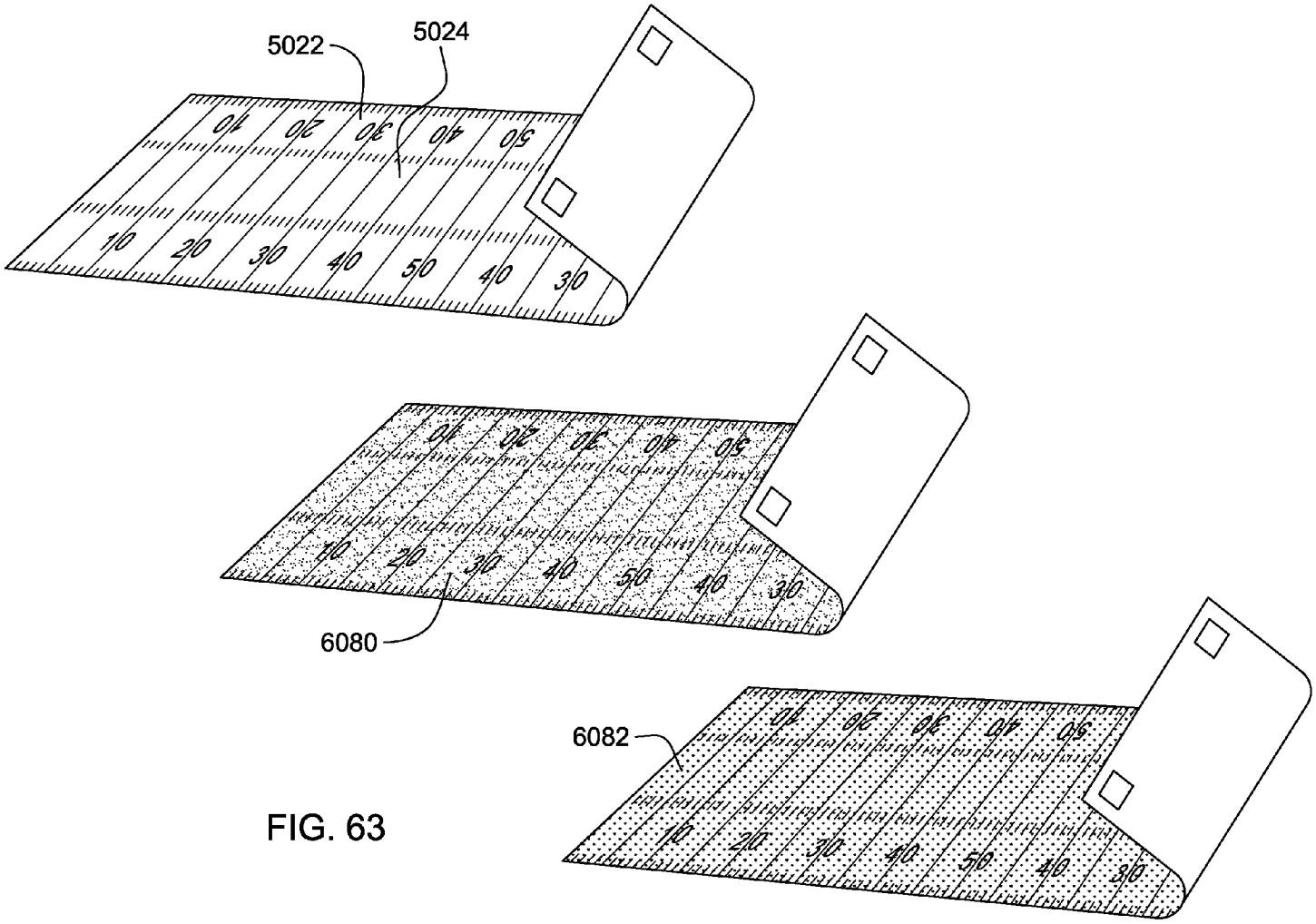
FIG. 63 is a perspective view of alternate embodiments of traditional football fields of the alternate embodiment of the football board game of FIG. 52.
Figure 64:
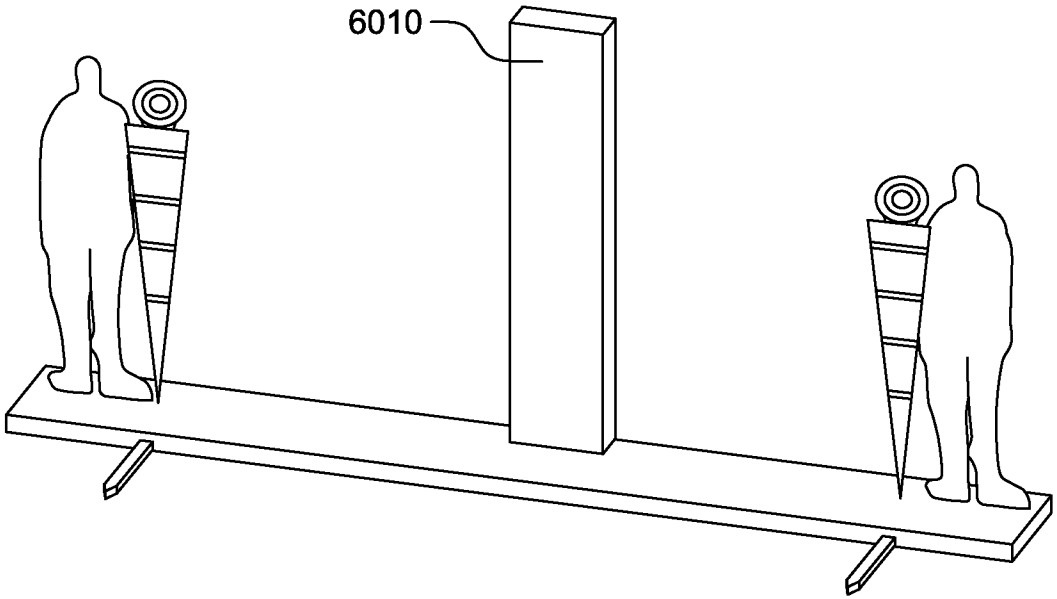
FIG. 64 is a perspective view of a ten yard marker of the alternate embodiment of the football board game of FIG. 52.

FIG. 31 shows dice used with OTR Golf.

Two standard dice (3101) are the play dice (abbreviated in some diagrams as PD, P.D. Play.D., etc.). These are used to implement a number of functions to model shooting performance. For example, a 'muff shot' is the typical result of rolling double Is; and, a double 6 often indicates that a shot results in sinking the ball, or results in adding additional yardage to a fairway shot that would otherwise be out of range of the green.

One directional die (3102) is provided determining both the directional path (typically Left, Center and Right) and whether the ball 'drops' or 'rolls' upon landing. With six sides each combination of L/R/C with drop/roll is represented. Separate dice (or other indicators) can, optionally, be used; and, the number of directional paths need not be limited to three.

A series of Club Dice (abbreviated in some diagrams as CD, C.D. Club.D., etc.) are used to play the game and have various distances in yards marked upon them, which are clustered around a performance typical for that type of club. For example: a Seven Iron (3103) produces for many players an average shot distance of 130; and the corresponding die has two sides marked with that average result, two sides above average (140 & 150) and two below average (120 & 110). As golf technology or player skill advances, these numbers are, optionally, periodically adjusted to reflect an authentic representation of the game at any given time.

A typical exemplary set of club dice consist of die representing a driver, several woods, several irons, optional pitching wedge (P.W.), sand wedge (S.W.) and putter (not shown in 2904), etc. Standard and 'pro' club dice are optionally provided with the pro dice having higher averages. Alternative single or sets of club die are provided either with, or as a supplement to, the basic game.

The Course: As with the real game, with OTR Golf a game consists of a series of holes with each player taking turns at shots (except for putting and escaping hazards, which proceed in OTR fashion) and accruing a 'stroke' for each shot. Holes vary in distance and difficulty and, therefore are, generally, par 3, 4 or 5.

The Wind: One of the optional features that makes for an authentic and realistic game play is the wind mechanism. At the start of the game (or, alternatively, before each hole, or more than once per hole) wind conditions are determined. For example, as an illustration, a die is rolled and outcomes of 1, 2, 3, 4, 5, 6 correspond to wind conditions of Due North, Due South, Due East, Due West, No Wind and No Wind for direction. A second roll determines wind speed with outcomes corresponding to 10, 20, 30, 40, 0 and 0 MPH.

Other randomizer mechanisms, formula and sets of directions are, optionally, used instead. For any given shot, the wind direction is compared to the direction of the shot to determine if the condition results in: a direct head wind, an indirect head wind, a direct tail wind or an indirect tail wind. FIG. 47 depicts a wind chart that shows how these various conditions modify the distance the ball travels as determined by the roll of the club die or, in some instances, the game die.

By this mechanism the effect of the wind changes with each shot in a predictable way and the direction of the wind interacts with the path of a particular stretch of the fairway or green. Play strategy is, thus, effected by the wind so that, for just one example, with a strong tail wind (in the direction of ball travel near the hole) a player may choose a particular club in order to try to make an intermediate shot which lands further from the green than if there was a strong head wind.

A Hole: As shown in FIG. 32, at the start of a hole (3200) the optional wind factor (3210) is rolled for both direction and strength. Then a tee is selected for all players to use or, alternatively, each player selects a tee at the beginning of their turn (3220). For a par 3 hole (3230), which is generally no more than 170 yards, the player proceeds directly to an approach shot, which is defined as a shot from a distance of 170 yard or less from the hole. Otherwise, for holes of par 4 or greater (3240), the first shot is a drive, which is defined as a shot taken from more than 170 yards from the hole.

The Drive Shot: As depicted in FIG. 34, the procedure for a drive shot (3400) is started (3410) by rolling together (3420) a selected club die (3411), the only one directional die (3412), and the two play dice (3413). Distance is determined by the roll of the club die as modified by the optional wind factor, as per FIG. 47. The particular directional path (L, C, R) is determined from the roll of the directional die. Further, is the directional die outcome is a drop, the location is fixed. Otherwise if the directional die outcome is a roll, the ball continues (in direction of the V pointers (3017) present in the area or, otherwise, toward the hole) by an amount equal to the marked speed factor (SP1 (3011) SP2 (3012) and SP3 (3013) or, otherwise, by a default value shown, generally 1 (3014)) .times.10 yards (3422). Further, if the play dice roll is a double 6 (3423) the ball is moved an additional 30 yards toward the hole (3424).

If a double 1 is rolled on the play dice (generally a 'muff shot') or the hole is overshot an out of bounds condition results (3430) leading (3431) to FIG. 33.

Otherwise (3432), if the ball lands in a hazard area (3440) play proceeds (3441) to FIG. 38.

Otherwise (3442), if the ball rests on the green (3450) the next shot is a putt, proceeding (3451) to FIG. 37.

Otherwise (3452), if the ball rests within 120 yards of the hole (but, thus, not on the green) (3460) the next shot is a chip shot, proceeding (3461) to FIG. 36.

Otherwise (3462), if the ball rests within 170 yards of the hole (3470) the next shot is an approach shot, proceeding (3471) to FIG. 35.

Otherwise (3472), if the ball rests more than 170 yards from the hole (3480) the next shot is another drive shot, proceeding (3481) to FIG. 34.

The Approach Shot: As depicted in FIG. 35, the procedure for an approach shot (3500) is fairly similar to that for a drive shot with a few exceptions. First, instead of relying on the directional die to determine, at random, which of the (generally) three directional paths the ball will land on, the player declares which path they desire. This reflects that approach shots are shorter, use different clubs, and there is more control. The directional die is still rolled, however, in order to determine the roll/drop condition.

There are also three additional outcomes for when the ball lands right at, or rolls right to the cup (and one outcome, the drive, omitted). First (3580), if the ball is at the hole distance exactly; and, double sixes is not rolled from a shot that originated more than 150 yards from the hole, or no double is rolled from a shot that originated within 150 yards from the hole; the result is a putt on the player's next shot leading (3581) to FIG. 37.

Otherwise (3582), if the ball is at the hole distance exactly; (3590) the directional die is a roll; and, a double sixes is rolled from a shot that originated more than 150 yards from the hole, or double 2 through double 5 is rolled from a shot that originated within 150 yards from the hole; the result is a 'gimme' on the player's next shot leading (3591) to FIG. 46.

Otherwise (3592), if the ball is at the hole distance exactly; (3595) the directional die is a drop; and, a double sixes is rolled from a shot that originated more than 150 yards from the hole, or double 2 through double 5 is rolled from a shot that originated within 150 yards from the hole; or, a double six is rolled from a shot that originated from within 150 yards of the hole with either a drop or a roll on the directional dice; the result is a sink, the hole is complete and, on the player's next shot, he proceeds (3596) to FIG. 32, a new hole.

The Chip Shot: As depicted in FIG. 36, the procedure for a chip shot (3600) is defined as applying when the ball is within 120 yards of the hole, but not yet on the green.

Either no club die is used for the chip shot or, alternatively, a pitching wedge die (2904) is provided (3611). The directional die (3612) and the two play dice (3613) are used (3620).

Two play dice conditions supersede even calculating distance. First, if the play dice roll a double, and the directional dice (used for drop/roll only, this is also a declared direction shot) roll is a drop (3630) the outcome is a sink and the hole is complete. The player proceeds (3631) to a new hole on their next turn which is shown in FIG. 32. Otherwise (3632), if the play dice roll a double, and the directional dice roll is a roll (3640) the outcome is a 'gimme' and the player proceeds (3641) to FIG. 46 on their next turn.

Otherwise (3642), the new ball position is calculated (3650) as the sum of the play dice (since, as the default option, no club die is used) time 10 yards, with the directional path declared by the player. The optional wind, and DD=roll/SP factors are applied as described for the drive shot.

If the ball overshoots the hole (3660) an out of bounds condition results in proceeding (3661) to FIG. 33. The conditions for hazard (3670), putt (3680) and chip (3690) shots are as described previously.

The Putt Shot: Once a player reaches the green, on their next shot they start putting. Unlike other shots which are interleaved with other players' round-robin style, when a player putts, they monopolize the game with an OTR mechanism called odd/even play, until their shot is done.

As depicted in FIG. 37, the procedure for putting (3700) applies when the ball is on the green. Either no club die is used for putting or, alternatively, a putter die is provided (3711). The directional die is not (3712) and the one (at the beginning) or two play dice are (3713) used (3710, 3720).

To start, one play die is rolled (3713) to establish a parity or 'toggle value' (abbreviated as TV or T.V.) of either 'odd' or 'even'. Then (3720) two dice are rolled and either match the toggle value in the parity of their sum or not. Then (3730), if there is not a match (3731) the toggle value is toggled (3732). That is: if the toggle value is even, it is set to odd; and, if the toggle value is odd, it is set to even. One stroke is added to the player's score (3733). And, in OTR fashion, the player rolls again (3734), completing (3735) an OTR loop.

Otherwise (3737), success (3740) is achieved: if the parity of the sum of the play dice matches the toggle value (3741), or the roll is any double (including 1/1) (3742), the putt is sunk (3743), and on the player's next move they proceed (3745) to a new hole, as per FIG. 32.

Out of Bounds: When encountered in a number of these algorithms, the out of bounds condition (3300) is depicted in FIG. 33. If ball location lands in a hazard (3311), move the ball near the same marker location, but just outside hazard area (3312); add one stroke to score as out of bounds penalty (3320); and, proceed with next shot (3330). If distance to hole is more than 170 yards of the hole (3331) proceed to another drive; otherwise, if distance to hole is within 170 yards of the hole (3332) proceed to an approach shot.

Gimme Shot: When encountered in a number of these algorithms, the 'gimme' procedure (4600) is depicted in FIG. 46. Like putting, this is an example of another OTR loop, although with a relatively low probability of occurring. Two dice are rolled (410) and if the outcome (4620) is double ones (4621) then a stroke is added (4622) and the player rolls again (4623) closing the OTR loop (4624).

Otherwise (4625) almost certain success (4626) sends the player to a new hole on their next shot via FIG. 32.

Determining Appropriate Next Shot: When encountered in a number of these algorithms, the 'take appropriate shot' selection procedure (4500) is depicted in FIG. 45.

First, if the ball has landed in a hazard area (4511) proceed (4512) to decision (4520); where:

a. If the player is coming out of a rough or D1 sand trap hazard on the fairway and had rolled a double 2 through double 6 (4521), hazard protection is afforded and the ball moved near same distance marker location, but just outside hazard area (4522), and the next shot is a drive (4523) proceeding (4524) to FIG. 34; or, b. Otherwise (4525), the next shot proceeds from the hazard area landed within, and the player proceeds (4533) to FIG. 38.

Otherwise (4513), if the ball is on the green (4531) the next shot is a putt (4532) and play proceeds (4526) to FIG. 37.

Otherwise (4534), if the ball is within 120 yards of the hole (4541) the next shot is a chip shot (4542) and play proceeds (4543) to FIG. 36.

Otherwise (4544), if the ball is within 170 yards of the hole (4551) the next shot is an approach shot (4552) and play proceeds (4553) to FIG. 35.

Otherwise (4554), the ball is more than 170 yards from the hole (4561) and the next shot is a drive shot (4562) and play proceeds (4563) to FIG. 34.

Hazards: The hazard procedure begins with a hazard selection process as depicted in FIG. 38:

If the hazard type is water (3811) proceed (3815) to FIG. 39.

If the hazard type is trees (3821) proceed (3825) to FIG. 40.

If the hazard type is a rough or a sand trap of lower difficulty (D1) and the ball is on the fairway (3831) proceed (3835) to FIG. 41.

If the hazard type is a sand trap of higher difficulty (D2) and the ball is on the fairway (3841) proceed (3845) to FIG. 42.

If the hazard type is a rough or a sand trap of lower difficulty (D1) and the ball is on the green (3851) proceed (3855) to FIG. 43.

If the hazard type is a sand trap of higher difficulty (D2) and the ball is on the green (3861) proceed (3865) to FIG. 44.

There are Five types of hazards: water (3006, FIG. 39), trees (3007, FIG. 40), rough (3010, FIGS. 41 and 43), sand traps of depth or difficulty 1 (D1) (3008, FIGS. 41 and 43), and sand traps of depth or difficulty 2 (D2) (3009, FIGS. 42 and 44). The last three are treated differently on the green (FIGS. 41 and 42) and fairway (FIGS. 43 and 44). In the example preferred embodiment described herein, rough and D1 are treated the same but, optionally, each have their Own unique mechanism. This specific correspondence between the landscape features depicted and the particular game mechanism associated with each type goes to making OTR Golf and authentic and satisfying game for those familiar with playing golf.

Water: For example, the water hazard mechanism (3900) depicted in FIG. 39 reflects the fact that, generally, despite cartoons of golfers in wading boots shooting from a pond, golfers drop a new ball at the edge of the water hazard and take a penalty stroke. In OTR Golf the player adds a one stroke penalty to their score (3910) or in accordance with professional golf, moves the ball token to position just outside hazard area adjacent to the current distance marker (3920), and takes the appropriate shot on their next turn (3930) as determined by the procedure in FIG. 45.

Trees: Trees have a similarly realistic mechanism in that when hitting out of trees the luck (or skill) is having the ball travel without bouncing off a tree back into the hazard area;

the choice of club has little to do with it, and the hope is to get out of the hazard area without expecting it to go very much further, or worrying overly much about exactly which direction the ball goes in when it stops bouncing. Further, it may take several attempts to free oneself from the trees and these shots are taken in succession without waiting for one's golfing buddies to shoot their turns in between.

These features are reflected in that for the tree hazard no club die but the randomizing directional die is used with the play dice (4020). Further the open-ended OTR Odd/Even Play Mechanism is again used.

A single play die is used to establish an opening odd or even toggle value (4014), although, alternative options include either value being used as the default opening value, the player may choose the opening value they consider to be 'lucky' or the toggle value may be fixed at odd or even for the entire play of the hazard.

Then the loop of (4020, 4021, 4030, 4031 or 4032, 4033, 4034 and 4035) is repeated for an open-ended, arbitrary number of iterations, until success is achieved. That is, if the parity of the roll of two play dice (4020) does not match the toggle value (4031) or a double 1 muff (4032) is shot: the toggle value is toggled from odd-to-even or even-to-odd (4033), a penalty stroke is added to the player's score (4034), and the process is repeated (4035).

Otherwise (4036) upon the successful roll of the two play dice matching the current toggle value (4041) the ball is progressed by the club independent distance of the higher value of the two play dice.times.10 yards (4042) a maximum of 60 yards. The directional die, optional wind factor, and roll/slant factors are then applied as usual.

Other Hazards: Of the three other hazards rough and shallow sand traps are treated the same (in this preferred embodiment but, alternatively will each have a unique play mechanism) and deep sand traps are treated separately. This is because in golf, the nature of rough or shallow sand is that a choice of club makes a difference in how the shot is played; but, in a deep sand trap, the sand wedge is a must and just getting out of the hole is the goal.

Further, these are played differently depending upon whether you are on the fairway (wanting distance) or green (wanting accuracy).

This is reflected in four more hazard mechanisms which are detailed in:

FIG. 41 for rough or D1 trap on the fairway;

FIG. 42 for a D2 trap on the fairway;

FIG. 43 for rough or D1 trap on the green; and,

FIG. 44 for a D2 trap on the green.

However, main features that differ among the above include that, as elsewhere in this preferred embodiment, the random directional die is used on the fairway to establish the less accurate results of drives; and, the declared direction on the green establishes that short shots permit more accuracy. Further, the wind and roll/slant factors are utilized only on the fairway. In addition, on drives the choice of clubs (at least for the rough/D1) is used because for these shallow hazards the choice is effective.

On the green the play dice are used to simulate statistics for putting outcomes, as there is generally no choice of club for putting, although a putter die is supplied as an optional alternative. Similarly, although FIG. 42 covers a fairway situation, the play dice determine outcome and distance, and there is no club die selected. This is because in a deep sand trap (as with putting), there is generally no club choice, a Sand Wedge is used. Nevertheless a S.W Die (2904) is optionally supplied as an alternative.

In all cases the open-ended OTR Odd/Even Play Mechanism is utilized with special meanings generally applied to double ones (muff), double twos through fives (good) and double sixes (better). As before, the player monopolizes the game, in OTR fashion, until they have cleared the hazard.

Basketball Preferred Embodiment

The OTR mechanism and over all style of game play has also been applied in Basketball in the following examples:

Offensive and Defensive strategies are selected prior to rolling the dice. Then each team flips their card before proceeding with a series of one die rolls (The series of rolls aimed at crossing the court and scoring.) Depending on what each team selects for OFF and DEF strategies the OFF will either gain the value of their roll or gain the difference between the OFF and DEF rolls.

There are charts in the classic OTR listing style for specific play functions and outcomes such as A chart for "Advancing rolls".

A chart for "Shooting in the zone".

A chart for the "Rebound of a missed shot".

All OFF and DEF materials including the dice are determined by the colors Green for OFF and Red for DEF.

The dice structure remains consistent with Hi/Lo and Equal Values, Matched Sums, and Hi/Lo and Equal Doubles all having various outcomes to OFF and DEF advantages.

Game momentum cards that are earned through various rolls and chart directives, will be able to effect play of the game.

Several examples of the OTR mechanism are provided below.

1. Equal values during advancement rolls each team continues to roll until someone wins which may lead to a DEF or OFF foul if three rolls of equal values occurs resulting in additional rolls for foul line points.
2. Equal sums on shot rolls (Player rolls to get basket). There are rebound rolls if the player misses the shot to see if the OFF or DEF gets the rebound or they continue to roll if equal values until someone gains possession.

An example of a basketball chart can be found in FIG. 50.

Application of the OTR Mechanism to Additional Sport Games

A common element of all of the OTR games is the dynamic manner in which dice rolls are used to advance play and maintain excitement for the players. As shown in FIG. 28, each of the games described in the instant application utilizes this mechanism differently to reflect the aspects of the particular game that require such momentum. The use of the OTR technique has been shown in only a few games herein, but it is clear that it can be used to great advantage in a wide range of games, whenever open-ended dynamic fast paced play is needed.

The following outlines, and provides examples of, the application of the OTR Mechanism to other games including Basketball, Hockey and Boxing; and, also describes the overall approach used to incorporate the OTR Mechanism into game designs for additional OTR games.

A well-organized set of OTR game components generally includes, without limitation: an array of charts; game rules; dice rolling outcomes and rules; simultaneous action; and, in particular, the OTR Mechanism of continuing rolls to complete a play. These are combined to provide coherent and realistic game structures, which authentically balance skill and chance, to further produce a sense of being able to influence the outcome of the game, leavened with unpredictability.

For example, with Basketball each team continuously rolls their dice simultaneously as they quickly advance across the court. A Ball Die is rolled by one of the offensive players and represents possession of the ball. In addition, a set of Team Dice (each team member rolls one) are matched up against the opposite player in a man-to-man defense configuration to determine movement up/down the court. However, at some points during play, if the defense chooses to take a zone defensive position, the offense and defense would not roll simultaneously with each other until the offense enters the zone of the defender, or the defender moves closer to the offense upon completion of the roll. For each pair of matched offense/defense players:

- if offense rolls higher than defense the pair of players moves in the offensive direction by the amount of the offensive roll;
- if defense rolls higher than offense the pair of players move in the offensive direction by the amount of the difference between the pair of dice;
- if players tie on the roll there is no movement, but there is an option to pass the ball; but,
- another option for passing is when a player rolls a six beating the defender's value; but,
- in the extreme situation (with standard dice) where one player rolls a six, and the other player rolls a one, a foul (or, more generally, a penalty) is called on the losing player.

Penalties include, for example, Traveling in Basketball (or Boarding in Hockey), and calling a penalty stops the clock.

With the OTR penalty system you first find on the chart the appropriate 1 vs. 6 (or, other defined penalty situation) outcome and then follow the directive of what to do next. Each type of game will have penalties and infractions appropriate to the game being played. In this exemplary case, a penalty card must be drawn by the Offense (OFF) or Attacking Team (AT) team (as appropriate), which will indicate the type of infraction and the prescribed procedure to follow to affect game play. See FIG. 48.

Easy-to-read game charts are also provided using a consistent layout of OFF (Offense) or AT (Attacking Team) and DEF (Defense) or DT (Defending Team) and Outcome, which is optionally modified by Coverage (defense strategy options) where applicable.

For one other example, in Hockey, where the Attacking Team and Defending Team roll simultaneously, whichever team rolls a higher value advances the marker (more generally a team marker, ball, puck, etc.) along the arena (more generally, the field, court, rink, etc.) an amount (generally, yards, ice points, distance points, etc.) representing the value of their roll, in the direction of their choice. This 'choice in direction' optionally represent an alternative to the simple choice of back and forth advancement (such as football yardage). With 'choice of direction' multiple sets of movement markers offer the players a variety of options for advancement along, for example, the center, left, and right sides of the rink (or, more generally, court, field or other playing arena). Alternatively, more than three tracks are provided; for example, center, mid-left, mid-right, extreme-left and extreme-right.

Turnovers are less rapid in Basketball than in Hockey. This difference is reflected in FIGS. 49 and 50, advancement charts for the two games. A Pass can be attempted to another teammate (if there is more than one player on a team), but only if that other teammate has beaten the roll of the opposing player they are paired with at the time. In basketball a player is eligible for a shot when they reach either the two point or three point zone for shooting.

In both Hockey and Basketball, if there are, on each team, more than one player, each player has a token representing their player on the field of play and a uniquely marked play die. All players roll simultaneously for their own respective position, using the game tokens to indicate their player and position as the team advances. Each player works (although separately) in concert with the other teammates. For example, if a 1 vs. 6 outcome were rolled between two players without possession, neither of which has possession of the ball, a penalty has occurred which would stop the game clock and create a penalty time-out condition.

There are also bonus cards that by are labeled with a name appropriate to the terminology or event of the particular game or sport being modeled. These provide opportunities to model game changing advantages/disadvantages for both the Offense and the Defense. These cards are obtained as a result of a particular roll, usually Double Ones or Double Sixes or, where a single play die is rolled, a 1 vs. 6 outcome. They provide a mechanism for modeling complex, randomly presented, game situations that offer more options than the random outcome of one or more dice. These realistic conditions, modeling situations in a particular sport, would otherwise be extremely complicated to provide in a game dependent solely upon dice outcomes. The cards, optionally, include further dice rolling to complete a play, or simply provide some procedure to follow, or an opportunity that may be applied to the play immediately or held in abeyance.

As described above, in response to a 1 vs. 6 roll in Basketball: the game clock stops; and, the OFF (or DEF, depending on who got the 1 and who got the 6) draws a Violation Card. An example of the text supplied on such a card is:

> "AT VIOLATION CARD: AT charges the DT on a lay-up shot, knocking player over. DT gets 2 Free Throws and takes a Free Throw card"

When a team draws a violation card that awards them a Free Throw they may also, optionally, be awarded a Free Throw Bonus card. The Free Throw bonus cards can be used immediately, or may be saved without revealing it to the other team at the time it is drawn. They may choose to use it when desired and appropriate. An example of the text supplied on such a card is:

> "FREE THROW CARD: DT tips ball out of AT hands and takes possession of rebound. Use this card to reward your team with a rebound when you have lost the roll for a rebound."

The above violation card includes the eligibility to take a Free Throw card. With this bonus the team in possession of the card can obtain an important rebound at a time when they would have lost the roll for the rebound.

Hockey uses the same format of penalty and Bonus card use, the only difference being the game terminology and types of penalties. An example of the text supplied on such a card is:

> "DT PENALTY CARD: DT while checking AT conducts unnecessary contact and violently knocks AT to the boards. DT loses one player for two minutes AT Draw a Rink Card"

The result of the above card is that, in the event that only two players are playing the game (i.e., one on each side or team) the AT will have an advantage rolling situation against the DT for two minutes. If there are more than one player on each team playing the game, the team loses one of their players for the duration of the penalty.

The next card reflects the eligibility of taking a Rink card. With this card, the DT could stop a potential scoring play by the AT after a successful pass, by throwing the card down, forcing a Face-Off An example of the text supplied on such a card is:

"RINK CARD: AT passes puck from defending zone across red center line. Two line pass by the AT. Both teams engage in a face-Off"

For Boxing a figure of a boxer will be shown for each player, with contact points listed upon the body that correspond to dice rolling outcomes. Thus, when a player rolls, for example, Double two's, that player will know where the punch hit on the body and will score according to the rules of professional boxing for that type of punch. The dice rolling takes place in a model Ring designed to represent professional Boxing specifications.

An example of a typical Boxing chart is FIG. 51. A fighter is scored by the amount of landed scoring punches verses how many he has thrown in several categories of types of punches.

In the case shown in the top entry in FIG. 51, the punch landed but was not in a highly effective area, based on the fact that a seven can be rolled six different ways, making it the most common outcome and therefore, in OTR Boxing, not a particularly impressive punch.

In the second entry in FIG. 51, Fighter One rolled doubles—a one in 30 roll chance—making it a highly effective punch. In addition Fighter One is given a second, undefended punch as, in theory, Fighter Two was caught off guard and Fighter One took advantage of that situation. Fighter One would score nicely in this round of punches.

The OTR style of simultaneous and continuing roll of the dice, until completion of a play is reached, is achieved in Boxing in the following way. The fighters consistently roll together. If a fighter throws any Doubles (or other specific roll outcomes), then the fighter would get an extra roll alone that would score. If that second solo roll resulted in Doubles (or other hard to roll outcomes) again, they would continue the procedure until no more rolls warranting additional free rolls or Doubles are rolled. This, by design, could put the opponent up against the ropes imposed by a dominant array of punches from the other opponent. Naturally, Double Sixes (the highest doubles outcome, with 1 in 36 odds for a pair of standard dice) results in a knock down. The player knocked down then rolls alone. The player must roll a six within eight rolls (equivalent to an eight count) or the fight is over.

True to the OTR style of game play, certain rolls will produce a penalty outcome of some sort, and the player who is violated will receive a Referee card, which has bonuses that can be used during the fight, to that fighter's advantage.

Rules and Fighting Figures for Kickboxing, and forms of Karate, use the same format, the only difference being that there is a much larger area of body contact for those sports.

This same format is used for additional games such as Car Racing, Drag Racing, or Horse Racing, where the opponents are identified by distinct (e.g. differently colored) Tokens, and advancement is established by simultaneous repeated rolls switching between Single and Double Die rolls. For example, in Auto Racing, where the racers are on the track, various rolls have different specific outcomes, such as Doubles affording a player an Extra Roll prior to resuming regular rolling with others who do not have Doubles. Such Extra Rolls can provide acceleration on a straightaway, but can be dangerous when, or if, approaching the apex of a turn. Markings on the track—or indicated in an associated guide—indicate that certain rolls in an area will produce trouble. For instance, on turn A of the track any Doubles except DOUBLE Sixes, rolled while passing through this area, will produce a fishtailing of the rear wheels of the vehicle, causing the Racer to be faced with a potential accident in which others, if present, are potentially involved. There are also, optionally, 1 vs. 6 or Double One rule outcomes, where a potential game-terminating accident has a chance of occurring between two or more racers. The players move their vehicles along the various track designs encountering hazards, mutual crashes, and other related difficulties—or successes—by roll outcomes and card earning, as a result of any particular roll.

Track Cards provide bonuses, such as "Driver miraculously makes it through the fire and debris to continue the race." This would allow a racer to escape an otherwise game-terminating event, where another Racer, without such a card, would be eliminated.

Further games adaptable to this OTR style of game design and modeling include Tennis—where the players realize their serves and shot results by strategically labeled court markings at, for example, left, right and center sections of the court. Ranking of bad to great shots are determined by most probable to least probable rolls. These represent and interact with specific location on the court, and the receiving opponent's anticipated positioning for the serve, prior to the serve by the opponent. As with other OTR games there are also cards which give a player an advantage on a play, and these are earned by specific rolls during game play.

Throughout all OTR games:

formulation of charts or tables showing OTR dice outcome;

penalty and bonus card earnings;

continuing, simultaneous rolling to complete a play, and authentic looking game boards are incorporated to achieve an authentic result modeling well the events of the particular game or sport being played.

Intellectual Property

The graphics and layouts of boards, graphics and configuration of pieces, algorithms and rules of play, steps described and/or depicted in any flow diagram, and other elements disclosed herein, are exemplary and not necessarily shown to scale. A number of alternatives for each element have been disclosed, as have specific choices of alternatives comprising some specific preferred embodiments. To whatever degree these alternatives are not in conflict, any and all of the alternatives for any element are practiced, in any combination, with any and all of the alternatives for other elements, in order to create alternative preferred embodiments of the instant invention. Furthermore, certain steps or other elements may be arranged differently, combined, separated, modified or eliminated entirely, without deviating from the intended scope of the invention. In addition, substitution, such as spinners, cards or other randomizing elements in place of dice, or cards; alternative configurations, colors or symbols for dice, or other elements; alternative formats; etc. are within the scope of the instant invention.

Further, these elements can be combined with elements of other games, now in existence or later developed, without deviating from the intended scope of the invention. Additionally, any method of manufacture, publishing or distribution of physical game boards and pieces used to play such games, now known or later developed, is intended to be within the scope of the instant invention.

The contents of the disclosure of this patent document, and the accompanying figures, is copyright to the inventor and/or practitioner. The copyright owners have no objection to the facsimile reproduction (but not further publication or distribution) of the patent document or the patent disclosure, as it appears as issued by the Patent and Trademark Office, to the extent permitted by law. Written permission of the appropriate copyright holder must be obtained for any other use. Copyright holder otherwise reserves all copyright rights whatsoever, including the right to excerpt, compile or otherwise alter or adapt, or make any other use of, this information.

Further, the name On-The-Roll and other names, and any other trademarkable elements of the games, are trademarked to the inventor.

In any event, any publication of or about any of the information contained herein must contain appropriate patent, trademark and copyright notices.

It will thus be seen that the objects set forth above, among those made apparent from the preceding description, are efficiently attained and certain changes may be made in carrying out the above method and in the construction set forth. Accordingly, it is intended that all matter contained in the above description or shown in the accompanying figures shall be interpreted as illustrative and not in a limiting sense.

Although the present invention has been described in considerable detail with reference to certain preferred versions thereof, other versions are possible. Therefore, the spirit and scope of the appended claims should not be limited to the description of the preferred versions contained herein.

What is claimed is:

1. A football board game, comprising:

a game board depicting a traditional football field comprising field markings, the field markings comprising opposing sidelines, opposing goal lines, opposing end zones, opposing end lines, a plurality of substantially parallel yard lines that cross the depicted traditional football field between the opposing sidelines, and a plurality of hash marks;

opposing combination football team tokens and football team markers, comprising opposing football team tokens removably mounted on opposing football team markers, the opposing football team tokens representing traditional opposing football teams and traditional team formations, the opposing football team tokens comprising offensive football team tokens and defensive football team tokens, the opposing football team markers comprising an offensive football team marker and a defensive football team marker, the offensive football team marker and the defensive football team marker each comprising a substantially translucent base straddling the game board between the opposing sidelines, the substantially translucent base adapted to facilitate viewing the field markings, the offensive football team marker and the defensive football team marker each comprising a front lip and a rear roll bar, the front lip and the rear roll bar of the offensive football team marker and the defensive football team marker each adapted to facilitate movement of the offensive football team marker and the defensive football team marker, the front lip of the offensive football team marker and the front lip of the defensive football team marker facing one another, the rear roll bar of the offensive football team marker and the defensive football team marker each comprising opposing rollers or wheels adapted to facilitate rolling or sliding movement on the traditional football field, the offensive football team marker comprising a measuring wheel or other like device adapted to measure distance bidirectionally along the traditional football field, the measuring wheel comprising a bidirectional yardage indicator adapted to indicate net distance travelled by the offensive football team marker as the offensive football team marker travels up and down the traditional football field, the offensive football team marker further comprising a sliding scrimmage marker adapted to indicate a line of scrimmage along the traditional football field, the offensive football team marker further comprising an adjustable down marker adapted to indicate one of four possible downs, a ten yard marker adapted to indicate ten hash marks of the plurality of hash marks within the four possible downs;

sets of specially marked opposing team dice, the sets of specially marked opposing team dice comprising a set of offensive team dice and a set of defensive team dice, the offensive team dice and the defensive team dice each having indicia that distinguish the offensive team dice from the defensive team dice and vice versa, and that signify numerals one through six, a pair of combination punt and field goal dice having other indicia that signify other numerals in increments of five, kick off dice having yet other indicia that signify yet other numerals in increments of five;

a game clock adapted to indicate quarter time during each quarter and limit duration of the each quarter, the game clock limiting duration of the each quarter and duration of total game play;

a play clock adapted to indicate play time during each game play of a plurality of game plays and limit duration of a play selection period of a plurality of play selection periods, the play clock limiting duration of the each play selection period of the plurality of play selection periods for rolling the sets of specially marked opposing team dice, the play clock synchronized with the game clock, the game clock stopping the play clock at the end of the each quarter;

a plurality of game play strategy cards, comprising a plurality of offensive strategy play cards, a plurality of defensive strategy play cards, and a plurality of special teams strategy play cards, comprising a plurality of play types and play moves;

a plurality of game play strategy look up tables, comprising a plurality of offensive strategy look up tables, a plurality of defensive strategy look up tables, and a plurality of special teams strategy look up tables, comprising additional plays and play moves;

movement and yardage of the opposing combination football team tokens and football team markers during the each game play of the plurality of game plays during the each quarter determined:

1) first by score of one of the kick off dice and score of the sets of specially marked opposing team dice, which determine a game play winner, and then by 2) a game play strategy card of the plurality of game play strategy cards in combination with an auxiliary planned game play and auxiliary planned movement selected by the game play winner from a game play strategy look up table of the plurality of game play strategy look up tables, the score of the sets of specially marked opposing team dice and the planned game play in combination with the planned movement selected by the game play winner determining the game play outcome of the each game play of the plurality of game plays;

the opposing combination football team tokens and football team markers being moved on the game board, in accordance with the game play outcome;

the ten yard marker, the adjustable down marker, and the sliding scrimmage marker being moved along one of the opposing sidelines, in accordance with the game play outcome of the each game play of the plurality of game plays;

a game winner determined by maximum number of goal line scores completed by a team of the opposing football team tokens.

2. The football board game according to claim 1, further comprising:

computer client devices adapted to facilitate playing the football board game by the players.

3. The football board game according to claim 2, wherein:

the computer client devices are from the group consisting of:

tablets, personal computers, laptops, cell phones, client devices, client devices communicating with one another, stand alone client devices, wireless client devices, wired client devices, client devices connected to the internet, client devices connect to a network, client devices adapted to facilitate play and provide additional information to players playing the football board game, and any combination thereof.

4. The football board game according to claim 1, wherein:

the traditional football field is constructed of material adapted to affect bounce and/or roll of dice thrown onto the traditional football field.

5. The football board game according to claim 4, wherein:

the material adapted to affect the bounce and/or the roll of the dice thrown onto the traditional football field is from the group consisting of:

carpeting, rubber, thermosetting polymers, polyethylene, vinyl, low pile carpet, medium pile carpet, high pile carpet, different density materials, materials of different resiliency, and any combination thereof.

6. The football board game according to claim 1, further comprising:

a locking mechanism adapted to releasably lock the sliding scrimmage marker into an extended position or a retracted position.

7. The football board game according to claim 1, wherein:

the football board game is of knockdown construction.

* * * * *